US008774429B2

(12) United States Patent
Takano et al.

(10) Patent No.: US 8,774,429 B2
(45) **Date of Patent: *Jul. 8, 2014**

(54) VOICE INPUT DEVICE, METHOD FOR MANUFACTURING THE SAME, AND INFORMATION PROCESSING SYSTEM

(75) Inventors: Rikuo Takano, Ibaraki (JP); Kiyoshi Sugiyama, Tokyo (JP); Toshimi Fukuoka, Kanagawa (JP); Masatoshi Ono, Ibaraki (JP); Ryusuke Horibe, Osaka (JP); Fuminori Tanaka, Osaka (JP); Takeshi Inoda, Osaka (JP)

(73) Assignees: Funai Electric Advanced Applied Technology Research Institute Inc., Osaka (JP); Funai Electric Co., Ltd., Osaka (JP)

( * ) Notice: Subject to any disclaimer, the term of this patent is extended or adjusted under 35 U.S.C. 154(b) by 713 days.

This patent is subject to a terminal disclaimer.

(21) Appl. No.: 12/994,137

(22) PCT Filed: May 20, 2009

(86) PCT No.: PCT/JP2009/059292
§ 371 (c)(1),
(2), (4) Date: Mar. 17, 2011

(87) PCT Pub. No.: WO2009/142249
PCT Pub. Date: Nov. 26, 2009

(65) Prior Publication Data

US 2011/0158454 A1 Jun. 30, 2011

(30) Foreign Application Priority Data

May 20, 2008 (JP) ..... P2008-132458

(51) Int. Cl.
*H04R 3/00* (2006.01)

(52) U.S. Cl.
CPC ..... *H04R 3/00* (2013.01)
USPC ..... 381/122; 381/92

(58) Field of Classification Search
CPC ..... H04R 3/00; H04R 3/005; H04R 3/04
USPC ..... 381/104, 92, 91, 355, 356, 369, 111, 381/170, 173, 174, 361, 362, 122, 381/71.1–71.8, 71.11–71.13, 94.1–94.4; 455/569.1, 550.1; 29/294, 602.1; 704/200, 231, 251
See application file for complete search history.

(56) References Cited

U.S. PATENT DOCUMENTS 4,131,760 A * 12/1978 Christensen et al. ..... 381/66
5,757,933 A 5/1998 Preves et al.

(Continued)

FOREIGN PATENT DOCUMENTS

EP 2101513 A1 9/2009
EP 2101514 A1 9/2009

(Continued)

OTHER PUBLICATIONS

International Search Report w/translation from PCT/JP2009/059292 dated Sep. 15, 2009 (6 pages).

(Continued)

*Primary Examiner* — Lun-See Lao
(74) *Attorney, Agent, or Firm* — Osha Liang LLP

(57) ABSTRACT

A voice input device, a method for manufacturing the same, and an information processing system are provided. The voice input device has a function of removing a noise component and includes a first microphone 710-1 that includes a first vibrating membrane, a second microphone 710-2 that includes a second vibrating membrane, and a differential signal generation section 720 that generates a differential signal between a first voltage signal and a second voltage signal. The first and second vibrating membranes are disposed so that a noise intensity ratio is smaller than an input voice intensity ratio that represents the ratio to intensity of an input voice component. The differential signal generation section 720 includes a delay section 730 and a differential signal output section 740 that generates and outputs a differential signal with respect to a signal to which a delay is applied by the delay section.

8 Claims, 49 Drawing Sheets

(56) References Cited

U.S. PATENT DOCUMENTS

| | | | | |
|---|---|---|---|---|
| 5,825,897 | A * | 10/1998 | Andrea et al. | 381/71.6 |
| 7,092,539 | B2 * | 8/2006 | Sheplak et al. | 381/114 |
| 2001/0028718 | A1 | 10/2001 | Hou | |
| 2006/0140431 | A1 * | 6/2006 | Zurek | 381/355 |
| 2007/0047746 | A1 * | 3/2007 | Weigold et al. | 381/174 |
| 2007/0237345 | A1 * | 10/2007 | Zhang et al. | 381/113 |

FOREIGN PATENT DOCUMENTS

| | | | |
|---|---|---|---|
| JP | 57-020088 | A | 2/1982 |
| JP | 1-152900 | A | 6/1989 |
| JP | 4-217199 | A | 8/1992 |
| JP | 6-153289 | A | 5/1994 |
| JP | 7-312638 | A | 11/1995 |
| JP | 8-256196 | A | 10/1996 |
| JP | 9-331377 | A | 12/1997 |
| JP | 2001-186241 | A | 7/2001 |
| JP | 2003-032779 | A | 1/2003 |
| JP | 2005-247181 | A | 9/2005 |
| JP | 2006-191359 | A | 7/2006 |
| JP | 2007-228300 | A | 9/2007 |
| WO | 2005055644 | A1 | 6/2005 |
| WO | 2008/062850 | A1 | 5/2008 |

OTHER PUBLICATIONS

Written Opinion from PCT/JP2009/059292 dated Sep. 15, 2009 (9 pages).

Espacenet abstract Publication No. JP2003032779A dated Jan. 31, 2003 (1 page).

Espacenet abstract Publication No. 57020088A dated Feb. 2, 1982 (1 page).

Espacenet abstract Publication No. JP6153289A dated May 31, 1994 (1 page).

Espacenet abstract Publication No. JP7312638A dated Nov. 28, 1995 (1 page).

Espacenet abstract Publication No. JP9331377A dated Dec. 22, 1997 (1 page).

Espacenet abstract Publication No. JP2001186241A dated Jul. 6, 2001 (1 page).

Espacenet abstract Publication No. JP1-152900 dated Jun. 15, 1989 (1 page).

Espacenet abstract Publication No. JP4217199A dated Aug. 7, 1992 (1 page).

Espacenet abstract Publication No. JP8256196A dated Oct. 1, 1996 (1 page).

Espacenet abstract Publication No. JP2005247181A dated Sep. 15, 2005 (1 page).

Espacenet abstract Publication No. JP2006191359A dated Jul. 20, 2006 (1 page).

Espacenet abstract Publication No. JP2007228300A dated Sep. 6, 2007 (1 page).

Espacenet abstract Publication No. WO2008062850A1 dated May 29, 2008 (1 page).

Extended European Search Report for Application No. 09750611.7 dated Dec. 15, 2011(12 pages).

* cited by examiner

1kHz

Δr=5mm

MICROPHONE-SOUND SOURCE DISTANCE: 2.5 cm

1kHz

Δr=5mm

MICROPHONE-SOUND SOURCE DISTANCE: 1 m

1kHz

Δr=10mm

MICROPHONE-SOUND SOURCE DISTANCE: 2.5 cm

1kHz

Δr=10mm

MICROPHONE-SOUND SOURCE DISTANCE: 1 m

1kHz

Δr=20mm

MICROPHONE-SOUND SOURCE DISTANCE: 2.5 cm

1kHz

Δr=20mm

MICROPHONE-SOUND SOURCE DISTANCE: 1 m

7kHz

Δr=5mm

MICROPHONE-SOUND SOURCE DISTANCE: 2.5 cm

7kHz

Δr=10mm

MICROPHONE-SOUND SOURCE DISTANCE: 2.5 cm

7kHz

Δr=10mm

MICROPHONE-SOUND SOURCE DISTANCE: 1 m

7kHz

Δr=20mm

MICROPHONE-SOUND SOURCE DISTANCE: 2.5 cm

7kHz

Δr=20mm

MICROPHONE-SOUND SOURCE DISTANCE: 1 m

300Hz

Δr=5mm

MICROPHONE-SOUND SOURCE DISTANCE: 2.5 cm

300Hz

Δr=5mm

MICROPHONE-SOUND SOURCE DISTANCE: 1 m

300Hz

Δr=10mm

MICROPHONE-SOUND SOURCE DISTANCE: 2.5 cm

300Hz

Δr=10mm

MICROPHONE-SOUND SOURCE DISTANCE: 1 m

300Hz

Δr=20mm

MICROPHONE-SOUND SOURCE DISTANCE: 2.5 cm

300Hz

Δr=20mm

MICROPHONE-SOUND SOURCE DISTANCE: 1 m

VOICE INPUT DEVICE, METHOD FOR MANUFACTURING THE SAME, AND INFORMATION PROCESSING SYSTEM

TECHNICAL FIELD

The present invention is related to a voice input device, a method for manufacturing the same, and an information processing system.

BACKGROUND ART

During a telephone call, voice recognition, voice recording, or the like, it is desirable to pick up only desired sound (user's voice). However, in an environment in which a voice input device is used, sound such as background noise other than desired sound may be present. Therefore, a voice input device which has a function of removing noise has been developed.

As a technique for removing noise in a usage environment in which noise is present, a method which provides a microphone with sharp directivity and a method which detects the arrival directions of sound waves using the difference in arrival time of sound waves and removes noise through signal processing are known.

Moreover, in recent years, electronic apparatuses have been scaled down, and a technique for reducing the size of a voice input device has become important.

CITATION LIST

[PTL 1] JP-A-7-312638
[PTL 2] JP-A-9-331377
[PTL 3] JP-A-2001-186241

SUMMARY OF INVENTION

Technical Problem

In order to provide a microphone with sharp directivity, it is necessary to arrange a number of vibrating membranes, which makes it difficult to achieve size-reduction.

In order to detect the arrival directions of sound waves accurately using the difference in arrival time of sound waves, it is necessary to provide a plurality of vibrating membranes at intervals equal to a reciprocal of several wavelengths of an audible sound wave, which also makes it difficult to achieve size-reduction.

Moreover, when using a differential signal of sound waves obtained by a plurality of microphones, a variation in delay or gain that occurs during the process of manufacturing microphones may affect the noise removal accuracy.

An object of the invention is to provide a voice input device having a function of removing noise components, a method for manufacturing the same, and an information processing system.

Solution to Problem (1) According to the invention, there is provided a voice input device including:

a first microphone that includes a first vibrating membrane;

a second microphone that includes a second vibrating membrane; and a differential signal generation section that generates a differential signal between a first voltage signal obtained by the first microphone and a second voltage signal obtained by the second microphone based on the first voltage signal and the second voltage signal, wherein the first and second vibrating membranes are disposed so that a noise intensity ratio that represents the ratio of intensity of a noise component contained in the differential signal to intensity of the noise component contained in the first or second voltage signal is smaller than an input voice intensity ratio that represents the ratio of intensity of an input voice component contained in the differential signal to intensity of the input voice component contained in the first voltage signal or the second voltage signal, and wherein the differential signal generation section includes:

a delay section that delays at least one of the first voltage signal obtained by the first microphone and the second voltage signal obtained by the second microphone by a predetermined delay amount and outputs the resulting signal; and a differential signal output section that receives the first voltage signal obtained by the first microphone and the second voltage signal obtained by the second microphone, at least one of the first and second voltage signals having been delayed by the delay section, generates a differential signal between the first voltage signal and the second voltage signal, and outputs the differential signal.

The delay section may include a first delay section that delays the first voltage signal obtained by the first microphone by a predetermined delay amount and outputs the resulting signal, or a second delay section that delays the second voltage signal obtained by the second microphone by a predetermined delay amount and outputs the resulting signal. In this case, the first voltage signal or the second voltage signal may be delayed by any one of the first and second delay sections, and the differential signal may be generated based on the delayed signal. Alternatively, the delay section may include both the first delay section and the second delay section. In this case, the first voltage signal and the second voltage signal may be delayed by the delay section, and the differential signal may be generated based on the delayed signals. When providing both the first delay section and the second delay section, one of the first delay section and the second delay section may be configured as a delay section that delays a signal by a fixed amount, and the other delay section may be configured as a delay section of which the delay amount can be adjusted.

However, in many cases, the delay amount of the microphone varies due to electrical or mechanical factors during the manufacturing process. It was experimentally confirmed that such a variation in delay amount affects the noise suppression effect.

However, according to the invention, since a variation in delay amount of the first voltage signal and the second voltage signal can be corrected by delaying at least one of the first voltage signal and the second voltage signal by a predetermined delay amount, a deterioration in the noise suppression effect due to a variation in delay amount can be prevented.

According to this voice input device, the first and second microphones (the first and second vibrating membranes) are disposed so as to satisfy predetermined conditions. Therefore, the differential signal that represents a difference between the first and second voltage signals obtained by the first and second microphones can be considered as a signal that represents an input voice from which a noise component has been removed. Therefore, according to the invention, it is possible to provide a voice input device that can implement a noise removal function by a simple configuration that generates just the differential signal.

In this voice input device, the differential signal generation section generates the differential signal without performing an analysis process (for example, Fourier analysis) on the first and second voltage signals. Therefore, it is possible to relieve a signal processing load of the differential signal generation section, or to implement the differential signal generation section by a circuit having a very simple configuration.

Given the above, according to the invention, a voice input device which can be scaled down and which can implement a highly accurate noise removal function can be provided.

In this voice input device, the first and second vibrating membranes may be disposed so that an intensity ratio based on a phase difference component of a noise component is smaller than an intensity ratio based on the amplitude of an input voice component.

(2) In the voice input device according to the invention, the differential signal generation section may include:

a delay section that is configured so that the delay amount is changed in accordance with a current that flows through a predetermined terminal; and a delay control section that supplies the current that controls the delay amount of the delay section to the predetermined terminal, and the delay control section may include a resistor array in which a plurality of resistors are connected in series or parallel, or includes at least one resistor, and is configured to be able to change the current supplied to the predetermined terminal of the delay section by cutting some of the resistors or conductors that form the resistor array or cutting a part of the at least one resistor.

In this voice input device, the resistance of the resistor array may be changed by cutting the resistors or conductors that form the resistor array using a laser or fusing the resistors or conductors by applying a high voltage or a high current, and the resistance of the resistor may be changed by cutting a part of one resistor.

A variation in delay amount due to an individual difference that occurs during the microphone manufacturing process is determined, and the delay amount of the first voltage signal is determined so as to cancel the difference in delay amount caused by the variation. Moreover, the resistance of the delay control section is set at an appropriate value by cutting some of the resistors or conductors (for example, fuses) that form the resistor array or cutting a part of the resistor so that a voltage or a current that achieves the determined delay amount can be supplied to the predetermined terminal. In this way, the delay balance between the first voltage signal obtained by the first microphone and the second voltage signal obtained by the second microphone can be adjusted.

(3) In the voice input device according to the invention, the differential signal generation section may include:

a phase difference detection section that receives the first voltage signal and the second voltage signal input to the differential signal output section, detects a phase difference between the first voltage signal and the second voltage signal when the differential signal is generated based on the first voltage signal and the second voltage signal that have been received, generates a phase difference signal based on the detection result, and outputs the phase difference signal; and a delay control section that changes the delay amount of the delay section based on the phase difference signal.

The phase difference may be detected by phase comparison using an analog multiplier, for example.

Moreover, in this voice input device, the phase difference detection section may generate a phase difference signal that changes in polarity based on whether the phase of the first voltage signal or the second voltage signal lags behind or leads the phase of the other voltage signal and changes in pulse width based on the amount of phase difference (i.e., the polarity of the signal indicates the lagging or leading of phase).

According to the invention, a variation in delay that changes during use for various reasons can be detected in real time and adjusted.

(4) In the voice input device according to the invention, the phase difference detection section may include:

a first binarization section that binarizes the received first voltage signal at a predetermined level to convert the first voltage signal into a first digital signal;

a second binarization section that binarizes the received second voltage signal at a predetermined level to convert the second voltage signal into a second digital signal; and a phase difference signal output section that calculates a phase difference between the first digital signal and the second digital signal and outputs the phase difference signal.

(5) The voice input device according to the invention may further include:

a sound source section that is provided at an equal distance from the first microphone and the second microphone, wherein the differential signal generation section includes:

a phase difference detection section that receives the first voltage signal and the second voltage signal input to the differential signal output section, detects a phase difference between the first voltage signal and the second voltage signal when the differential signal is generated based on the first voltage signal and the second voltage signal that have been received, generates a phase difference signal based on the detection result, and outputs the phase difference signal; and a delay control section that changes the delay amount of the delay section based on the phase difference signal, and wherein the delay control section changes the delay amount of the delay section based on sound output from the sound source section.

(6) According to the invention, there is provided a voice input device including:

a first microphone that includes a first vibrating membrane;

a second microphone that includes a second vibrating membrane;

a differential signal generation section that generates a differential signal between a first voltage signal obtained by the first microphone and a second voltage signal obtained by the second microphone based on the first voltage signal and the second voltage signal;

a delay section that delays at least one of the first voltage signal obtained by the first microphone and the second voltage signal obtained by the second microphone by a predetermined delay amount and outputs the resulting signal;

a differential signal output section that receives the first voltage signal obtained by the first microphone and the second voltage signal obtained by the second microphone, at least one of the first and second voltage signals having been delayed by the delay section, and generates a differential signal between the first voltage signal and the second voltage signal; and a sound source section that is provided at an equal distance from the first microphone and the second microphone, wherein the differential signal generation section changes the delay amount of the delay section based on sound output from the sound source section.

(7) In the voice input device according to the invention, the differential signal generation section may include:

a phase difference detection section that receives the first voltage signal and the second voltage signal input to the differential signal output section, detects a phase difference between the first voltage signal and the second voltage signal when the differential signal is generated based on the first voltage signal and the second voltage signal that have been received, generates a phase difference signal based on the detection result, and outputs the phase difference signal; and a delay control section that changes the delay amount of the delay section based on the phase difference signal.

(8) In the voice input device according to the invention, the sound source section may be a sound source that produces sound having a single frequency.

(9) In the voice input device according to the invention, the frequency of the sound source section may be set outside an audible band.

According to this configuration, the difference in phase or delay between the input signals can be adjusted using the sound source section during use without hindering the user. Therefore, according to the voice input device of the invention, since the delay amount can be dynamically adjusted during use, it is possible to adjust the delay amount in accordance with the environment such as a change in temperature.

(10) In the voice input device according to the invention, the phase difference detection section may include:

a first band-pass filter that receives the first voltage signal and allows a component having the single frequency to pass therethrough; and a second band-pass filter that receives the second voltage signal and allows a component having the single frequency to pass therethrough, the phase difference detection section may detect the phase difference based on the first voltage signal that has passed through the first band-pass filter and the second voltage signal that has passed through the second band-pass filter.

According to this configuration, since the phase difference can be detected after sound other than the sound having a single frequency produced by the sound source section is blocked by the first band-pass filter and the second band-pass filter, the phase difference or the delay amount can be detected with high accuracy.

When the voice input device itself does not include the sound source section, a test sound source may be temporarily provided near the voice input device during a test, and may be set so that sound is input to the first microphone and the second microphone with the same phase. The first microphone and the second microphone may receive sound generated by the test sound source, and the waveforms of the first voltage signal and the second voltage signal may be monitored. The delay amount of the delay section may be changed so that the phase of the first voltage signal is identical to the phase of the second voltage signal. Moreover, the phase difference detection section and the band-pass filter may not necessarily be provided in the voice input device, but may be provided externally in the same manner as the test sound source.

(11) The voice input device according to the invention may further include:

a noise detection delay section that delays the second voltage signal obtained by the second microphone by a noise detection delay amount and outputs the resulting signal;

a noise detection differential signal generation section that generates a noise detection differential signal between the second voltage signal that has been delayed by the noise detection delay section by a predetermined noise detection delay amount and the first voltage signal obtained by the first microphone;

a noise detection section that determines a noise level based on the noise detection differential signal and outputs a noise detection signal based on the determination result; and a signal switching section that receives the differential signal output from the differential signal generation section and the first voltage signal obtained by the first microphone and selectively outputs the first voltage signal or the differential signal based on the noise detection signal.

According to this voice input device, the state of surrounding noise other than the speaker's voice can be detected by controlling the directional pattern of the differential microphone, and the output of the single microphone and the output of the differential microphone can be selectively used based on the detected noise level. Therefore, a voice input device that gives priority to the SN ratio in a quiet environment and gives priority to a distant noise suppression effect in a noisy environment can be provided by using the output of the single microphone when the detected noise level is lower than a predetermined level and using the output of the differential microphone when the detected noise level is higher than the predetermined level.

(12) According to the invention, there is provided a voice input device including:

a first microphone that includes a first vibrating membrane;

a second microphone that includes a second vibrating membrane;

a differential signal generation section that generates a differential signal between a first voltage signal obtained by the first microphone and a second voltage signal obtained by the second microphone based on the first voltage signal and the second voltage signal;

a noise detection delay section that delays the second voltage signal obtained by the second microphone by a noise detection delay amount and outputs the resulting signal;

a noise detection differential signal generation section that generates a noise detection differential signal between the second voltage signal that has been delayed by the noise detection delay section by a predetermined noise detection delay amount and the first voltage signal obtained by the first microphone;

a noise detection section that determines a noise level based on the noise detection differential signal and outputs a noise detection signal based on the determination result; and a signal switching section that receives the differential signal output from the differential signal generation section and the first voltage signal obtained by the first microphone and selectively outputs the first voltage signal or the differential signal based on the noise detection signal.

(13) The voice input device according to the invention may further include:

a loudspeaker that outputs sound information; and a volume control section that controls the volume of the loudspeaker based on the noise detection signal.

In this case, the volume of the loudspeaker may be increased when the noise level is higher than a predetermined level, and may be decreased when the noise level is lower than the predetermined level.

(14) In the voice input device according to the invention, the noise detection delay amount may be set at a time obtained by dividing a center-to-center distance between the first and second vibrating membranes by the speed of sound.

Since a directivity that picks up only surrounding noise while cutting off the speaker's voice can be implemented by thus setting the delay amount so that the voice input device has a cardioid directional pattern and setting the null direction of the directional pattern in the direction of the speaker, such a directivity can be utilized for noise detection.

(15) The voice input device according to the invention may further include:

first AD conversion means that subjects the first voltage signal to analog-to-digital conversion; and second AD conversion means that subjects the second voltage signal to analog-to-digital conversion, wherein the differential signal generation section generates a differential signal between the first voltage signal that has been converted into a digital signal by the first AD conversion means and the second voltage signal that has been converted into a digital signal by the second AD conversion means based on the first voltage signal and the second voltage signal.

(16) In the voice input device according to the invention, the delay amount of the delay section may be set to be an integer multiple of an analog-to-digital conversion cycle.

(17) In the voice input device according to the invention, the center-to-center distance between the first and second vibrating membranes may be set to be a value obtained by multiplying an analog-to-digital conversion cycle by the speed of sound or an integer multiple of that value.

According to this configuration, the cardioid directional pattern that is convenient for collecting surrounding noise can be easily and accurately implemented by a simple operation that digitally delays the input voltage signal by n clock pulses (n is an integer) using the noise detection delay section.

(18) The voice input device according to the invention may further include:

a gain section that amplifies at least one of the first voltage signal obtained by the first microphone and the second voltage signal obtained by the second microphone by a predetermined gain and outputs the resulting signal, wherein the differential signal output section receives the first voltage signal obtained by the first microphone and the second voltage signal obtained by the second microphone, at least one of the first and second voltage signals having been amplified by the gain section, generates the differential signal that represents the difference between the first voltage signal and the second voltage signal, and outputs the differential signal.

According to this configuration, a variation in gain due to an individual difference that has occurred during the microphone manufacturing process can be absorbed by amplifying at least one of the first voltage signal obtained by the first microphone and the second voltage signal obtained by the second microphone by a predetermined gain. Here, a variation in amplitude of the first voltage signal and the second voltage signal may be corrected so that the amplitude of the first voltage signal is equal to the amplitude of the second voltage signal with respect to the input sound pressure, or the difference in amplitude between the first voltage signal and the second voltage signal is within a predetermined range. In this way, a decrease in noise suppression effect due to a variation in sensitivity resulting from an individual difference of each microphone that has occurred during the manufacturing process can be prevented.

(19) The voice input device according to the invention may further include:

a base in which a depression is formed in a main surface thereof, wherein the first vibrating membrane is disposed on a bottom surface of the depression, and wherein the second vibrating membrane is disposed on the main surface.

(20) In the voice input device according to the invention, the base may be provided so that an opening that communicates with the depression is disposed closer to the input voice model sound source than a formation area of the second vibrating membrane on the main surface.

According to this voice input device, the difference in phase of the input voice that enters the first vibrating membrane and the second vibrating membrane can be reduced. Therefore, a differential signal that contains only a small amount of noise can be generated, and a voice input device that can implement a highly accurate noise removal function can be provided.

(21) In the voice input device according to the invention, the depression may be shallower than a distance between the opening and the formation area of the second vibrating membrane.

(22) The voice input device according to the invention may further include:

a base in which a first depression and a second depression that is shallower than the first depression are formed in a main surface thereof, wherein the first vibrating membrane is disposed on a bottom surface of the first depression; and wherein the second vibrating membrane is disposed on a bottom surface of the second depression.

(23) In the voice input device according to the invention, the base may be provided so that a first opening that communicates with the first depression is disposed closer to the input voice model sound source than a second opening that communicates with the second depression.

According to this voice input device, the difference in phase of the input voice that enters the first vibrating membrane and the second vibrating membrane can be reduced. Therefore, a differential signal that contains only a small amount of noise can be generated, and a voice input device that can implement a highly accurate noise removal function can be provided.

(24) In the voice input device according to the invention, a difference in depth between the first depression and the second depression may be smaller than a distance between the first opening and the second opening.

(25) In the voice input device according to the invention, the base may be provided so that the input voice reaches the first vibrating membrane and the second vibrating membrane at the same time.

According to this configuration, since a differential signal that does not contain an input voice phase difference can be generated, a voice input device having a highly accurate noise removal function can be provided.

(26) According to the invention, there is provided a voice input device including:

a first microphone that includes a first vibrating membrane;

a second microphone that includes a second vibrating membrane; and a differential signal generation section that generates a differential signal between a first voltage signal obtained by the first microphone and a second voltage signal obtained by the second microphone, wherein the first and second vibrating membranes are disposed so that a noise intensity ratio that represents the ratio of intensity of a noise component contained in the differential signal to intensity of the noise component contained in the first or second voltage signal is smaller than an input voice intensity ratio that represents the ratio of intensity of an input voice component contained in the differential signal to intensity of the input voice component contained in the first voltage signal or the second voltage signal; and at least one of the first vibrating membrane and the second vibrating membrane is configured to obtain sound waves through a tubular sound guide tube that is provided perpendicularly to a surface of the at least one vibrating membrane.

Here, the sound guide tube is attached to a substrate around the vibrating membrane so that sound waves that enter the opening reach the vibrating membrane without leaking to the outside, whereby sound that has entered the sound guide tube reaches the vibrating membrane without being attenuated. According to this voice input device, the travel distance of sound before reaching the vibrating membrane without being attenuated due to diffusion can be changed by providing the sound guide tube to at least one of the first vibrating membrane and the second vibrating membrane. Therefore, a delay can be canceled by providing a sound guide tube having an appropriate length (for example, several millimeters) in accordance with a variation in delay balance.

(27) In the voice input device according to the invention, the sound guide tube may be provided so that an input voice reaches the first and second vibrating membranes at the same time.

(28) In the voice input device according to the invention, the first and second vibrating membranes may be disposed so that the normal lines thereof are parallel to each other.

(29) In the voice input device according to the invention, the first and second vibrating membranes may be disposed so that the normal lines thereof are not on the same line.

(30) In the voice input device according to the invention, the first and second microphones may be formed as a semiconductor device.

Here, the first and second microphones may be silicon microphones (Si microphones), for example. The first and second microphones may be formed on a single semiconductor substrate. In this case, the first microphone, the second microphone, and the differential signal generation section may be formed on a single semiconductor substrate. The first microphone, the second microphone, and the differential signal generation section may be formed as a so-called micro-electro-mechanical system (MEMS) using a semiconductor process.

(31) In the voice input device according to the invention, a center-to-center distance between the first and second vibrating membranes may be 5.2 mm or less.

The first and second vibrating membranes may be disposed so that the normal lines thereof are parallel to each other at an interval of 5.2 mm or less.

(32) In the voice input device according to the invention, the vibrating membrane may be formed by a vibrator having an SN ratio of about 60 dB or more.

For example, the vibrating membrane may be formed by a vibrator having an SN ratio of 60 dB or more and may be formed by a vibrator having an SN ratio of $60\pm\alpha$ dB or more.

(33) In the voice input device according to the invention, a center-to-center distance between the first and second vibrating membranes may be set at a distance in which a phase component of a voice intensity ratio that is the ratio of the intensity of a differential sound pressure of voices incident on the first and second vibrating membranes to the intensity of a sound pressure of a voice incident on the first vibrating membrane becomes 0 dB or less with respect to sound in a frequency band of 10 kHz or less.

(34) In the voice input device according to the invention, a center-to-center distance between the first and second vibrating membranes may be set within a range of distances in which a sound pressure when the vibrating membrane is used as a differential microphone is equal to or less than a sound pressure when the vibrating membrane is used as a single microphone in all directions with respect to sound in an extraction target frequency band.

In this voice input device, the extraction target frequency refers to the frequency of sound to be extracted by the voice input device. For example, the center-to-center distance between the first and second vibrating membranes may be set using a frequency of 7 kHz or less as the extraction target frequency.

(35) According to the invention, there is provided an information processing system including:

the voice input device according to any one of the inventions; and an analysis section that analyzes voice information input to the voice input device based on the differential signal.

According to this information processing system, the voice information is analyzed based on the differential signal obtained by the voice input device in which the first vibrating membrane and the second vibrating membrane are disposed so as to satisfy predetermined conditions. According to this voice input device, since the differential signal is a signal that represents a voice component from which a noise component has been removed, various kinds of information processing based on the input voice can be performed by analyzing the differential signal.

The information processing system according to the invention may be a system that performs a voice recognition process, a voice authentication process, or a command generation process based on voice, for example.

(36) According to the invention, there is provided an information processing system including:

the voice input device according to any one of the inventions; and a host computer that analyzes voice information input to the voice input device based on the differential signal, wherein the voice input device communicates with the host computer through a network via the communication section.

According to this information processing system, the voice information is analyzed based on the differential signal obtained by the voice input device in which the first vibrating membrane and the second vibrating membrane are disposed so as to satisfy predetermined conditions. According to this voice input device, since the differential signal is a signal that represents a voice component from which a noise component has been removed, various kinds of information processing based on the input voice can be performed by analyzing the differential signal.

The information processing system according to the invention may be a system that performs a voice recognition process, a voice authentication process, or a command generation process based on voice, for example.

(37) According to the invention, there is provided a method for manufacturing a voice input device which has a function of removing a noise component and includes a first microphone that includes a first vibrating membrane, a second microphone that includes a second vibrating membrane, and a differential signal generation section that generates a differential signal between a first voltage signal obtained by the first microphone and a second voltage signal obtained by the second microphone, the method including:

a step of preparing data that represents the relationship between the value of the ratio $\Delta r/\lambda$ and a noise intensity ratio, the ratio $\Delta r/\lambda$ representing the ratio of a center-to-center distance $\Delta r$ between the first and second vibrating membranes to a wavelength $\lambda$ of noise, and the noise intensity ratio representing the ratio of intensity of the noise component contained in the differential signal to intensity of the noise component contained in the first or second voltage signal;

a step of setting the value of the ratio $\Delta r/\lambda$, based on the data;

a step of setting the center-to-center distance based on the set value of the ratio $\Delta r/\lambda$ and the wavelength of the noise.

a delay amount setting step of forming the delay control section that controls a delay amount of a delay section so as to include a resistor array in which a plurality of resistors are connected in series or parallel, the delay section being configured so that the delay amount is changed in accordance with a current flowing through a predetermined terminal, and cutting some of the resistors or conductors that form the resistor array so as to supply a predetermined current to the predetermined terminal of the delay section.

(38) In the method for manufacturing a voice input device according to the invention, the delay amount setting step may involve:

providing a sound source section at an equal distance from the first microphone and the second microphone; and determining a phase difference between the voltage signal obtained by the first microphone and the voltage signal obtained by the second microphone based on sound output from the sound source section and cutting some of the resistors or conductors that form the resistor array to achieve a resistance that allows the phase difference to be within a predetermined range.

DESCRIPTION OF EMBODIMENTS

Hereinafter, embodiments to which the invention is applied will be described with reference to the drawings. However, the invention is not limited to the following embodiments. The invention includes arbitrary combinations of the elements of the following embodiments.

1. Configuration of Voice Input Device According to First Embodiment

Figure 1:
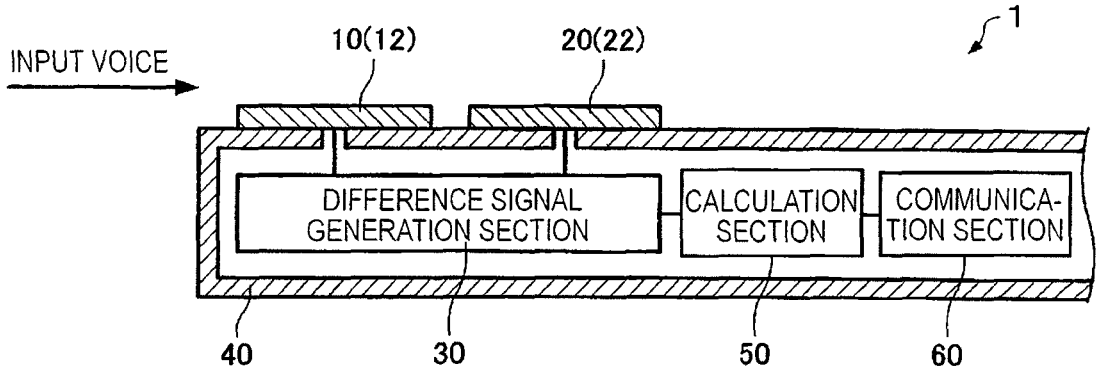
FIG. 1 is a diagram for describing a voice input device.
Figure 2:
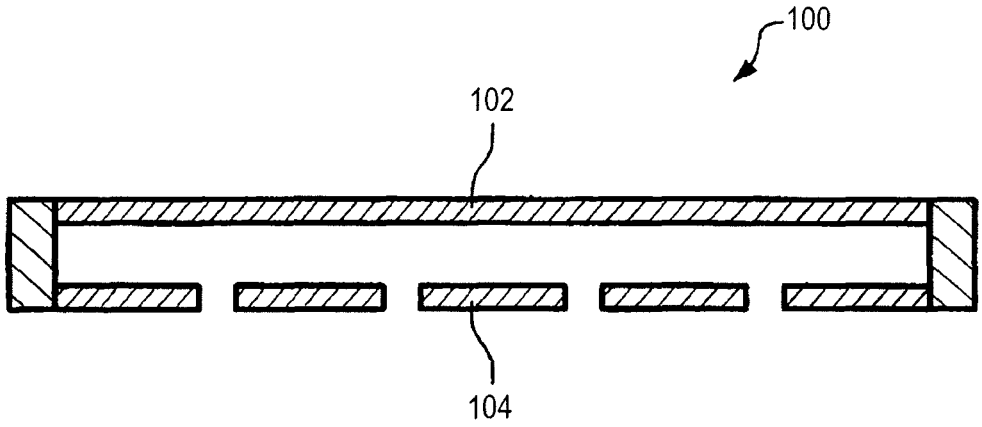
FIG. 2 is a diagram for describing a voice input device.

First, the configuration of a voice input device 1 according to an embodiment to which the invention is applied will be described with reference to FIGS. 1 to 3. The voice input device 1 described below is a close-talking voice input device, and can be applied, for example, to voice communication apparatuses (such as portable phones or transceivers), information processing systems using input voice analysis techniques (such as voice authentication systems, voice recognition systems, command generation systems, electronic dictionaries, translation devices, or voice input remote controllers), recording apparatuses, amplifier systems (loudspeakers), microphone systems, and the like.

The voice input device according to this embodiment includes a first microphone 10 that includes a first vibrating membrane 12, and a second microphone 20 that includes a second vibrating membrane 22. Here, the term "microphone" is an electro-acoustic transducer that converts an acoustic signal into an electrical signal. The first and second microphones 10 and 20 may be converters that respectively output vibrations of the first and second vibrating membranes 12 and 22 (vibrating plates) as voltage signals.

In the voice input device according to this embodiment, the first microphone 10 generates a first voltage signal. Moreover, the second microphone 20 generates a second voltage signal. That is, the voltage signals generated by the first and second microphones 10 and 20 may be referred to as first and second voltage signals, respectively.

The mechanisms of the first and second microphones 10 and 20 are not particularly limited. FIG. 2 illustrates the structure of a capacitor-type microphone 100 as an example of a microphone that can be applied to the first and second microphones 10 and 20. The capacitor-type microphone 100 includes a vibrating membrane 102. The vibrating membrane 102 is a film (thin film) that vibrates in response to sound waves. The vibrating membrane 102 has conductivity and forms one end of an electrode. The capacitor-type microphone 100 also includes an electrode 104. The electrode 104 is disposed so as to face the vibrating membrane 102. In this way, the vibrating membrane 102 and the electrode 104 form a capacitor. When sound waves enter the capacitor-type microphone 100, the vibrating membrane 102 vibrates so that the distance between the vibrating membrane 102 and the electrode 104 changes, whereby the capacitance between the vibrating membrane 102 and the electrode 104 changes. The sound waves that have entered the capacitor-type microphone 100 can be converted into an electrical signal by outputting the change in capacitance as a change in voltage, for example. In the capacitor-type microphone 100, the electrode 104 may have a structure that is not affected by sound waves. For example, the electrode 104 may have a mesh structure.

However, the microphone that can be applied to the invention is not limited to a capacitor-type microphone, and any known microphone may be applied to the invention. For example, an electrodynamic (dynamic) microphone, an electromagnetic (magnetic) microphone, a piezoelectric (crystal) microphone, and the like may be used as the first and second microphones 10 and 20.

The first and second microphones 10 and 20 may be silicon microphones (Si microphones) in which the first and second vibrating membranes 12 and 22 are formed from silicon. The use of silicon microphones enables reducing the size and increasing the performance of the first and second microphones 10 and 20. In this case, the first and second microphones 10 and 20 may be formed as a single integrated circuit device. That is, the first and second microphones 10 and 20 may be formed on a single semiconductor substrate. In that case, a differential signal generation section 30 described later may also be formed on the same semiconductor substrate. That is, the first and second microphones 10 and 20 may be formed as a so-called micro-electro-mechanical system (MEMS). However, the first microphone 10 and the second microphone 20 may be formed as separate silicon microphones.

The vibrating membrane may be formed by a vibrator having an SN (Signal to Noise) ratio of about 60 dB or more. When making the vibrator function as a differential microphone, the SN ratio decreases in comparison with the case where the vibrator is made to function as a single microphone. Consequently, by forming the vibrating membrane using a vibrator having an excellent SN ratio (a MEMS vibrator having an SN ratio of 60 dB or more, for example), a sensitive voice input device can be implemented.

For example, when a differential microphone is configured by arranging two single microphones so as to be separated by about 5 mm and acquire a differential signal between them, and is used in a condition that the speaker-microphone distance is about 2.5 cm (this is a close-talking voice input device), the output sensitivity thereof decreases by a dozen dB as compared with a single microphone. That is, the SN ratio of the differential microphone decreases by at least 10 dB as compared with a single microphone. Since it is considered that the SN ratio of about 50 dB is required when practical use of a microphone is considered, in order for a differential microphone to satisfy this condition, it is necessary to form a microphone using a vibrator which is solely capable of securing an SN ratio of about 60 dB or more. In this way, a voice input device having sufficient function necessary for a microphone can be implemented in spite of the influence of decrease of the sensitivity.

The voice input device according to this embodiment implements a function of removing a noise component by using a differential signal that represents the difference between the first and second voltage signals, as described later. In order to implement this function, the first and second microphones (the first and second vibrating membranes 12 and 22) are disposed so as to satisfy predetermined conditions. The details of the conditions that must be satisfied by the first and second vibrating membranes 12 and 22 will be described later. In this embodiment, the first and second vibrating membranes 12 and 22 (the first and second microphones 10 and 20) are disposed so that a noise intensity ratio is smaller than an input voice intensity ratio. Therefore, the differential signal can be considered as a signal that represents a voice component from which a noise component has been removed. The first and second vibrating membranes 12 and 22 may be disposed so that the center-to-center distance thereof is 5.2 mm or less, for example.

In the voice input device according to this embodiment, the orientations of the first and second vibrating membranes 12 and 22 are not particularly limited. The first and second vibrating membranes 12 and 22 may be disposed so that the normal lines thereof are parallel to each other. In that case, the first and second vibrating membranes 12 and 22 may be disposed so that the normal lines thereof are not on the same line. For example, the first and second vibrating membranes 12 and 22 may be disposed at an interval on the surface of a base (for example, a circuit board) which is not shown. Alternatively, the first and second vibrating membranes 12 and 22 may be disposed so that they are misaligned in the normal direction. However, the first and second vibrating membranes 12 and 22 may be disposed so that the normal lines thereof are not parallel to each other. The first and second vibrating membranes 12 and 22 may be disposed so that the normal lines thereof are orthogonal to each other.

The voice input device according to this embodiment includes the differential signal generation section 30. The differential signal generation section 30 generates a differential signal that represents the difference (voltage difference) between the first voltage signal obtained by the first microphone 10 and the second voltage signal obtained by the second microphone 20. The differential signal generation section 30 performs a process of generating the differential signal that represents the difference between the first and second voltage signals in a time domain without performing an analysis process (for example, Fourier analysis) on the first and second voltage signals. The function of the differential signal generation section 30 may be implemented by a dedicated hardware circuit (differential signal generation circuit), or may be implemented by signal processing using a CPU or the like.

The voice input device according to this embodiment may further include a gain section that amplifies the differential signal (i.e., increases or decreases the gain thereof). The differential signal generation section 30 and the gain section may be implemented by a single control circuit. However, the voice input device according to this embodiment may not include the gain section.

Figure 3:
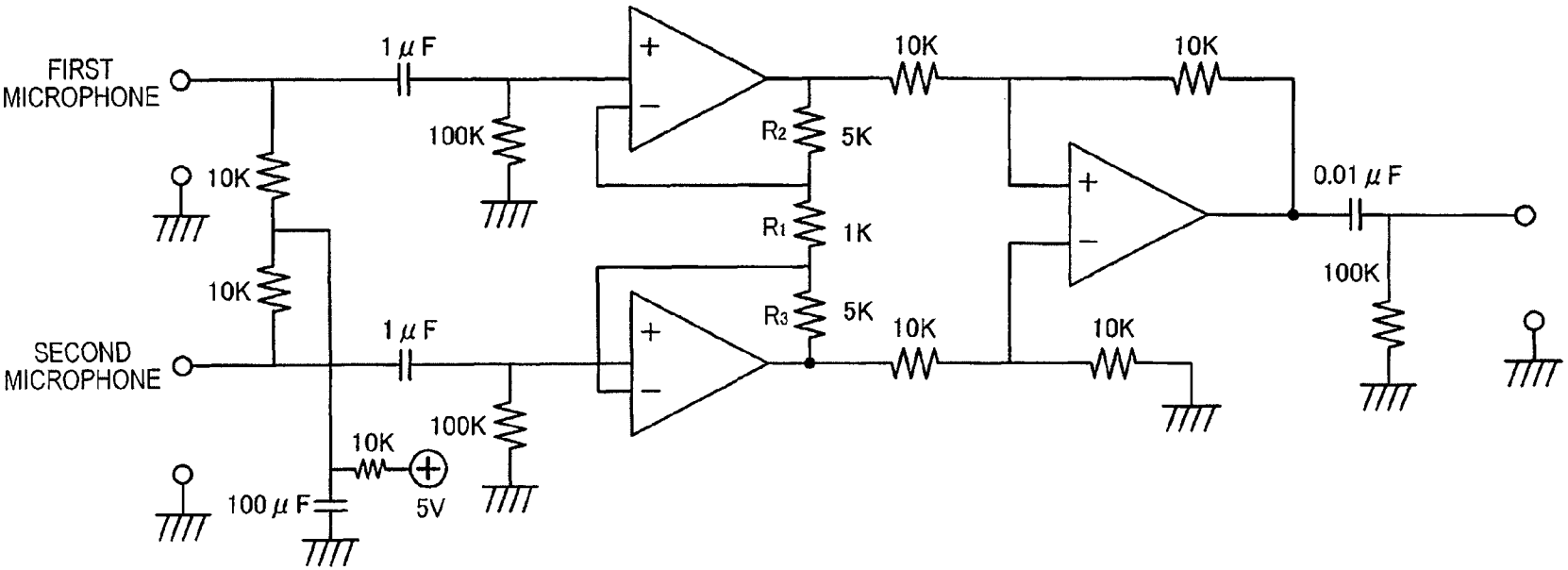
FIG. 3 is a diagram for describing a voice input device.

FIG. 3 illustrates an example of a circuit that can implement the differential signal generation section 30 and the gain section. The circuit illustrated in FIG. 3 receives the first and second voltage signals and outputs a signal obtained by amplifying the differential signal that represents the difference between the first and second voltage signals by a factor of 10. However, the circuit configuration for implementing the differential signal generation section 30 and the gain section is not limited to this.

The voice input device according to this embodiment may include a housing 40. In this case, the external shape of the voice input device may be defined by the housing 40. A basic position may be set for the housing 40, whereby the travel path of the input voice can be limited. The first and second vibrating membranes 12 and 22 may be formed on the surface of the housing 40. Alternatively, the first and second vibrating membranes 12 and 22 may be disposed in the housing 40 so as to face openings (voice incident openings) formed in the housing 40. Moreover, the first and second vibrating membranes 12 and 22 may be disposed so that they are at different distances from the sound source (incident voice model sound source). For example, as illustrated in FIG. 1, the basic position of the housing 40 may be set so that the travel path of the input voice extends along the surface of the housing 40. Moreover, the first and second vibrating membranes 12 and 22 may be disposed along the travel path of the input voice. In addition, the first vibrating membrane 12 may be a vibrating membrane which is disposed on the upstream side of the travel path of the input voice, and the second vibrating membrane 22 may be a vibrating membrane which is disposed on the downstream side of the travel path of the input voice.

The voice input device according to this embodiment may further include a calculation section 50. The calculation section 50 performs various calculation processes based on the differential signal generated by the differential signal generation section 30. The calculation section 50 may perform an analysis process on the differential signal. The calculation section 50 may perform a process (so-called voice authentication process) of specifying a person who has produced the input voice by analyzing the differential signal. Alternatively, the calculation section 50 may specify the content of the input voice by analyzing the differential signal (i.e., voice recognition process). The calculation section 50 may perform a process of creating various commands based on the input voice. The calculation section 50 may perform a process of amplifying the differential signal. In addition, the calculation section 50 may control the operation of a communication section 60 described later. Moreover, the calculation section 50 may implement the above-mentioned functions by signal processing using a CPU and a memory.

The calculation section 50 may be disposed in the housing 40 and may be disposed outside the housing 40. When the calculation section 50 is disposed outside the housing 40, the calculation section 50 may acquire the differential signal through the communication section 60 described later.

The voice input device according to this embodiment may further include the communication section 60. The communication section 60 controls communication between the voice input device and other terminals (for example, portable phone terminals or host computers). The communication section 60 may have a function of transmitting a signal (differential signal) to other terminals through a network. The communication section 60 may also have a function of receiving a signal from other terminals through a network. Moreover, a host computer, for example, may analyze the differential signal acquired through the communication section 60 and perform various kinds of information processing such as a voice recognition process, a voice authentication process, a command generation process, and a data storage process. That is, the voice input device may form an information processing system in collaboration with other terminals. In other words, the voice input device may be considered as an information input terminal that forms an information processing system. However, the voice input device may not include the communication section 60.

The voice input device according to this embodiment may further include a display device such as a display panel and a sound output device such as a loudspeaker. Moreover, the voice input device according to this embodiment may further include an operation key that allows the user to input operation information.

The voice input device according to this embodiment may have the above-described configuration. According to this voice input device, a signal (voltage signal) that represents a voice component from which a noise component has been removed is generated by a simple process that involves outputting just the difference between the first and second voltage signals. Therefore, according to the invention, a voice input device that can be reduced in size and has an excellent noise removal function can be provided. The noise removal principle is described later.

2. Noise Removal Function

Hereinafter, the noise removal principle employed by the voice input device according to this embodiment and the conditions for implementing the principle will be described.

(1) Noise Removal Principle

First, the noise removal principle of the voice input device according to this embodiment will be described.

Sound waves are attenuated as they travel through a medium, and the sound pressure (the intensity or amplitude of the sound waves) thereof decreases. Since the sound pressure is inversely proportional to the distance from the sound source, a sound pressure P can be expressed by the following expression in relation to a distance R from the sound source,

[Mathematical Formula 1]

$$P = K\frac{1}{R} \tag{1}$$

Figure 4:
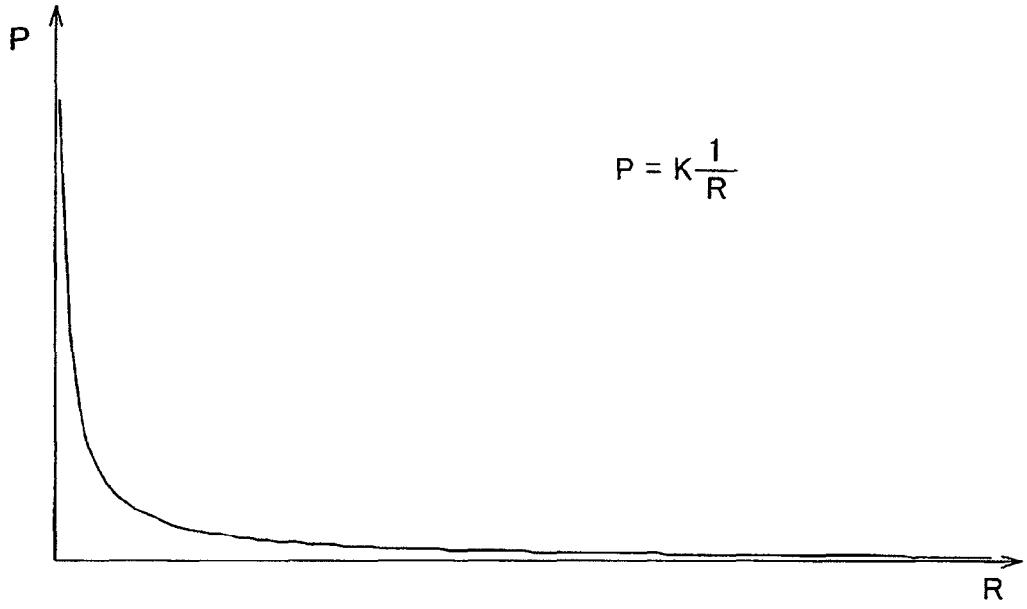
FIG. 4 is a diagram for describing a voice input device.

In the expression (1), K is a proportionality constant. FIG. 4 illustrates a graph that represents the expression (1). As can be understood from this figure, the sound pressure (amplitude of sound waves) is rapidly attenuated at a position near the sound source (left of the graph), and is gradually attenuated as the distance from the sound source increases. The voice input device according to this embodiment removes a noise component by using the above-mentioned attenuation characteristics.

That is, the user of the close-talking voice input device produces a voice at a position closer to the first and second microphones 10 and 20 (the first and second vibrating membranes 12 and 22) than the noise source. Therefore, the user's voice is attenuated greatly between the first and second vibrating membranes 12 and 22, so that a difference occurs in the intensities of the user's voices contained in the first and second voltage signals. In contrast, since the source of a noise component is far away from the voice input device as compared with the user's voice, the noise component is rarely attenuated between the first and second vibrating membranes 12 and 22. Therefore, it can be considered that there is no substantial difference in the intensity of the noise components contained in the first and second voltage signals. For this reason, since noise is removed if the difference between the first and second voltage signals is detected, a voltage signal (differential signal) that represents only the user's voice component and does not contain the noise component can be acquired. That is, the differential signal can be considered as a signal that represents the user's voice from which the noise component has been removed.

However, sound waves have a phase component. Therefore, in order to implement a highly reliable noise removal function, it is necessary to take the phase difference between the voice components and the noise components contained in the first and second voltage signals into consideration.

Hereinafter, specific conditions that must be satisfied by the voice input device in order to implement the noise removal function by generating the differential signal will be described.

(2) Specific Conditions that Must be Satisfied by Voice Input Device

As described above, the voice input device according to this embodiment considers the differential signal that represents the difference between the first and second voltage signals as an input voice signal that does not contain noise. According to this voice input device, it can be considered that the noise removal function has been implemented when a noise component contained in the differential signal has become smaller than a noise component contained in the first or second voltage signal. Specifically, it can be considered that the noise removal function has been implemented when a noise intensity ratio that represents the ratio of the intensity of a noise component contained in the differential signal to the intensity of a noise component contained in the first voltage signal or the second voltage signal has become smaller than a voice intensity ratio that represents the ratio of the intensity of a voice component contained in the differential signal to the intensity of a voice component contained in the first voltage signal or the second voltage signal.

Hereinafter, specific conditions that must be satisfied by the voice input device (the first and second vibrating membranes 12 and 22) in order to implement the noise removal function will be described.

First, the sound pressure of a voice that enters the first and second microphones 10 and 20 (the first and second vibrating membranes 12 and 22) will be discussed. When the distance from the sound source of the input voice (user's voice) to the first vibrating membrane 12 is R and the center-to-center distance between the first and second vibrating membranes 12 and 22 (the first and second microphones 10 and 20) is Δr, the sound pressures (intensities) P(S1) and P(S2) of the input voices obtained by the first and second microphones 10 and 20 can be expressed as follows (if the phase difference is disregarded).

[Mathematical Formula 2]

$$\begin{cases} P(S1) = K\dfrac{1}{R} & (2) \\ P(S2) = K\dfrac{1}{R+\Delta r} & (3) \end{cases}$$

Therefore, a voice intensity ratio ρ(P) that represents the ratio of the intensity of the input voice component contained in the differential signal to the intensity of the input voice component obtained by the first microphone 10 is expressed as follows (if the phase difference of the input voice is disregarded).

[Mathematical Formula 3]

$$\rho(P) = \frac{P(S1) - P(S2)}{P(S1)} = \frac{\Delta r}{R+\Delta r} \quad (4)$$

Here, the voice input device according to this embodiment is a close-talking voice input device, and the center-to-center distance Δr can be considered to be sufficiently smaller than the distance R.

Therefore, the expression (4) can be transformed as follows.

[Mathematical Formula 4]

$$\rho(P) = \frac{\Delta r}{R} \quad (A)$$

That is, it can be understood that the voice intensity ratio when the phase difference of the input voice is disregarded is expressed by the expression (A).

However, when the phase difference of the input voice is taken into consideration, the sound pressures Q(S1) and Q(S2) of the user's voices can be expressed as follows,

[Mathematical Formula 5]

$$\begin{cases} Q(S1) = K\dfrac{1}{R}\sin\omega t & (5) \\ Q(S2) = K\dfrac{1}{R+\Delta r}\sin(\omega t - \alpha) & (6) \end{cases}$$

In the expression, α is the phase difference.

In this case, the voice intensity ratio ρ(S) is expressed as follows.

[Mathematical Formula 6]

$$\rho(S) = \frac{|P(S1) - P(S2)|_{max}}{|P(S1)|_{max}} = \frac{\left|\dfrac{K}{R}\sin\omega t - \dfrac{K}{R+\Delta r}\sin(\omega t - \alpha)\right|_{max}}{\left|\dfrac{K}{R}\sin\omega t\right|_{max}} \quad (7)$$

The magnitude of the voice intensity ratio ρ(S) can then be expressed as follows based on the expression (7).

[Mathematical Formula 7]

$$\rho(s) = \frac{\dfrac{K}{R}\left|\sin\omega t - \dfrac{1}{1+\Delta r/R}\sin(\omega t - \alpha)\right|_{max}}{\dfrac{K}{R}|\sin\omega t|_{max}} = \frac{1}{1+\Delta r/R}|(1+\Delta r/R)\sin\omega t - \sin(\omega t - \alpha)|_{max} = \frac{1}{1+\Delta r/R}\left|\sin\omega t - \sin(\omega t - \alpha) + \frac{\Delta r}{R}\sin\omega t\right|_{max} \quad (8)$$

However, in the expression (8), the term sin ωt-sin(ω−α) represents the phase component intensity ratio, and the term Δr/R sin ωt represents the amplitude component intensity ratio. Since the phase difference component of the input voice component also serves as noise for the amplitude component, the phase component intensity ratio must be sufficiently smaller than the amplitude component intensity ratio in order to accurately extract the input voice (user's voice). That is, it is necessary that the terms sin ωt-sin(ωt−α) and Δr/R sin ωt satisfy the following relationship.

[Mathematical Formula 8]

$$\left|\frac{\Delta r}{R}\sin\omega t\right|_{max} > |\sin\omega t - \sin(\omega t - \alpha)|_{max} \quad (B)$$

Here, since sin ωt−sin(ωt−α) can be expressed as follows,

[Mathematical Formula 9]

$$\sin\omega t - \sin(\omega t - \alpha) = 2\sin\frac{\alpha}{2}\cdot\cos\left(\omega t - \frac{\alpha}{2}\right) \quad (9)$$

the expression (B) can then be expressed as follows.

[Mathematical Formula 10]

$$\left|\frac{\Delta r}{R}\sin\omega t\right|_{max} > \left|2\sin\frac{\alpha}{2}\cdot\cos\left(\omega t-\frac{\alpha}{2}\right)\right|_{max} \quad (10)$$

Thus, it can be understood that the voice input device according to this embodiment must satisfy the following expression when the amplitude component in the expression (10) is taken into consideration.

[Mathematical Formula 11]

$$\frac{\Delta r}{R} > 2\sin\frac{\alpha}{2} \quad (C)$$

Since the center-to-center distance Δr is considered to be sufficiently smaller than the distance R, sin(α/2) can be considered to be sufficiently small and approximated as follows.

[Mathematical Formula 12]

$$\sin\frac{\alpha}{2} \approx \frac{\alpha}{2} \quad (11)$$

Therefore, the expression (C) can be transformed as follows.

[Mathematical Formula 13]

$$\frac{\Delta r}{R} > \alpha \quad (D)$$

When the relationship between the phase difference α and the center-to-center distance Δr is expressed as follows,

[Mathematical Formula 14]

$$\alpha = \frac{2\pi\Delta r}{\lambda} \quad (12)$$

the expression (D) can then be transformed as follows.

[Mathematical Formula 15]

$$\frac{\Delta r}{R} > 2\pi\frac{\Delta r}{\lambda} > \frac{\Delta r}{\lambda} \quad (E)$$

That is, in this embodiment, in order to accurately extract the input voice (user's voice), the voice input device must be manufactured so as to satisfy the relationship shown by the expression (E).

Next, the sound pressure of noise that enters the first and second microphones 10 and 20 (the first and second vibrating membranes 12 and 22) will be discussed.

When the amplitudes of noise components obtained by the first and second microphones are A and A', respectively, sound pressures Q(N1) and Q(N2) of noise can be expressed as follows if a phase difference component is taken into consideration.

[Mathematical Formula 16]

$$\begin{cases} Q(N1) = A\sin\omega t & (13) \\ Q(N2) = A'\sin(\omega t-\alpha) & (14) \end{cases}$$

A noise intensity ratio ρ(N) that represents the ratio of the intensity of the noise component contained in the differential signal to the intensity of the noise component obtained by the first microphone 10 can be expressed as follows.

[Mathematical Formula 17]

$$\rho(N) = \frac{|Q(N1)-Q(N2)|_{max}}{|Q(N1)|_{max}} = \frac{|A\sin\omega t - A'\sin(\omega t-\alpha)|_{max}}{|A\sin\omega t|_{max}} \quad (15)$$

As described above, the amplitudes (intensities) of noise components obtained by the first and second microphones are almost equal to each other and can be regarded as A=A'. Therefore, the expression (15) can be transformed as follows.

[Mathematical Formula 18]

$$\rho(N) = \frac{|\sin\omega t - \sin(\omega t-\alpha)|_{max}}{|\sin\omega t|_{max}} \quad (16)$$

The magnitude of the noise intensity ratio can be expressed as follows.

[Mathematical Formula 19]

$$\rho(N) = \frac{|\sin\omega t - \sin(\omega t-\alpha)|_{max}}{|\sin\omega t|_{max}} = |\sin\omega t - \sin(\omega t-\alpha)|_{max} \quad (17)$$

Here, the expression (17) can be transformed as follows based on the expression (9).

[Mathematical Formula 20]

$$\rho(N) = \left|\cos\left(\omega t-\frac{\alpha}{2}\right)\right|_{max}\cdot 2\sin\frac{\alpha}{2} = 2\sin\frac{\alpha}{2} \quad (18)$$

The expression (18) can be transformed as follows based on the expression (11).

[Mathematical Formula 21]

$$\rho(N)=\alpha \quad (19)$$

Here, the noise intensity ratio can be expressed as follows based on the expression (D).

[Mathematical Formula 22]

$$\rho(N) = \alpha < \frac{\Delta r}{R} \tag{F}$$

Here, Δr/R is the amplitude component intensity ratio of the input voice (user's voice) as represented by the expression (A). As is clear from the expression (F), in the voice input device, the noise intensity ratio is smaller than the intensity ratio Δr/R of the input voice.

Given the above, according to the voice input device that is designed so that the phase component intensity ratio of the input voice is smaller than the amplitude component intensity ratio (see the expression (B)), the noise intensity ratio is smaller than the input voice intensity ratio (see the expression (F)). In other words, according to the voice input device that is designed so that the noise intensity ratio is smaller than the input voice intensity ratio, a highly accurate noise removal function can be implemented.

That is, according to the voice input device according to this embodiment in which the first and second vibrating membranes 12 and 22 (the first and second microphones 10 and 20) are disposed so that the noise intensity ratio is smaller than the input voice intensity ratio, a highly accurate noise removal function can be implemented.

3. Method for Manufacturing Voice Input Device

Hereinafter, a method for manufacturing the voice input device according to this embodiment will be described. In this embodiment, the voice input device is manufactured using data that represents the relationship between the value of Δr/λ that represents the ratio of the center-to-center distance Δr between the first and second vibrating membranes 12 and 22 to a wavelength λ of noise and the noise intensity ratio (intensity ratio based on the phase component of noise).

The intensity ratio based on the phase component of noise is expressed by the expression (18). Therefore, the decibel value of the intensity ratio based on the phase component of noise is expressed as follows.

[Mathematical Formula 23]

$$20\log\rho(N) = 20\log\left|2\sin\frac{\alpha}{2}\right| \tag{20}$$

Figure 5:
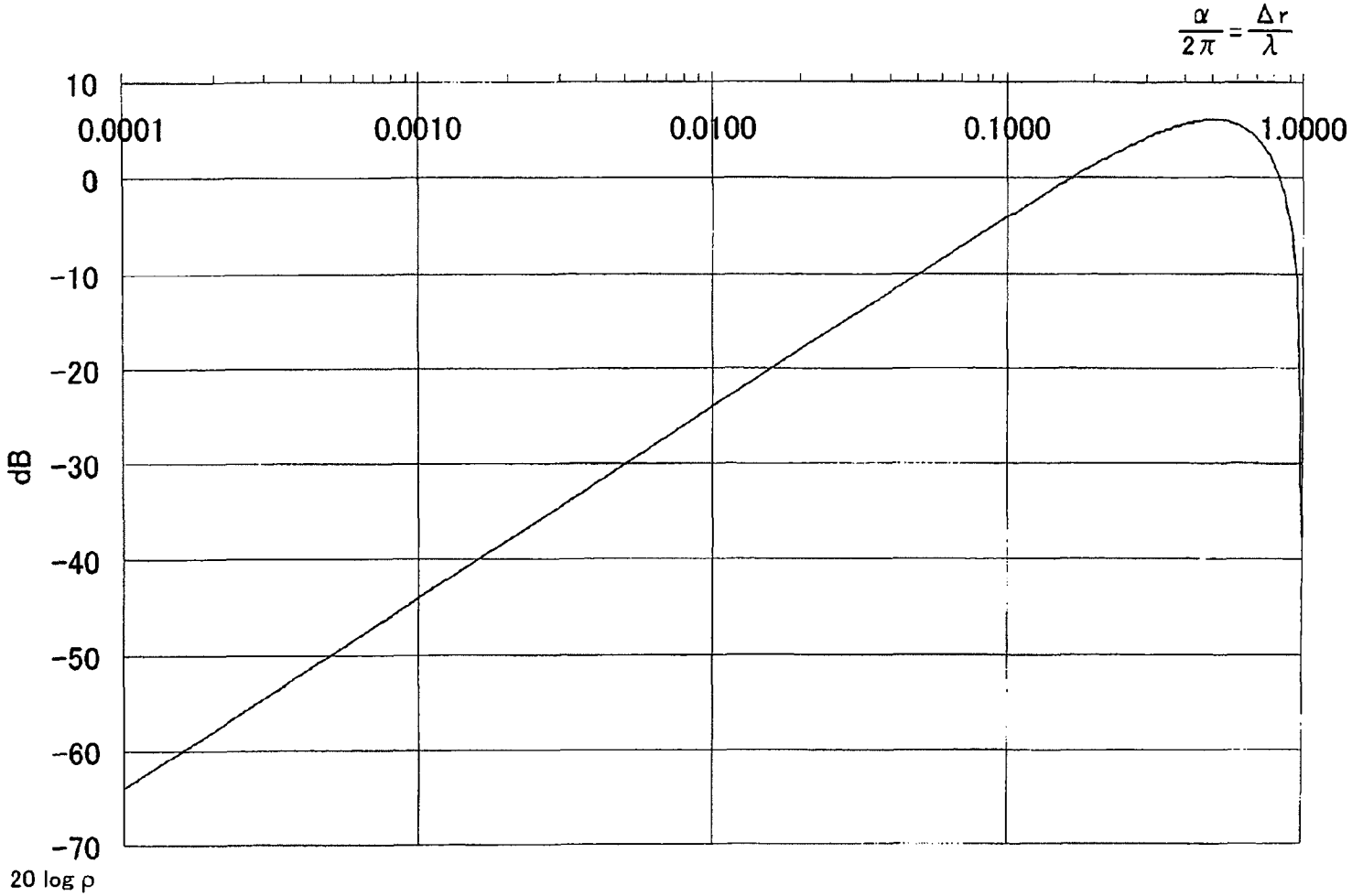
FIG. 5 is a diagram for describing a method for manufacturing a voice input device.

The relationship between the phase difference α and the intensity ratio based on the phase component of noise can be determined by substituting each value for α in the expression (20). FIG. 5 illustrates an example of data that represents the relationship between the phase difference and the intensity ratio when the horizontal axis represents α/2π and the vertical axis represents the intensity ratio (decibel value) based on the phase component of noise.

The phase difference α can be expressed as a function of the ratio Δr/λ, that represents the ratio of the distance Δr to the wavelength λ, as represented by the expression (12). Therefore, the vertical axis in FIG. 5 can be considered to represent the ratio Δr/λ. That is, it can be said that FIG. 5 illustrates data that represents the relationship between the intensity ratio based on the phase component of noise and the ratio Δr/λ.

Figure 6:
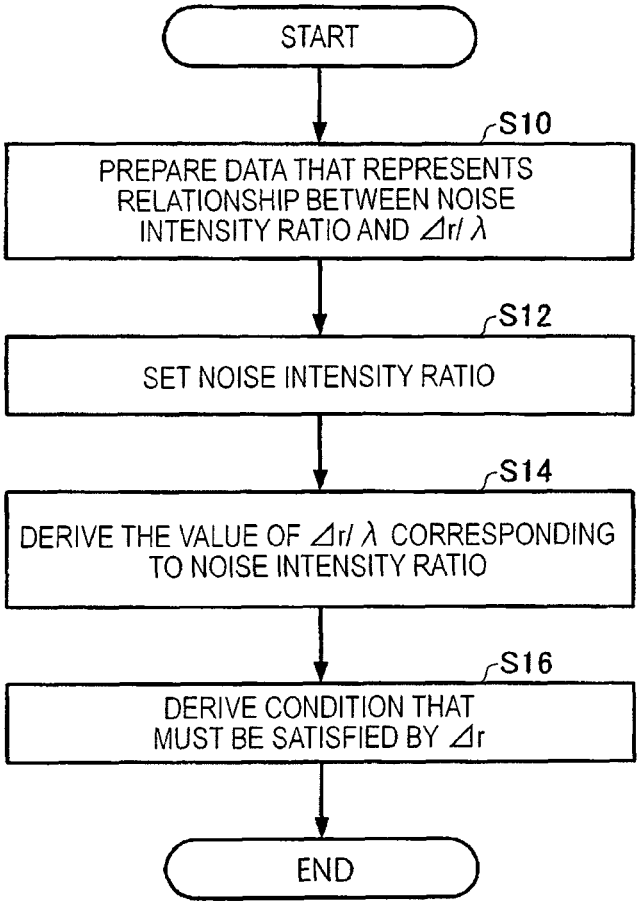
FIG. 6 is a diagram for describing a method for manufacturing a voice input device.

In this embodiment, the voice input device is manufactured using the above-mentioned data. FIG. 6 is a flowchart diagram for describing a process of manufacturing the voice input device using the above-mentioned data.

First, data (see FIG. 5) that represents the relationship between the noise intensity ratio (intensity ratio based on the phase component of noise) and the ratio Δr/λ, is provided (step S10).

Subsequently, the noise intensity ratio is set corresponding to the application (step S12). In this embodiment, the noise intensity ratio must be set so that the noise intensity decreases. Therefore, the noise intensity ratio is set to be 0 dB or less in this step.

Subsequently, the value of Δr/λ corresponding to the noise intensity ratio is derived based on the data (step S14).

A condition that must be satisfied by the distance Δr is derived by substituting the wavelength of the main noise for (step S16).

A specific example in which the frequency of the main noise is 1 kHz and a voice input device that reduces the intensity of the noise by 20 dB is manufactured in an environment in which the wavelength of the noise is 0.347 m is discussed below.

First, a condition necessary for the noise intensity ratio to become 0 dB or less will be discussed. Referring to FIG. 5, the noise intensity ratio can be set at 0 dB or less by setting the value of Δr/λ at 0.16 or less. That is, the noise intensity ratio can be set at 0 dB or less by setting the value of Δr at 55.46 mm or less. This is a necessary condition for the voice input device.

Next, a condition necessary for reducing the intensity of noise having a frequency of 1 KHz by 20 dB will be discussed. Referring to FIG. 5, the intensity of noise can be reduced by 20 dB by setting the value of Δr/λ at 0.015. When λ=0.347 m, this condition is satisfied by setting the value of Δr at 5.20 mm or less. That is, a close-talking sound input device having a noise removal function can be manufactured by setting the center-to-center distance Δr between the first and second vibrating membranes 12 and 22 (the first and second microphones 10 and 20) at about 5.2 mm or less.

The voice input device according to this embodiment is a close-talking voice input device, and the distance between the sound source of the user's voice and the first or second vibrating membrane 12 or 22 is normally 5 cm or less. Moreover, the distance between the sound source of the user's voice and the first and second vibrating membranes 12 and 22 can be controlled by changing the design of the housing 40. Therefore, it can be understood that the value of Δr/R which is the intensity ratio of the input voice (user's voice) becomes larger than 0.1 (noise intensity ratio), so that the noise removal function is implemented.

Generally, noise is not limited to a single frequency. However, since the wavelength of noise having a frequency lower than that of noise considered as the main noise is longer than the wavelength of the main noise, the value of Δr/λ decreases, so that the noise is removed by the voice input device. On the other hand, the energy of sound waves is attenuated more quickly as the frequency becomes higher. Therefore, since the noise having a frequency higher than that of noise considered as the main noise is attenuated more quickly than the main noise, the effect of the noise on the voice input device can be disregarded. Therefore, the voice input device according to this embodiment exhibits an excellent noise removal function even in an environment in which noise having a frequency different from that of noise considered as the main noise is present.

As can be understood from the expression (12), this embodiment has been described for a case where noise enters along a straight line that connects the first and second vibrating membranes 12 and 22. In this case, the apparent distance between the first and second vibrating membranes 12 and 22 becomes a maximum, and the noise has the largest phase difference in an actual usage environment. That is, the voice input device according to this embodiment is configured to be able to remove noise having the largest phase difference. Therefore, according to the voice input device according to this embodiment, noise that enters from all directions is removed.

4. Effects

Effects achieved by the voice input device according to this embodiment are described below.

As described above, according to the voice input device according to this embodiment, it is possible to acquire a voice component from which a noise component has been removed by just generating the differential signal that represents the difference between the voltage signals obtained by the first and second microphones 10 and 20. That is, the voice input device can implement a noise removal function without performing a complex analytical calculation process. Therefore, according to this embodiment, it is possible to provide a voice input device that can implement a highly accurate noise removal function by a simple configuration. In particular, by setting the center-to-center distance Δr between the first and second vibrating membranes 12 and 14 at 5.2 mm or less, a voice input device which produces less phase distortion and which can implement a more accurate noise removal function can be provided.

Moreover, the center-to-center distance between the first and second vibrating membranes may be set at a distance in which the phase component of the voice intensity ratio that is the ratio of the intensity of the differential sound pressure of voices incident on the first and second vibrating membranes to the intensity of the sound pressure of a voice incident on the first vibrating membrane becomes 0 dB or less with respect to sound in the frequency band of 10 kHz or less.

The first and second vibrating membranes may be disposed along the travel direction of sound (for example, voice) from a sound source, and the center-to-center distance between the first and second vibrating membranes may be set within a range of distances in which the phase component of a sound pressure when the vibrating membrane is used as a differential microphone is equal to or less than the phase component of a sound pressure when the vibrating membrane is used as a single microphone with respect to sound in the frequency band of 10 kHz or less from the travel direction.

The delay distortion removal effect of the voice input device 1 will be described.

First, as described above, the user's voice intensity ratio ρ(S) is expressed by the following expression (8).

[Mathematical Formula 24]

$$\rho(S) = \frac{\frac{K}{R}\left|\sin\omega t - \frac{1}{1+\Delta r/R}\sin(\omega t-\alpha)\right|_{max}}{\frac{K}{R}\left|\sin\omega t\right|_{max}} = \frac{1}{1+\Delta r/R}\left|(1+\Delta r/R)\sin\omega t - \sin(\omega t-\alpha)\right|_{max} = \frac{1}{1+\Delta r/R}\left|\sin\omega t - \sin(\omega t-\alpha) + \frac{\Delta r}{R}\sin\omega t\right|_{max} \quad (8)$$

Here, the phase component $\rho(S)_{phase}$ of the user's voice intensity ratio ρ(S) corresponds to the term sin ωt-sin(ωt−α). By substituting the following expressions in the expression (8),

[Mathematical Formula 25]

$$\sin\omega t - \sin(\omega t-\alpha) = 2\sin\frac{\alpha}{2}\cdot\cos\left(\omega t-\frac{\alpha}{2}\right) \quad (9)$$

[Mathematical Formula 26]

$$\frac{1}{1+\Delta r/R} \approx 1$$

the phase component $\rho(S)_{phase}$ of the user's voice intensity ratio ρ(S) can be expressed as the following expression.

[Mathematical Formula 27]

$$\rho(S)_{phase} = \left|\cos\left(\omega t-\frac{\alpha}{2}\right)\right|_{max}\cdot 2\sin\frac{\alpha}{2} = 2\sin\frac{\alpha}{2} \quad (21)$$

Therefore, the decibel value of the intensity ratio based on the phase component $\rho(S)_{phase}$ of the user's voice intensity ratio ρ(S) can be expressed as the following expression.

[Mathematical Formula 28]

$$20\log\rho(S)_{phase} = 20\log\left|2\sin\frac{\alpha}{2}\right| \quad (22)$$

The relationship between the phase difference α and the intensity ratio based on the phase component of the user's voice can be determined by substituting each value for α in the expression (22).

Figure 41:
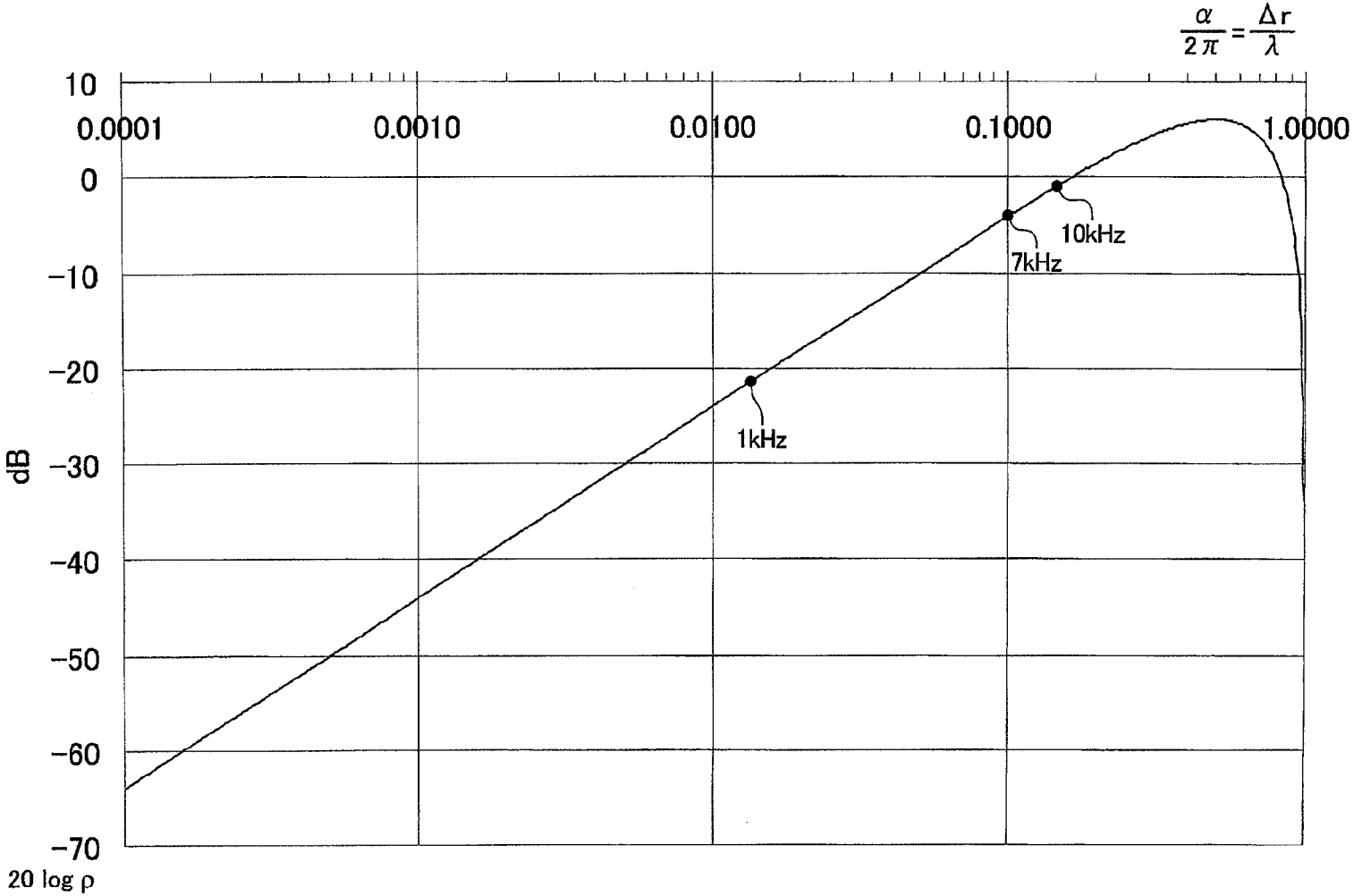
FIG. 41 is a diagram for describing the relationship of phase-component distribution of a user's voice intensity ratio when the intermicrophone distance is 5 mm.
Figure 42:
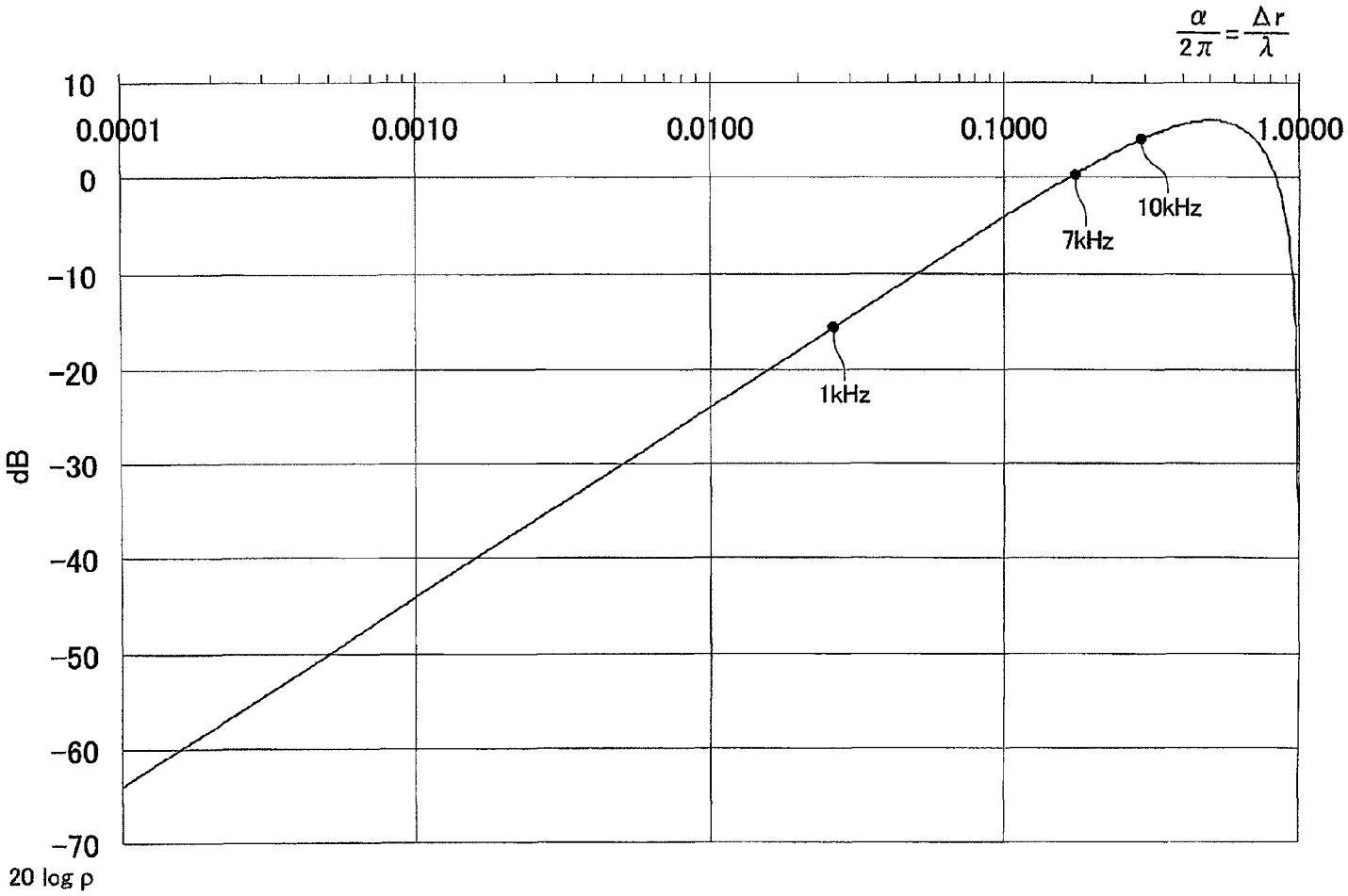
FIG. 42 is a diagram for describing the relationship of phase-component distribution of a user's voice intensity ratio when the intermicrophone distance is 10 mm.
Figure 43:
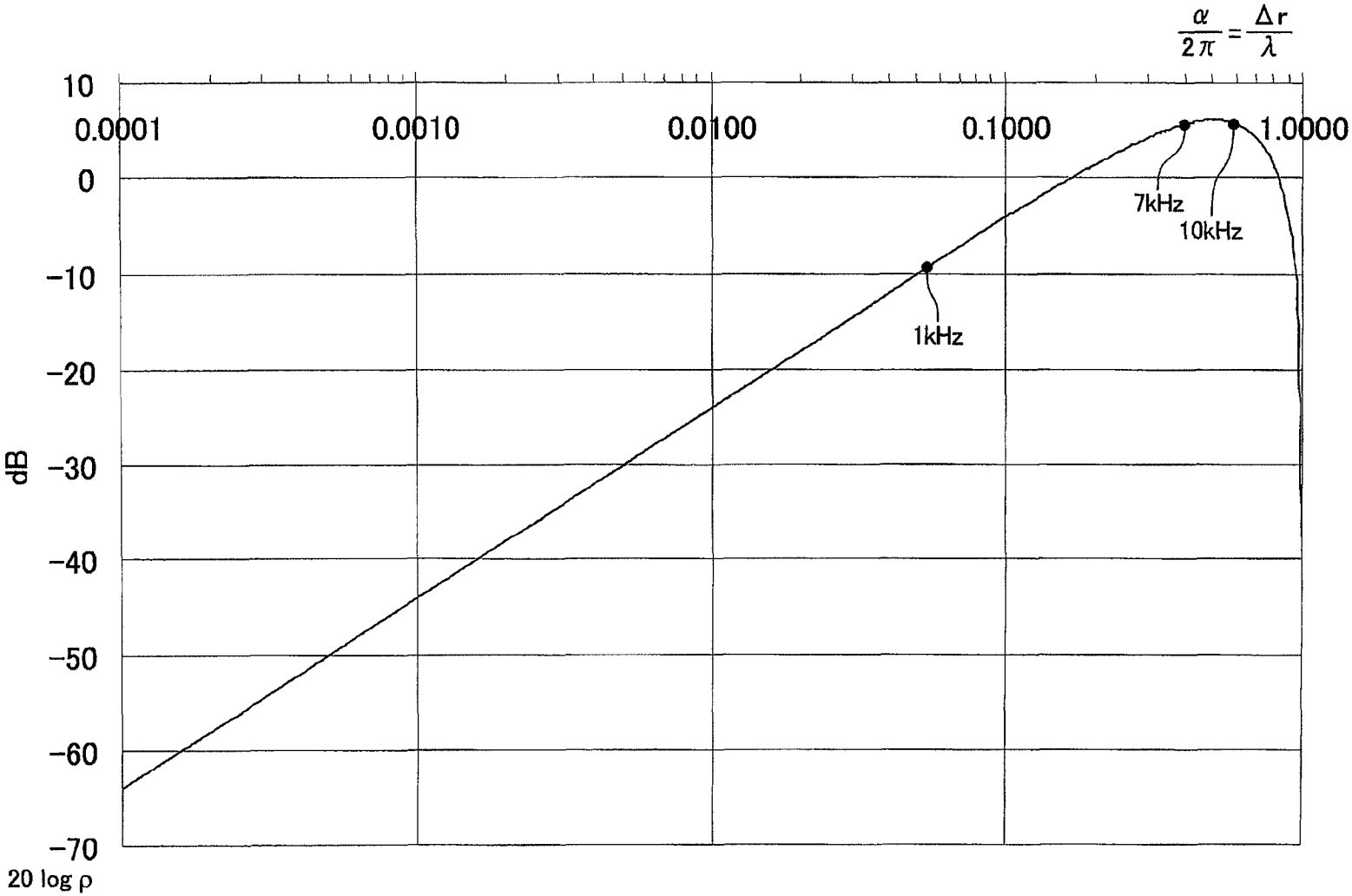
FIG. 43 is a diagram for describing the relationship of phase-component distribution of a user's voice intensity ratio when the intermicrophone distance is 20 mm.

FIGS. 41 to 43 are diagrams for describing the relationship between the intermicrophone distance and the phase component $\rho(S)_{phase}$ of the user's voice intensity ratio ρ(S). In FIGS. 41 to 44, the horizontal axis represents the ratio Δr/λ, and the vertical axis represents the phase component $\rho(S)_{phase}$ of the user's voice intensity ratio ρ(S). The term "phase component $\rho(S)_{phase}$ of user's voice intensity ratio ρ(S)" is the phase component (the intensity ratio based on the phase component of the user's voice) of the sound pressure ratio between the differential microphone and the single microphone. A point at which the sound pressure when the microphone forming the differential microphone is used as a single microphone is equal to the differential sound pressure is 0 dB.

That is, the graphs shown in FIGS. 41 to 43 represent a change in differential sound pressure corresponding to the ratio Δr/λ. It can be considered that a delay distortion (noise) is large in the areas of which the values on the vertical axis are equal to or higher than 0 dB.

Although the current telephone line is designed for a voice frequency band of 3.4 kHz, in order to realize a higher-quality voice communication, a voice frequency band of 7 kHz or more, and preferably a voice frequency band of 10 kHz, is required. Hereinafter, the effect of voice distortion caused by delay will be discussed for a voice frequency band of 10 kHz.

FIG. 41 shows the distribution of the phase component $\rho(S)_{phase}$ of the user's voice intensity ratio ρ(S) when sound in the frequency of 1 kHz, 7 kHz, or 10 kHz is collected using the differential microphone and the intermicrophone distance (Δr) is 5 mm.

As shown in FIG. 41, when the intermicrophone distance is 5 mm, the phase component $\rho(S)_{phase}$ of the user's voice intensity ratio ρ(S) of sound in the frequency of 1 kHz, 7 kHz, or 10 kHz is equal to or less than 0 dB.

FIG. 42 shows the distribution of the phase component $\rho(S)_{phase}$ of the user's voice intensity ratio ρ(S) when sound in the frequency of 1 kHz, 7 kHz, or 10 kHz is collected using the differential microphone and the intermicrophone distance (Δr) is 10 mm.

As shown in FIG. 42, when the intermicrophone distance is 10 mm, the phase component $\rho(S)_{phase}$ of the user's voice intensity ratio ρ(S) of sound in the frequency of 1 kHz or 7 kHz is equal to or less than 0 dB. However, the phase component $\rho(S)_{phase}$ of the user's voice intensity ratio ρ(S) of sound in the frequency of 10 kHz is equal to or higher than 0 dB, so that a delay distortion (noise) increases.

FIG. 43 shows the distribution of the phase component $\rho(S)_{phase}$ of the user's voice intensity ratio ρ(S) when sound in the frequency of 1 kHz, 7 kHz, or 10 kHz is collected using the differential microphone and the intermicrophone distance (Δr) is 20 mm.

As shown in FIG. 43, when the intermicrophone distance is 20 mm, the phase component $\rho(S)_{phase}$ of the user's voice intensity ratio ρ(S) of sound in the frequency of 1 kHz is equal to or less than 0 dB. However, the phase component $\rho(S)_{phase}$ of the user's voice intensity ratio ρ(S) of sound in the frequency of 7 kHz or 10 kHz is equal to or higher than 0 dB, so that a delay distortion (noise) increases.

Therefore, by setting the intermicrophone distance at about 5 mm to about 6 mm (more specifically, 5.2 mm or less), it is possible to implement a voice input device which can accurately extract speech sound in the frequency band of up to 10 kHz and can significantly suppress distant noise.

Here, although the phase distortion of speech sound is suppressed and the accuracy increases as the intermicrophone distance is shortened, the output level of the differential microphone decreases and the SN ratio decreases. Therefore, when practical use is considered, an optimal intermicrophone distance range exists.

In this embodiment, by setting the center-to-center distance between the first and second vibrating membranes at about 5 mm to about 6 mm (more specifically, 5.2 mm or less), it is possible to implement a voice input device which can accurately extract speech sound in the frequency band of up to 10 kHz, can secure an SN ratio of a practical level, and can significantly suppress distant noise.

Moreover, according to this voice input device, since the noise intensity ratio based on the phase difference is smaller than the input voice intensity ratio, the noise removal function is implemented. However, the noise intensity ratio based on the phase difference changes in accordance with the arrangement direction of the first and second vibrating membranes 12 and 22 and the incident direction of noise. That is, as the distance (apparent distance) between the first and second vibrating membranes 12 and 22 with respect to noise increases, the phase difference of noise increases and the noise intensity ratio based on the phase difference increases. However, in this embodiment, as can be understood from the expression (12), the voice input device is configured to be able to remove noise having the largest apparent distance between the first and second vibrating membranes 12 and 22. In other words, in this embodiment, the first and second vibrating membranes 12 and 22 are disposed so that noise incident with the largest noise intensity ratio based on the phase difference can be removed. Therefore, according to this voice input device, noise that enters from all directions is removed. That is, according to the invention, it is possible to provide a voice input device that can remove noise entering from all directions.

FIGS. 44A to 52B are diagrams for describing the directivity of the differential microphone with respect to the sound source frequency, the intermicrophone distance Δr, and the microphone-sound source distance.

Figure 44A:
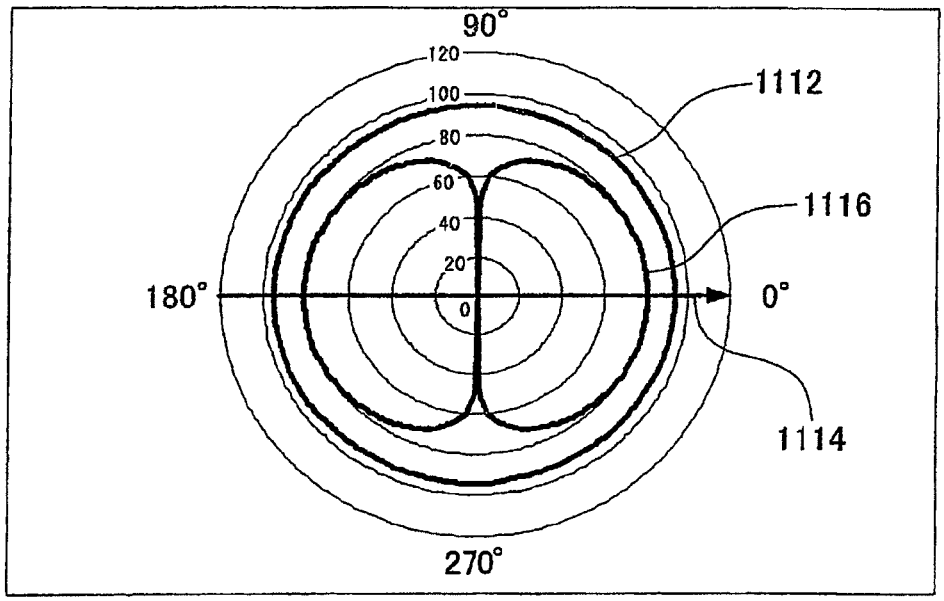
FIG. 44A is a diagram for describing the directivity of a differential microphone when an intermicrophone distance is 5 mm, a sound source frequency is 1 kHz, and a microphone-sound source distance is 2.5 cm.
Figure 44B:
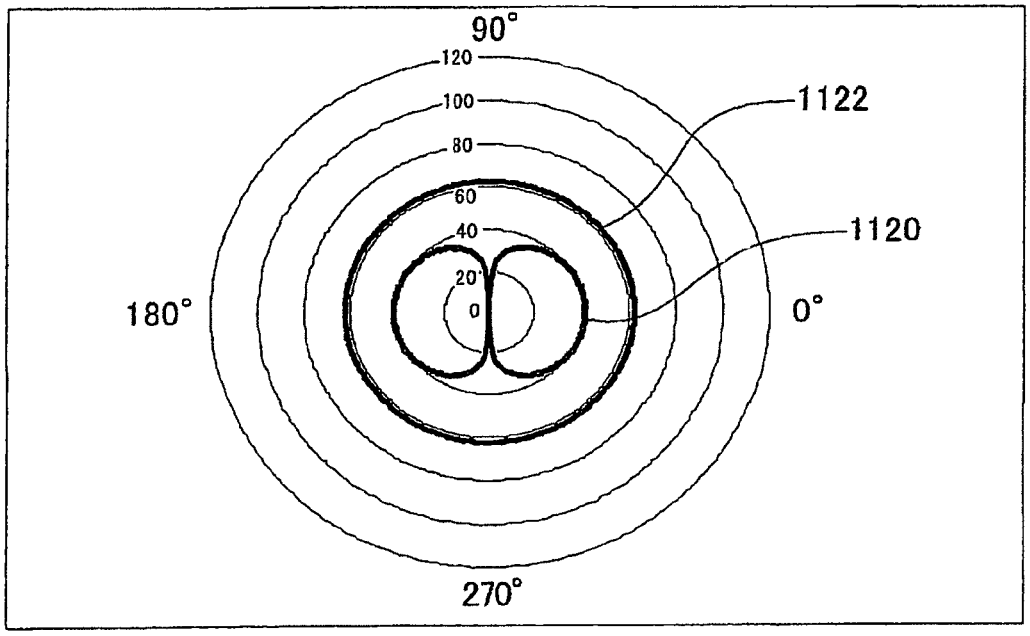
FIG. 44B is a diagram for describing the directivity of a differential microphone when an intermicrophone distance is 5 mm, a sound source frequency is 1 kHz, and a microphone-sound source distance is 1 m.

FIGS. 44A and 44B are diagrams showing the directivity of the differential microphone when the sound source frequency is 1 kHz, the intermicrophone distance Δr is 5 mm, and the microphone-sound source distance is 2.5 cm (corresponding to the close-talking distance between the mouth of the speaker and the microphone) or 1 m (corresponding to distant noise).

Reference numeral 1116 represents a graph showing the sensitivity (differential sound pressure) of the differential microphone in all directions, showing the directional pattern of the differential microphone. Reference numeral 1112 represents a graph showing the sensitivity (sound pressure) in all directions when using the differential microphone as a single microphone, showing the directional pattern of the single microphone.

Reference numeral 1114 represents the direction of a straight line that connects the two microphones when forming a differential microphone using two microphones or the direction of a straight line that connects the first and second vibrating membranes for allowing sound waves to reach both faces of a microphone when implementing a differential microphone using one microphone (0°-180°, two microphones M1 and M2 of the differential microphone or the first and second vibrating membranes are positioned on the straight line). The direction of the straight line is a 0°-180° direction, and a direction perpendicular to the direction of the straight line is a 90°-270° direction.

As denoted by 1112 and 1122, the single microphone uniformly collects sound from all directions and does not have directivity. Moreover, the sound pressure collected is attenuated as the distance from the sound source increases.

As denoted by 1116 and 1120, the differential microphone shows a decrease in sensitivity to some extent in the 90° direction and the 270° direction, but has almost uniform directivity in all directions. The sound pressure collected by the differential microphone is attenuated more than the single microphone, and the collected sound pressure is attenuated to a larger extent as the distance from the sound source increases similarly to the single microphone.

As shown in FIG. 44B, when the sound source frequency is 1 kHz and the intermicrophone distance Δr is 5 mm, the area indicated by the graph 1120 of the differential sound pressure which represents the directivity of the differential microphone is included in the area of the graph 1122 which represents the directivity of the single microphone. Thus, it can be said that the differential microphone suppresses distant noise better than the single microphone.

Figure 45A:
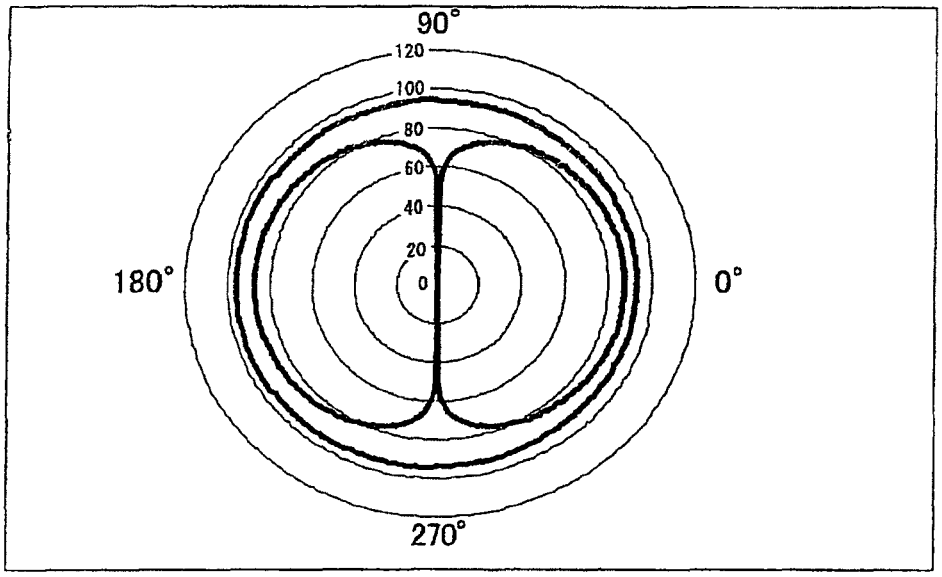
FIG. 45A is a diagram for describing the directivity of a differential microphone when an intermicrophone distance is 10 mm, a sound source frequency is 1 kHz, and a microphone-sound source distance is 2.5 cm.
Figure 45B:
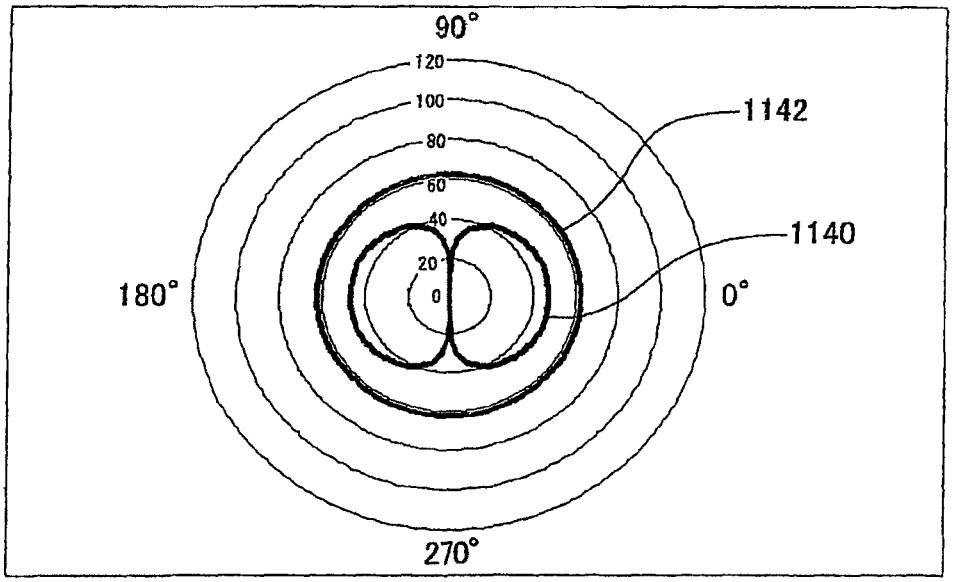
FIG. 45B is a diagram for describing the directivity of a differential microphone when an intermicrophone distance is 10 mm, a sound source frequency is 1 kHz, and a microphone-sound source distance is 1 m.

FIGS. 45A and 45B are diagrams showing the directivity of the differential microphone when the sound source frequency is 1 kHz, the intermicrophone distance Δr is 10 mm, and the microphone-sound source distance is 2.5 cm or 1 m. In this case, also, as shown in FIG. 45B, the area indicated by the graph 1140 which represents the directivity of the differential microphone is included in the area of the graph 1142 which represents the directivity of the single microphone. Thus, it can be said that the differential microphone reduces distant noise better than the single microphone.

Figure 46A:
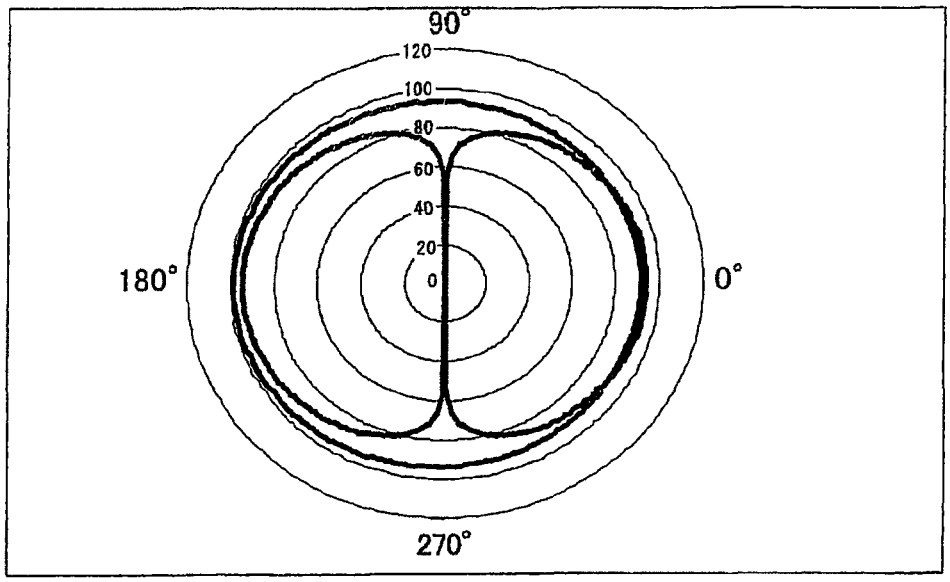
FIG. 46A is a diagram for describing the directivity of a differential microphone when an intermicrophone distance is 20 mm, a sound source frequency is 1 kHz, and a microphone-sound source distance is 2.5 cm.
Figure 46B:
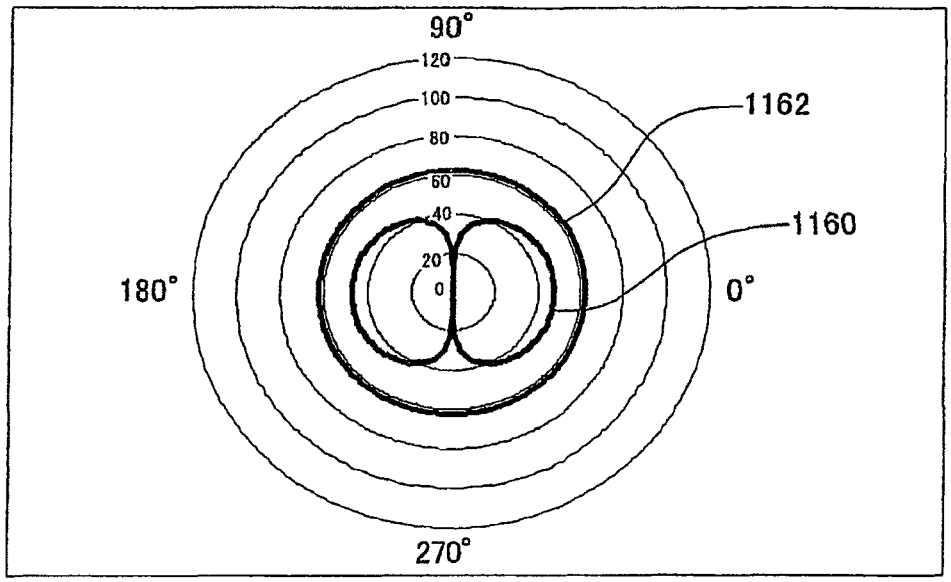
FIG. 46B is a diagram for describing the directivity of a differential microphone when an intermicrophone distance is 20 mm, a sound source frequency is 1 kHz, and a microphone-sound source distance is 1 m.

FIGS. 46A and 46B are diagrams showing the directivity of the differential microphone when the sound source frequency is 1 kHz, the intermicrophone distance Δr is 20 mm, and the microphone-sound source distance is 2.5 cm or 1 m. In this case, also, as shown in FIG. 46B, the area indicated by the graph 1160 which represents the directivity of the differential microphone is included in the area of the graph 1162 which represents the directivity of the single microphone. Thus, it can be said that the differential microphone reduces distant noise better than the single microphone.

Figure 47A:
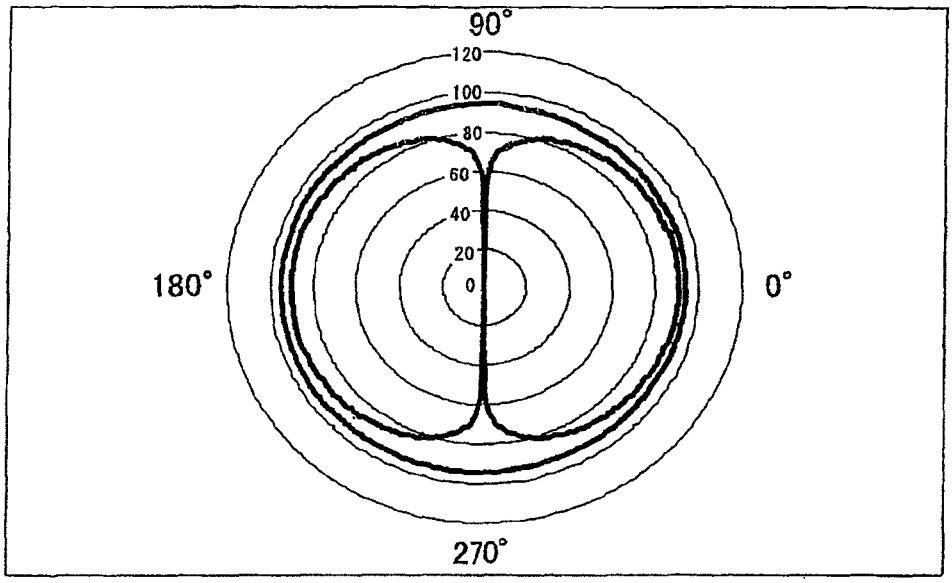
FIG. 47A is a diagram for describing the directivity of a differential microphone when an intermicrophone distance is 5 mm, a sound source frequency is 7 kHz, and a microphone-sound source distance is 2.5 cm.
Figure 47B:
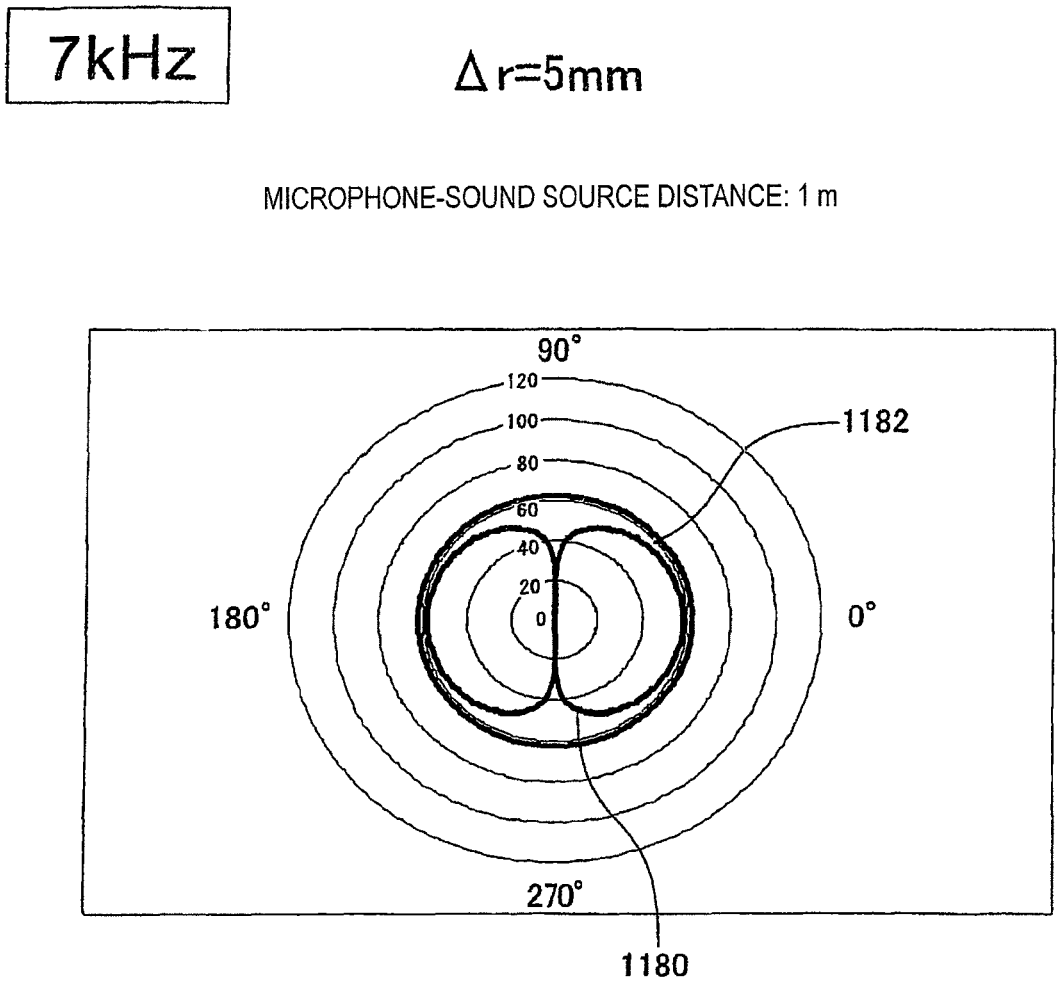
FIG. 47B is a diagram for describing the directivity of a differential microphone when an intermicrophone distance is 5 mm, a sound source frequency is 7 kHz, and a microphone-sound source distance is 1 m.

FIGS. 47A and 47B are diagrams showing the directivity of the differential microphone when the sound source frequency is 7 kHz, the intermicrophone distance Δr is 5 mm, and the microphone-sound source distance is 2.5 cm or 1 m. In this case, also, as shown in FIG. 47B, the area indicated by the graph 1180 which represents the directivity of the differential microphone is included in the area of the graph 1182 which represents the directivity of the single microphone. Thus, it can be said that the differential microphone reduces distant noise better than the single microphone.

Figure 48A:
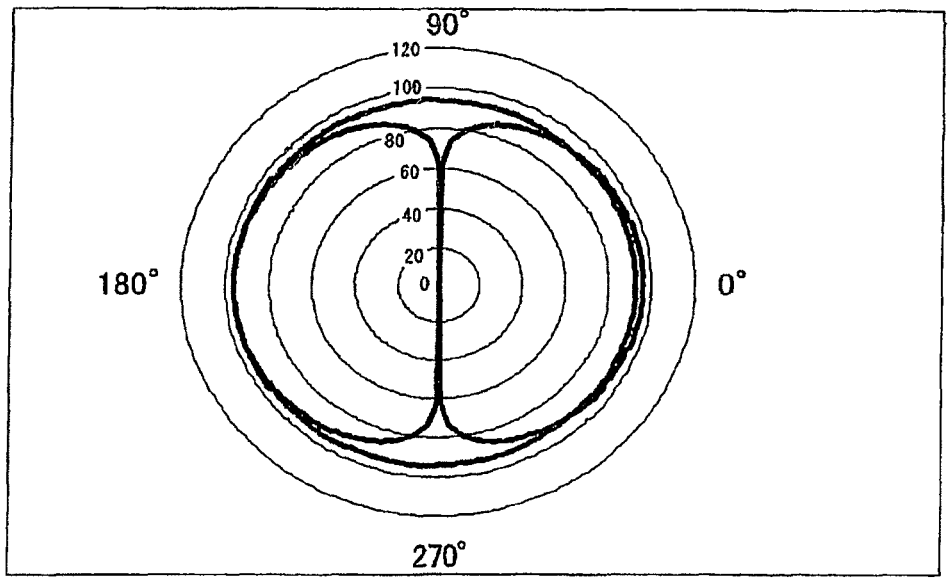
FIG. 48A is a diagram for describing the directivity of a differential microphone when an intermicrophone distance is 10 mm, a sound source frequency is 7 kHz, and a microphone-sound source distance is 2.5 cm.
Figure 48B:
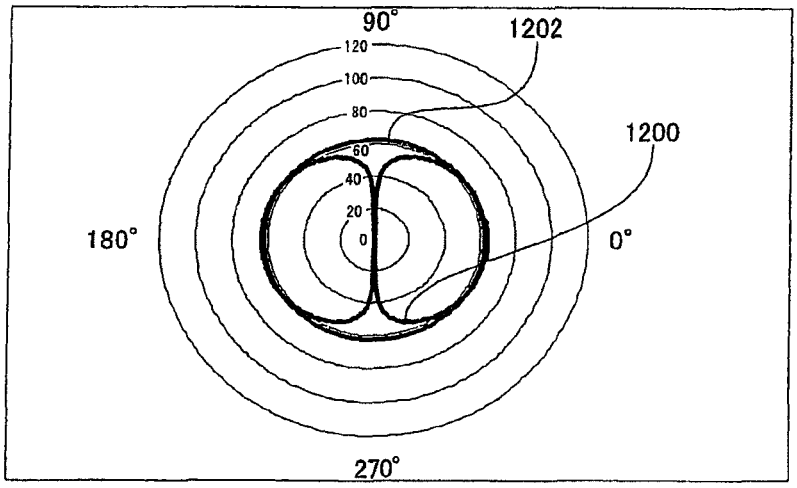
FIG. 48B is a diagram for describing the directivity of a differential microphone when an intermicrophone distance is 10 mm, a sound source frequency is 7 kHz, and a microphone-sound source distance is 1 m.

FIGS. 48A and 48B are diagrams showing the directivity of the differential microphone when the sound source frequency is 7 kHz, the intermicrophone distance Δr is 10 mm, and the microphone-sound source distance is 2.5 cm or 1 m. In this case, also, as shown in FIG. 48B, the area indicated by the graph 1200 which represents the directivity of the differential microphone is not included in the area of the graph 1202 which represents the directivity of the single microphone. Thus, it can be said that the differential microphone reduces distant noise less than the single microphone.

Figure 49A:
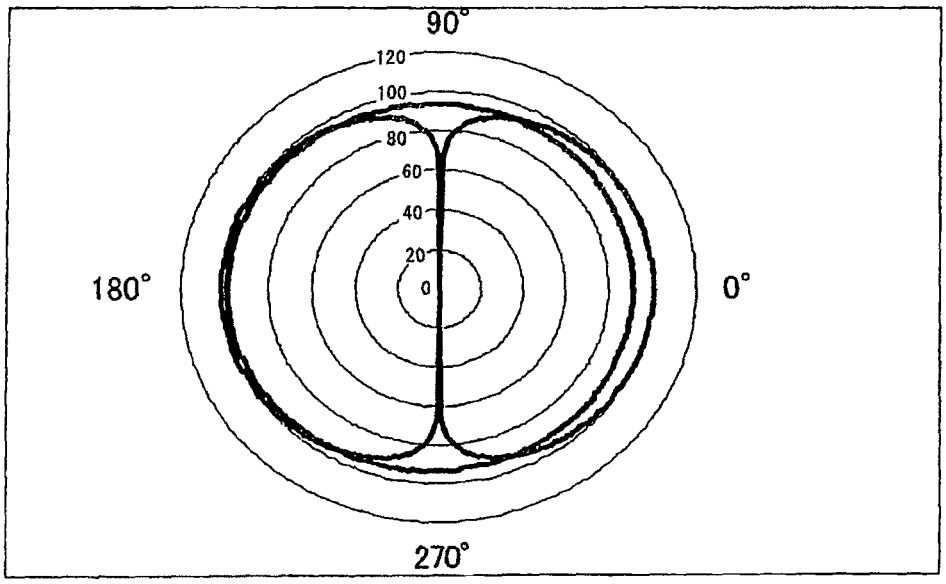
FIG. 49A is a diagram for describing the directivity of a differential microphone when an intermicrophone distance is 20 mm, a sound source frequency is 7 kHz, and a microphone-sound source distance is 2.5 cm.
Figure 49B:
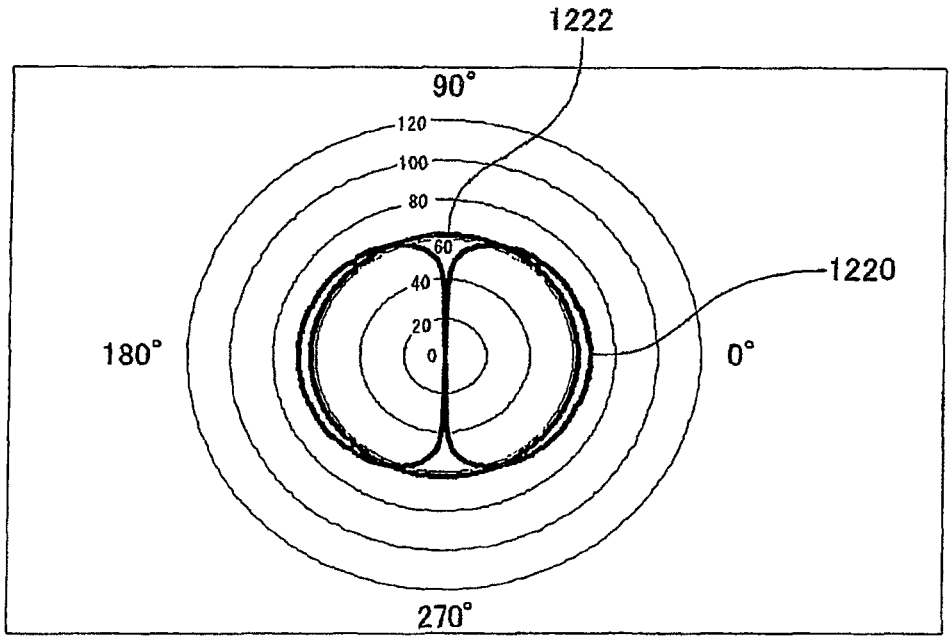
FIG. 49B is a diagram for describing the directivity of a differential microphone when an intermicrophone distance is 20 mm, a sound source frequency is 7 kHz, and a microphone-sound source distance is 1 m.

FIGS. 49A and 49B are diagrams showing the directivity of the differential microphone when the sound source frequency is 7 kHz, the intermicrophone distance Δr is 20 mm, and the microphone-sound source distance is 2.5 cm or 1 m. In this case, also, as shown in FIG. 49B, the area indicated by the graph 1220 which represents the directivity of the differential microphone is not included in the area of the graph 1222 which represents the directivity of the single microphone. Thus, it can be said that the differential microphone reduces distant noise less than the single microphone.

Figure 50A:
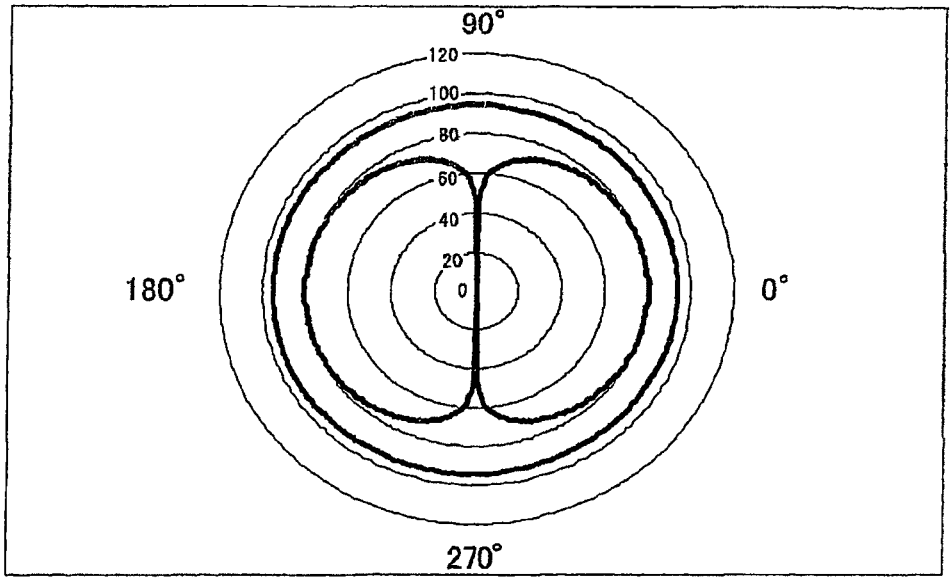
FIG. 50A is a diagram for describing the directivity of a differential microphone when an intermicrophone distance is 5 mm, a sound source frequency is 300 Hz, and a microphone-sound source distance is 2.5 cm.
Figure 50B:
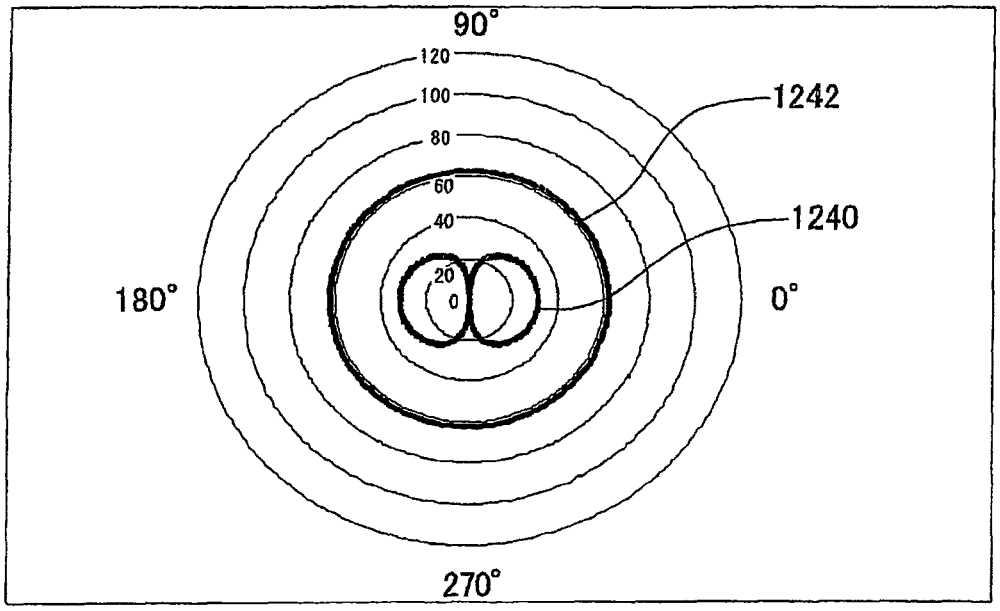
FIG. 50B is a diagram for describing the directivity of a differential microphone when an intermicrophone distance is 5 mm, a sound source frequency is 300 Hz, and a microphone-sound source distance is 1 m.

FIGS. 50A and 50B are diagrams showing the directivity of the differential microphone when the sound source frequency is 300 Hz, the intermicrophone distance Δr is 5 mm, and the microphone-sound source distance is 2.5 cm or 1 m. In this case, also, as shown in FIG. 50B, the area indicated by the graph 1240 which represents the directivity of the differential microphone is included in the area of the graph 1242 which represents the directivity of the single microphone. Thus, it can be said that the differential microphone reduces distant noise better than the single microphone.

Figure 51A:
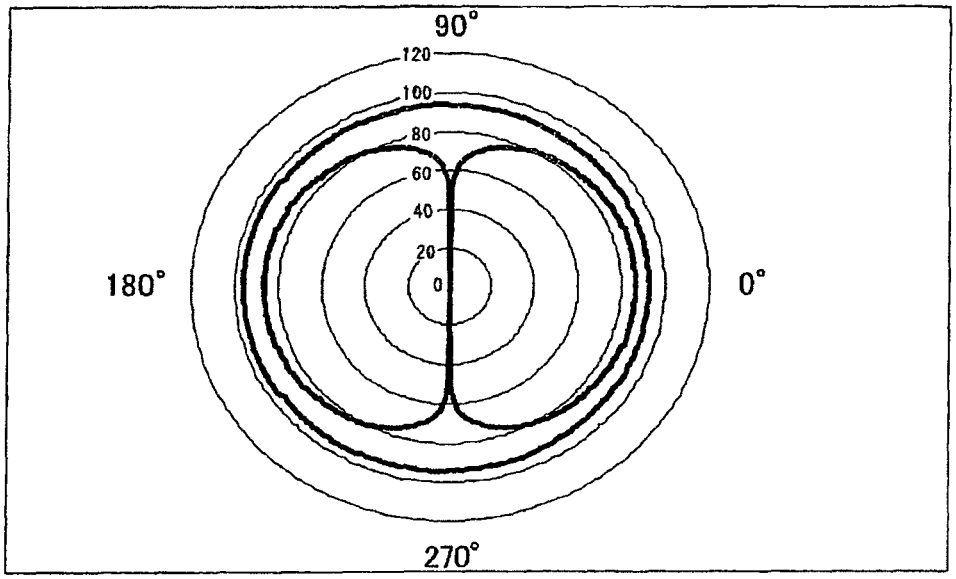
FIG. 51A is a diagram for describing the directivity of a differential microphone when an intermicrophone distance is 10 mm, a sound source frequency is 300 Hz, and a microphone-sound source distance is 2.5 cm.
Figure 51B:
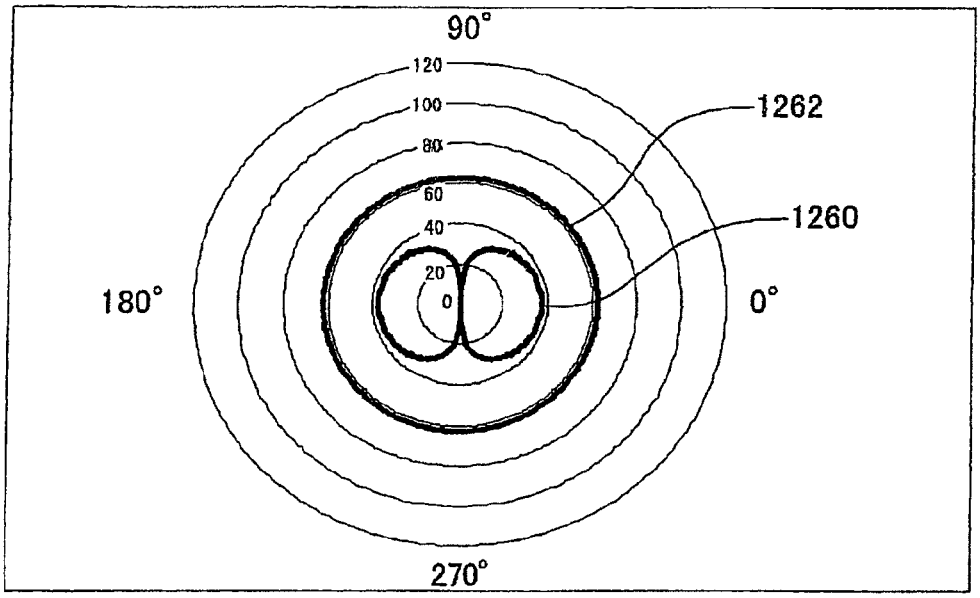
FIG. 51B is a diagram for describing the directivity of a differential microphone when an intermicrophone distance is 10 mm, a sound source frequency is 300 Hz, and a microphone-sound source distance is 1 m.

FIGS. 51A and 51B are diagrams showing the directivity of the differential microphone when the sound source frequency is 300 Hz, the intermicrophone distance Δr is 10 mm, and the microphone-sound source distance is 2.5 cm or 1 m. In this case, also, as shown in FIG. 51B, the area indicated by the graph 1260 which represents the directivity of the differential microphone is included in the area of the graph 1262 which represents the directivity of the single microphone. Thus, it can be said that the differential microphone reduces distant noise better than the single microphone.

Figure 52A:
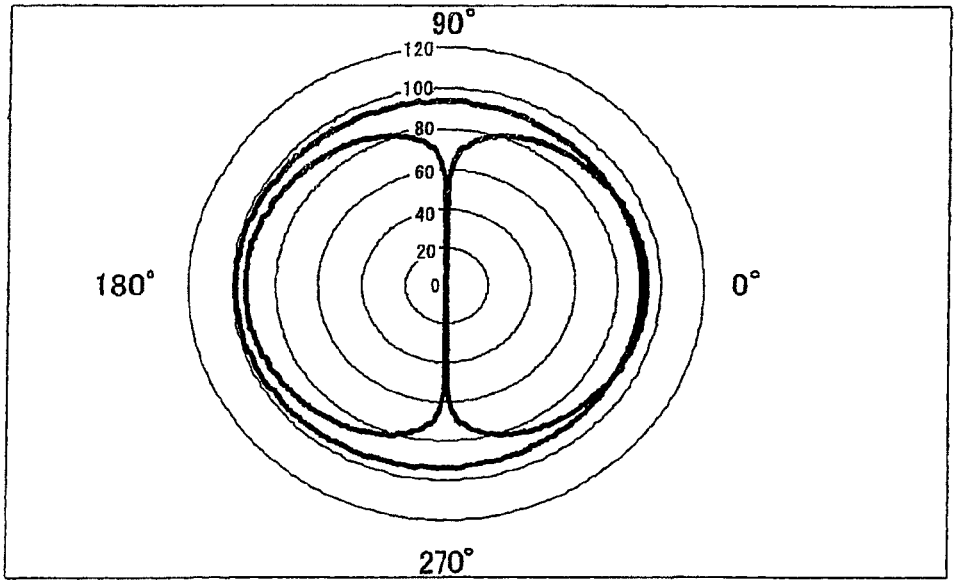
FIG. 52A is a diagram for describing the directivity of a differential microphone when an intermicrophone distance is 20 mm, a sound source frequency is 300 Hz, and a microphone-sound source distance is 2.5 cm.
Figure 52B:
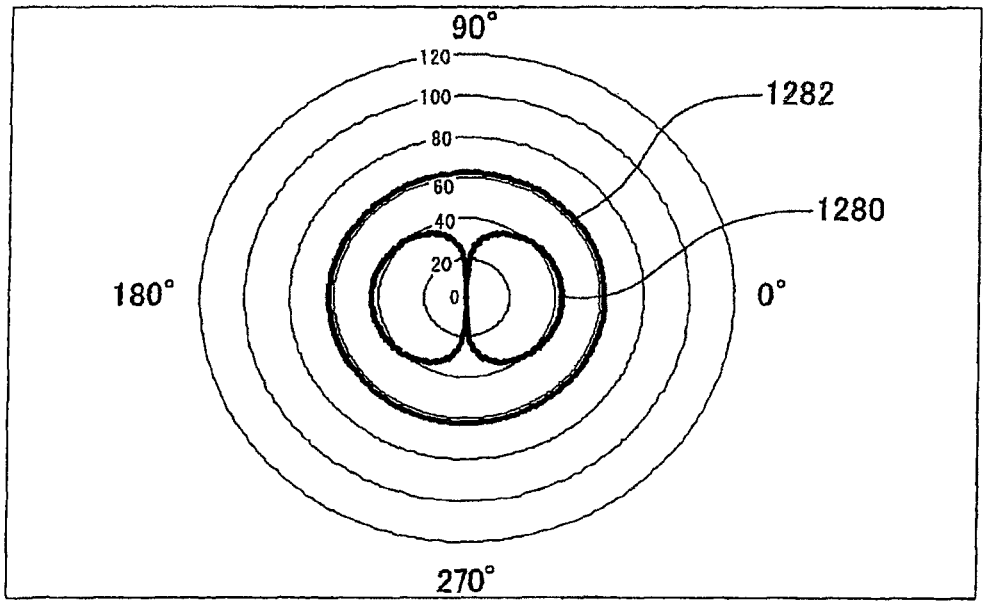
FIG. 52B is a diagram for describing the directivity of a differential microphone when an intermicrophone distance is 20 mm, a sound source frequency is 300 Hz, and a microphone-sound source distance is 1 m.

FIGS. 52A and 52B are diagrams showing the directivity of the differential microphone when the sound source frequency is 300 Hz, the intermicrophone distance Δr is 20 mm, and the microphone-sound source distance is 2.5 cm or 1 m. In this case, also, as shown in FIG. 52B, the area indicated by the graph 1280 which represents the directivity of the differential microphone is included in the area of the graph 1282 which represents the directivity of the single microphone. Thus, it can be said that the differential microphone reduces distant noise better than the single microphone.

As shown in FIGS. 44B, 47B, and 50B, when the intermicrophone distance is 5 mm, the area indicated by the graph which represents the directivity of the differential microphone is included in the area of the graph which represents the directivity of the single microphone when the frequency of sound is 1 kHz, 7 kHz, or 300 Hz. That is, when the intermicrophone distance is 5 mm, the differential microphone exhibits an excellent distant noise suppression effect as compared with the single microphone when the frequency band of sound is 7 kHz or less.

However, as shown in FIGS. 45B, 48B, and 50B, when the intermicrophone distance is 10 mm, the area indicated by the graph which represents the directivity of the differential microphone is not included in the area of the graph which represents the directivity of the single microphone when the frequency of sound is 7 kHz. That is, when the intermicrophone distance is 10 mm, the differential microphone does not exhibit an excellent distant noise suppression effect as compared with the single microphone when the frequency of sound is near 7 kHz (or 7 kHz or more).

Moreover, as shown in FIGS. 46B, 49B, and 52B, when the intermicrophone distance is 20 mm, the area indicated by the graph which represents the directivity of the differential microphone is not included in the area of the graph which represents the directivity of the single microphone when the frequency of sound is 7 kHz. That is, when the intermicrophone distance is 20 mm, the differential microphone does not exhibit an excellent distant noise suppression effect as compared with the single microphone when the frequency of sound is near 7 kHz (or 7 kHz or more).

By setting the intermicrophone distance of the differential microphone at about 5 mm to about 6 mm (more specifically, 5.2 mm or less), the differential microphone can exhibit an excellent distant noise suppression effect in all directions independent of directivity for sound in the frequency of 7 kHz or less as compared with the single microphone. Therefore, by setting the center-to-center distance between the first and second vibrating membranes at about 5 mm to about 6 mm (more specifically, 5.2 mm or less), it is possible to implement a voice input device which can suppress distant noise in all directions independent of directivity for sound in the frequency of 7 kHz or less.

According to this voice input device, it is possible to remove a user's voice component incident on the voice input device after being reflected by a wall or the like. Specifically, the sound source of a user's voice reflected by a wall or the like can be considered to be positioned away from the voice input device as compared with the sound source of a normal user's voice. Moreover, since the energy of such a user's voice has been reduced to a large extent due to reflection, the sound pressure is not attenuated to a large extent between the first and second vibrating membranes 12 and 22 in the same manner as a noise component. Therefore, according to this voice input device, a user's voice component incident on the voice input device after being reflected by a wall or the like is also removed in the same manner as noise (as one type of noise).

Moreover, by using this voice input device, a signal which represents an input voice and does not contain noise can be obtained. Therefore, by using this voice input device, highly accurate voice recognition, voice authentication, and command generation can be implemented.

Moreover, when this voice input device is applied to a microphone system, the user's voice output from a loudspeaker is also removed as noise. Therefore, a microphone system in which howling rarely occurs can be provided.

5. Voice Input Device According to Second Embodiment

Figure 7:
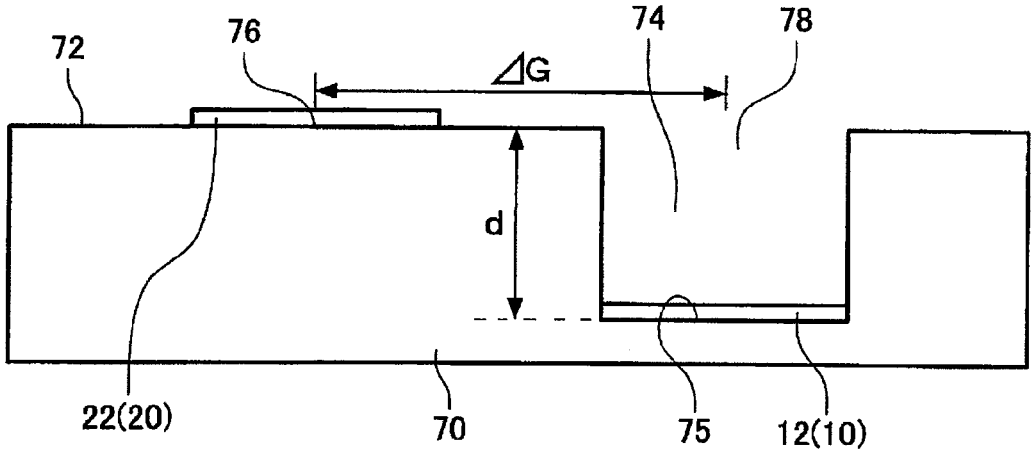
FIG. 7 is a diagram for describing a voice input device.

Next, a voice input device according to a second embodiment to which the invention is applied is described with reference to FIG. 7.

The voice input device according to this embodiment includes a base 70. A depression 74 is formed in a main surface 72 of the base 70. In the voice input device according to this embodiment, a first vibrating membrane 12 (first microphone 10) is disposed on a bottom surface 75 of the depression 74, and a second vibrating membrane 22 (second microphone 20) is disposed on the main surface 72 of the base 70. The depression 74 may extend perpendicularly to the main surface 72. The bottom surface 75 of the depression 74 may be parallel to the main surface 72. The bottom surface 75 may perpendicularly intersect the depression 74. The depression 74 may have the same external shape as that of the first vibrating membrane 12.

In this embodiment, the depression 74 may have a depth smaller than the distance between an area 76 and an opening 78. That is, when the depth of the depression 74 is referred to as d and the distance between the area 76 and the opening 78 is referred to as ΔG, the relationship "d≤ΔG" may be satisfied by the base 70. The base 70 may satisfy the relationship "2d=ΔG". The distance ΔG may be 5.2 mm or less. Alternatively, the base 70 may be formed so that the center-to-center distance between the first and second vibrating membranes 12 and 22 is 5.2 mm or less.

The base 70 is provided so that the opening 78 that communicates with the depression 74 is disposed at a position closer to the input voice source than the area 76 of the main surface 72 in which the second vibrating membrane 22 is disposed. The base 70 is provided so that the input voice reaches the first and second vibrating membranes 12 and 22 at the same time. For example, the base 70 may be disposed so that the distance between the input voice source (model sound source) and the first vibrating membrane 12 is equal to the distance between the model sound source and the second vibrating membrane 22. The base 70 may be disposed in a housing of which the basic position is set to satisfy the above-mentioned conditions.

According to the voice input device of this embodiment, it is possible to reduce the difference in incident time between the input voices (user's voices) incident on the first and second vibrating membranes 12 and 22. That is, since the differential signal can be generated so that the differential signal does not contain the phase difference component of the input voice, the amplitude component of the input voice can be accurately extracted.

Since sound waves are not diffused inside the depression 74, the amplitude of the sound waves is attenuated to only a small extent. Therefore, in this voice input device, the intensity (amplitude) of the input voice that causes the first vibrating membrane 12 to vibrate can be considered to be the same as the intensity of the input voice in the opening 78. Accordingly, even when the voice input device is configured so that the input voice reaches the first and second vibrating membranes 12 and 22 at the same time, a difference occurs in the intensities of the input voices that cause the first and second vibrating membranes 12 and 22 to vibrate. Therefore, the input voice can be extracted by obtaining the differential signal that represents the difference between the first and second voltage signals.

In summary, according to this voice input device, it is possible to acquire the amplitude component (differential signal) of the input voice so that noise based on the phase difference component of the input voice is not included. Therefore, it is possible to implement a highly accurate noise removal function.

Since the resonance frequency of the depression 74 can be set at a high value by setting the depth of the depression 74 to be equal to or less than the distance ΔG (5.2 mm), it is possible to prevent resonance noise from being generated in the depression 74.

Figure 8:
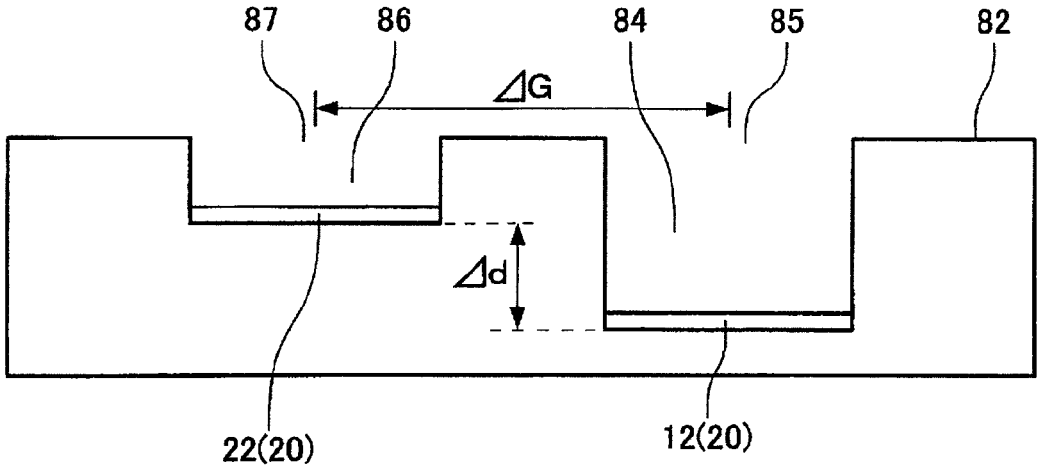
FIG. 8 is a diagram for describing a voice input device.

FIG. 8 illustrates a modification of the voice input device according to this embodiment.

The voice input device according to this embodiment includes a base 80. A first depression 84 and a second depression 86 that is shallower than the first depression 84 are formed in a main surface 82 of the base 80. A difference Δd in depth between the first depression 84 and the second depression 86 may be smaller than a distance ΔG between a first opening 85 that communicates with the first depression 84 and a second opening 87 that communicates with the second depression 86. The first vibrating membrane 12 is disposed on the bottom surface of the first depression 84, and the second vibrating membrane 22 is disposed on the bottom surface of the second depression 86.

This voice input device also achieves the above-mentioned effects and can implement a highly accurate noise removal function.

Figure 9:
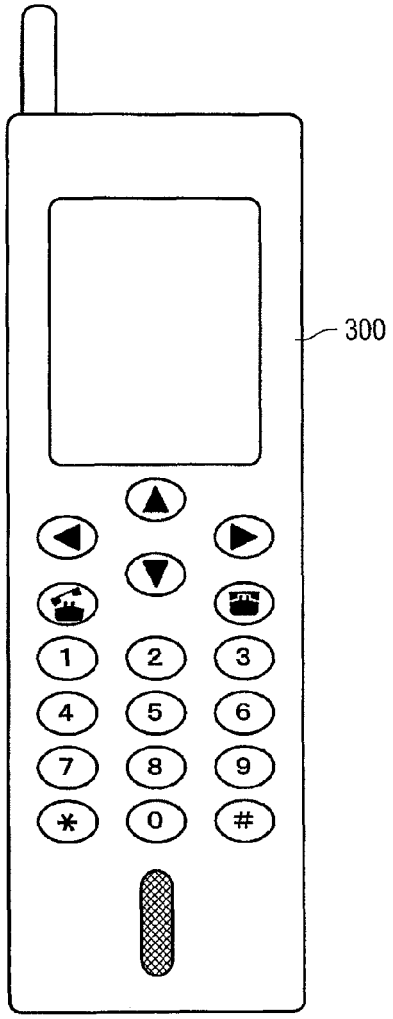
FIG. 9 is a diagram illustrating a portable phone that is an example of a voice input device.
Figure 10:
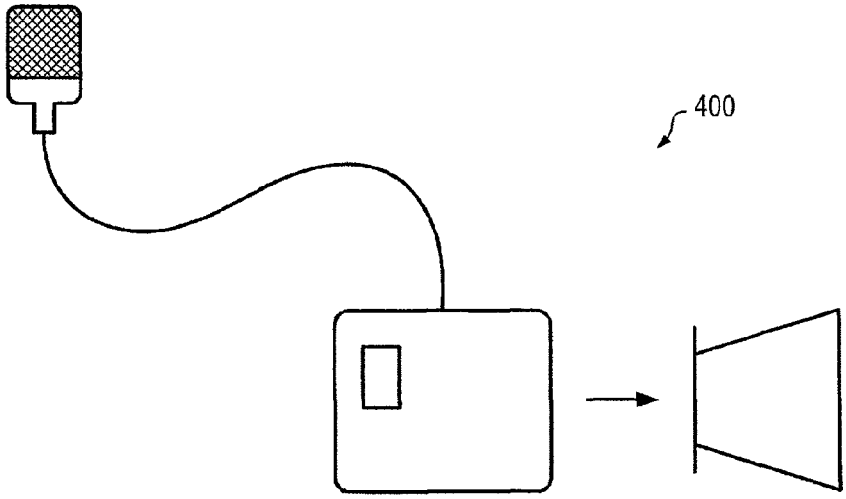
FIG. 10 is a diagram illustrating a microphone that is an example of a voice input device.
Figure 11:
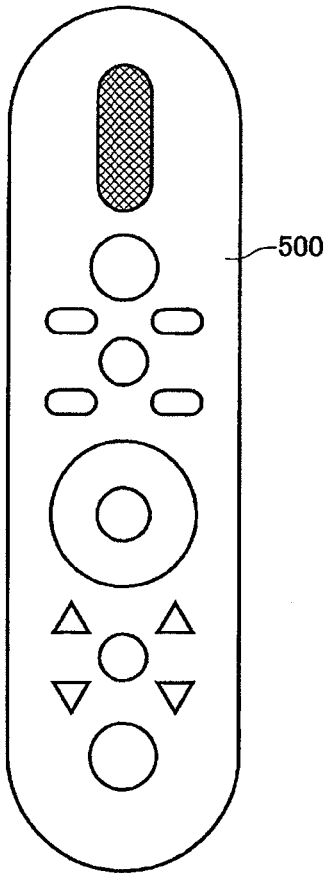
FIG. 11 is a diagram illustrating a remote controller that is an example of a voice input device.
Figure 12:
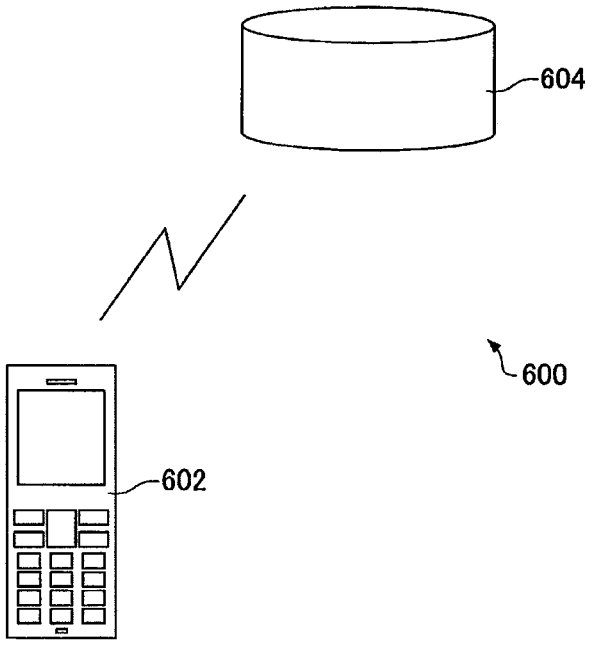
FIG. 12 is a schematic diagram of an information processing system.

Lastly, FIGS. 9 to 11 respectively illustrate a portable phone 300, a microphone (microphone system) 400, and a remote controller 500 as examples of the voice input device according to the embodiment of the invention. FIG. 12 schematically illustrates an information processing system 600 that includes a voice input device 602 used as an information input terminal and a host computer 604.

6. Configuration of Voice Input Device According to Third Embodiment

Figure 13:
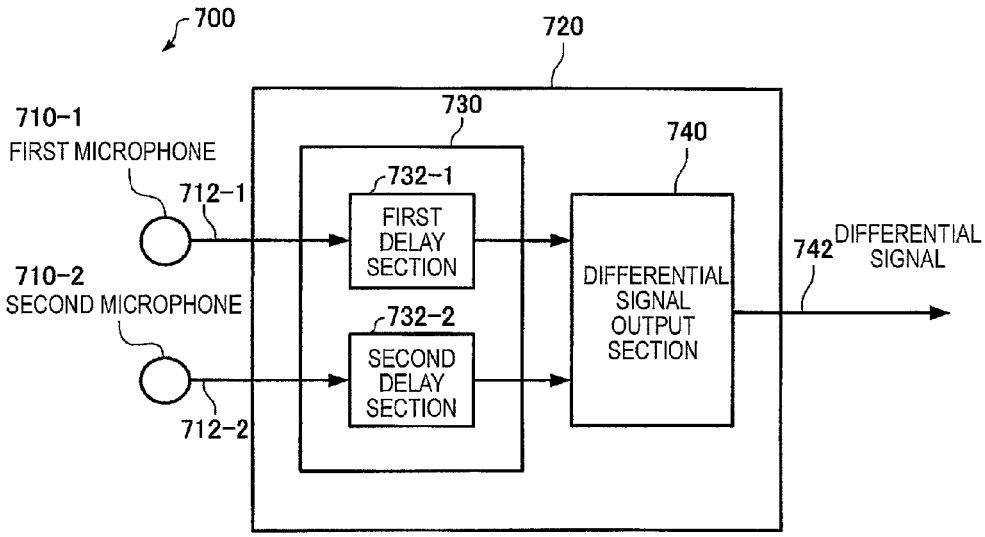
FIG. 13 is a diagram illustrating an example of the configuration of a voice input device.

FIG. 13 is a diagram illustrating an example of the configuration of a voice input device according to a third embodiment.

A voice input device 700 according to the third embodiment includes a first microphone 710-1 that includes a first vibrating membrane. The voice input device 700 according to the third embodiment also includes a second microphone 710-2 that includes a second vibrating membrane.

The first vibrating membrane of the first microphone 710-1 and the second vibrating membrane of the second microphone 710-2 are disposed so that a noise intensity ratio that represents the ratio of the intensity of a noise component contained in a differential signal 742 to the intensity of the noise component contained in a first or second voltage signal 712-1 or 712-2 is smaller than an input voice intensity ratio that represents the ratio of the intensity of an input voice component contained in the differential signal 742 to the intensity of the input voice component contained in the first or second voltage signal.

Moreover, the first microphone 710-1 that includes the first vibrating membrane and the second microphone 710-2 that includes the second vibrating membrane may be configured as described with reference to FIGS. 1 to 8.

The voice input device 700 according to the third embodiment includes a differential signal generation section 720 that generates the differential signal 742 that represents the difference between the first voltage signal 712-1 obtained by the first microphone 710-1 and the second voltage signal 712-2 obtained by the second microphone 710-2 based on the first voltage signal 712-1 and the second voltage signal 712-2.

The differential signal generation section 720 also includes a delay section 730. The delay section 730 delays at least one of the first voltage signal 712-1 obtained by the first microphone 710-1 and the second voltage signal 712-2 obtained by the second microphone 710-2 by a predetermined amount, and outputs the resulting signal.

The differential signal generation section 720 also includes a differential signal output section 740. The differential signal output section 740 receives the first voltage signal 712-1 obtained by the first microphone 710-1 and the second voltage signal 712-2 obtained by the second microphone 710-2, wherein at least one of the first voltage signal 712-1 and the second voltage signal 712-2 has been delayed by the delay section, generates a differential signal that represents the difference between the first and second voltage signals, and outputs the differential signal.

The delay section 730 may include a first delay section 732-1 that delays the first voltage signal 712-1 obtained by the first microphone 710-1 by a predetermined amount and outputs the resulting signal, or a second delay section 732-2 that delays the second voltage signal 712-2 by a predetermined amount and outputs the resulting signal, delay any one of the voltage signals, and generate the differential signal. The delay section 730 may include both the first delay section 732-1 and the second delay section 732-2, delay both the first voltage signal 712-1 and the second voltage signal 712-2, and generate the differential signal. When both the first delay section 732-1 and the second delay section 732-2 are provided, one of the delay sections may be configured as a delay section that delays a signal by a fixed amount, and the other delay section may be configured as a variable delay section of which the delay amount can be adjusted.

According to this configuration, a variation in delay of the first and second voltage signals due to an individual difference that occurs during manufacturing of microphones can be corrected by delaying at least one of the first voltage signal 712-1 and the second voltage signal 712-2 by a predetermined amount. Therefore, a decrease in the noise suppression effect due to a variation in delay of the first and second voltage signals can be prevented.

Figure 14:
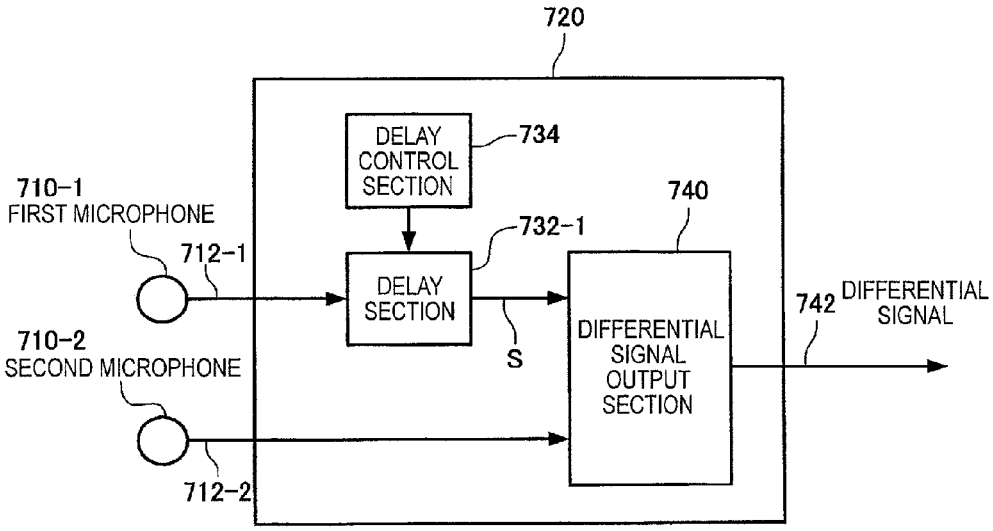
FIG. 14 is a diagram illustrating an example of the configuration of a voice input device.

FIG. 14 is a diagram illustrating an example of the configuration of the voice input device according to the third embodiment.

The differential signal generation section 720 according to this embodiment may include a delay control section 734. The delay control section 734 changes the delay amount of the delay section (the first delay section 732-1 in this example). The signal delay balance between an output S1 from the delay section and the second voltage signal 712-2 obtained by the second microphone may be adjusted by the delay control section 734 dynamically or statically controlling the delay amount of the delay section (the first delay section 732-1 in this example).

Figure 15:
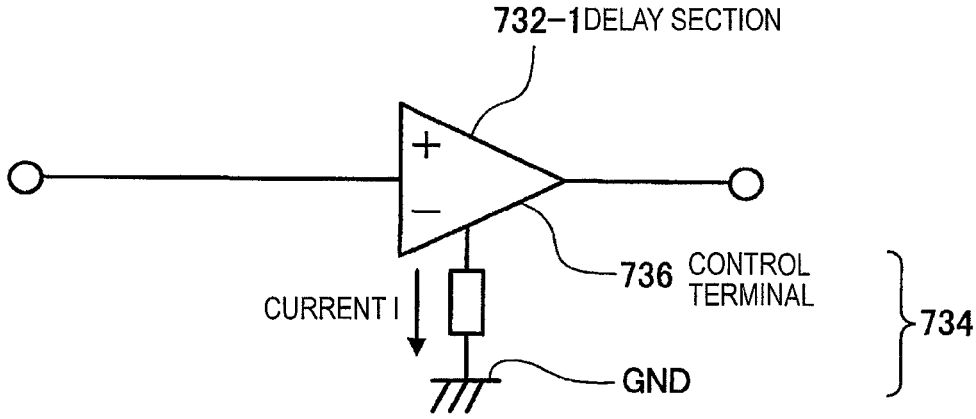
FIG. 15 is a diagram illustrating an example of the specific configuration of a delay section and a delay control section.

FIG. 15 is a diagram illustrating an example of the specific configuration of the delay section and the delay control section. For example, the delay section (the first delay section 732-1 in this example) may be formed by an analog filter such as a group delay filter. For example, the delay control section 734 may dynamically or statically control the delay amount of a group delay filter by controlling the voltage between a control terminal 736 of the group delay filter 732-1 and GND, or the amount of current that flows between the control terminal 736 and GND.

Figure 16A:
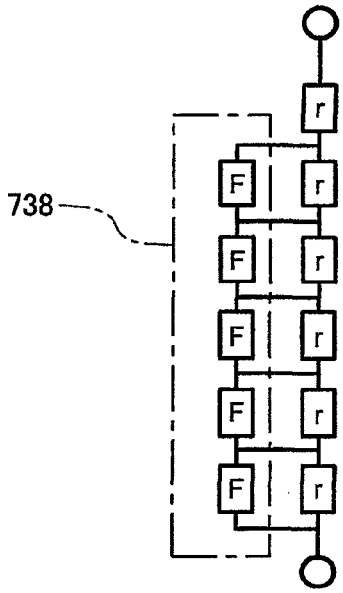
FIG. 16A is a diagram illustrating an example of a configuration that statically controls the delay amount of a group delay filter.
Figure 16B:
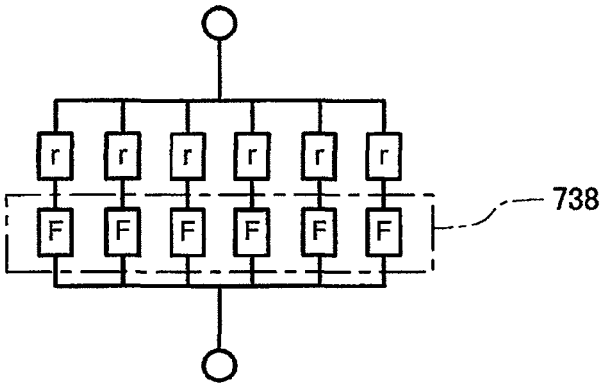
FIG. 16B is a diagram illustrating an example of a configuration that statically controls the delay amount of a group delay filter.

FIGS. 16A and 16B illustrate an example of a configuration that statically controls the delay amount of the group delay filter.

For example, as illustrated in FIG. 16A, the delay control section may include a resistor array in which a plurality of resistors (r) is connected in series, and supply a predetermined amount of current to a predetermined terminal (the control terminal 734 in FIG. 15) of the delay section through the resistor array. Here, during the manufacturing process, the resistors (r) or conductors (F denoted by reference numeral 738) that form the resistor array may be cut using a laser or fused by applying a high voltage or a high current in accordance with a predetermined amount of current.

Moreover, for example, as illustrated in FIG. 16B, the delay control section may include a resistor array in which a plurality of resistors (r) is connected in parallel, and supply a predetermined amount of current to a predetermined terminal (the control terminal 734 in FIG. 15) of the delay section through the resistor array. Here, during the manufacturing process, the resistors (r) or conductors (F) that form the resistor array may be cut using a laser or may be fused by applying a high voltage or a high current in accordance with the amount of current supplied to a predetermined terminal.

Here, the amount of current supplied to the predetermined terminal of the delay section may be set at a value that can cancel a variation in delay that has occurred during the manufacturing process. A resistance corresponding to a variation in delay that has occurred during the manufacturing process can be achieved by using the resistor array in which a plurality of resistors (r) is connected in series or parallel as shown in FIGS. 16A and 16B. Thus, the resistor array functions as the delay control section that is connected to the predetermined terminal so as to supply a current that controls the delay amount of the delay section.

Although this embodiment has been described by way of an example in which a plurality of resistors (r) is connected through fuses (F), the invention is not limited to this. A plurality of resistors (r) may be connected in series or parallel without using the fuses (F). In this case, at least one resistor may be cut.

Figure 32:
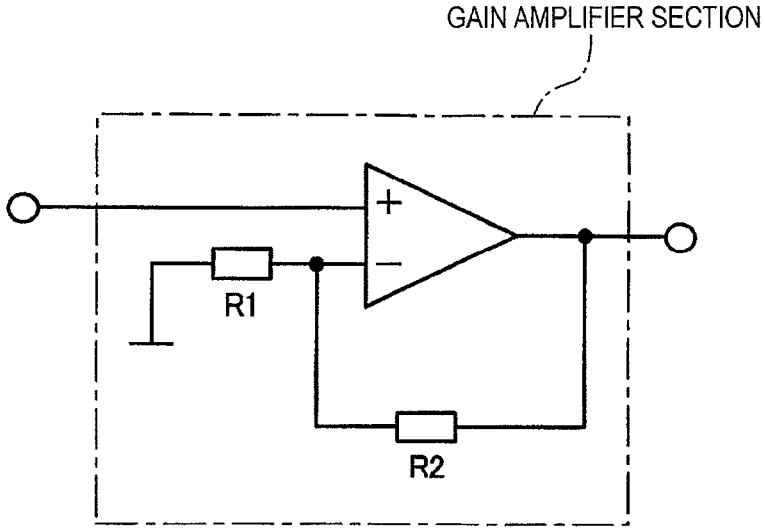
FIG. 32 is a diagram illustrating an example of the specific configuration of a gain section and a gain control section.
Figure 40:
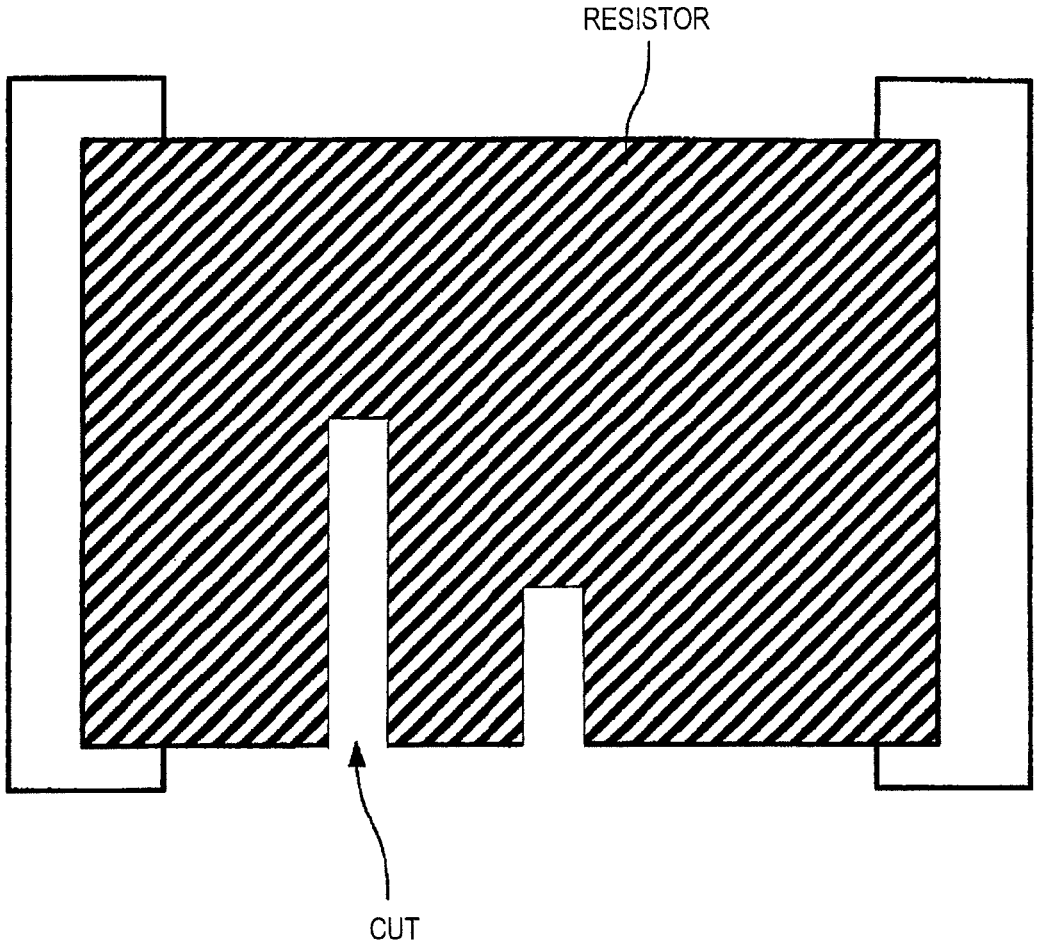
FIG. 40 is a diagram illustrating an example of adjustment of a resistance by laser trimming.

Moreover, for example, the resistor R1 or R2 in FIG. 32 may be formed by a single resistor as shown in FIG. 40, and the resistance of the resistor may be adjusted by so-called laser trimming which involves cutting a part of the resistor.

Moreover, trimming may be performed using a print resistor as the resistor which is patterned and formed, for example, by spraying resistors onto a wiring board on which the microphone 710 is mounted. In addition, in order to perform trimming during actual operation in the finished state of the microphone unit, it is more preferable to form the resistor on the surface of a housing of the microphone unit.

Figure 17:
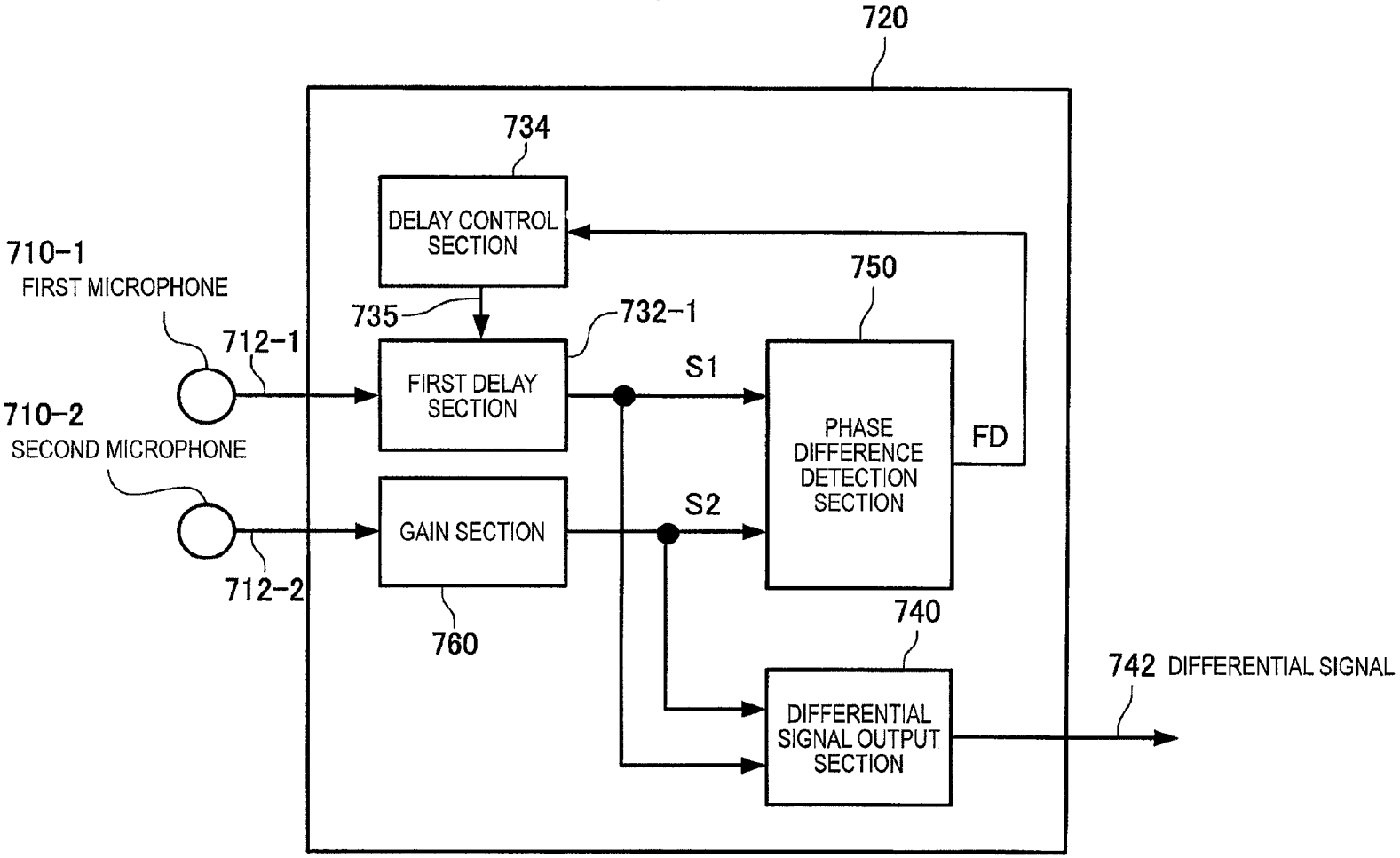
FIG. 17 is a diagram illustrating an example of the configuration of a voice input device.

FIG. 17 is a diagram illustrating an example of the configuration of the voice input device according to the third embodiment.

The differential signal generation section 720 may include a phase difference detection section 750. The phase difference detection section 750 receives a first voltage signal (S1) and a second voltage signal (S2) which are input to the differential signal output section 740, detects the difference in phase between the first voltage signal (S1) and the second voltage signal (S2) when the differential signal 742 is generated based on the first voltage signal (S1) and the second voltage signal (S2) which have been received, generates a phase difference signal (FD) based on the detection result, and outputs the phase difference signal (FD).

The delay control section 734 may change the delay amount of the delay section (the first delay section 732-1 in this example) based on the phase difference signal (FD).

The differential signal generation section 720 may also include a gain section 760. The gain section 760 applies a predetermined gain to at least one of the first voltage signal obtained by the first microphone 710-1 and the second voltage signal obtained by the second microphone 710-2 and outputs the resulting signal.

The differential signal output section 740 may receive the signal (S2) obtained by applying a gain to at least one of the first voltage signal obtained by the first microphone 710-1 and the second voltage signal obtained by the second microphone 710-2 using the gain section 760, generate a differential signal that represents the difference between the first voltage signal (S1) and the second voltage signal (S2), and output the differential signal.

For example, the phase difference detection section 740 may calculate the phase difference between the output S1 from the delay section (the first delay section 732-1 in this example) and the output S2 from the gain section and output the phase difference signal FD, and the delay control section 734 may dynamically change the delay amount of the delay section (the first delay section 732-1 in this example) in accordance with the polarity of the phase difference signal FD.

The first delay section 732-1 receives the first voltage signal 712-1 obtained by the first microphone 710-1, delays the first voltage signal 712-1 by a predetermined amount based on a delay control signal 735 (for example, a predetermined current), and outputs the resulting voltage signal S1. The gain section 760 receives the second voltage signal 712-2 obtained by the second microphone 710-2, applies a predetermined gain to the second voltage signal 712-2, and outputs the resulting voltage signal S2. The phase difference signal output section 754 receives the voltage signal S1 output from the first delay section 732-1 and the voltage signal S2 output from the gain section 760 and outputs the phase difference signal FD. The delay control section 734 receives the phase difference signal FD output from the phase difference signal output section 754 and outputs the delay control signal 735 (for example, a predetermined current). The delay amount of the first delay section 732-1 may be feedback-controlled by controlling the delay amount of the first delay section 732-1 based on the delay control signal 735 (for example, a predetermined current).

Figure 18:
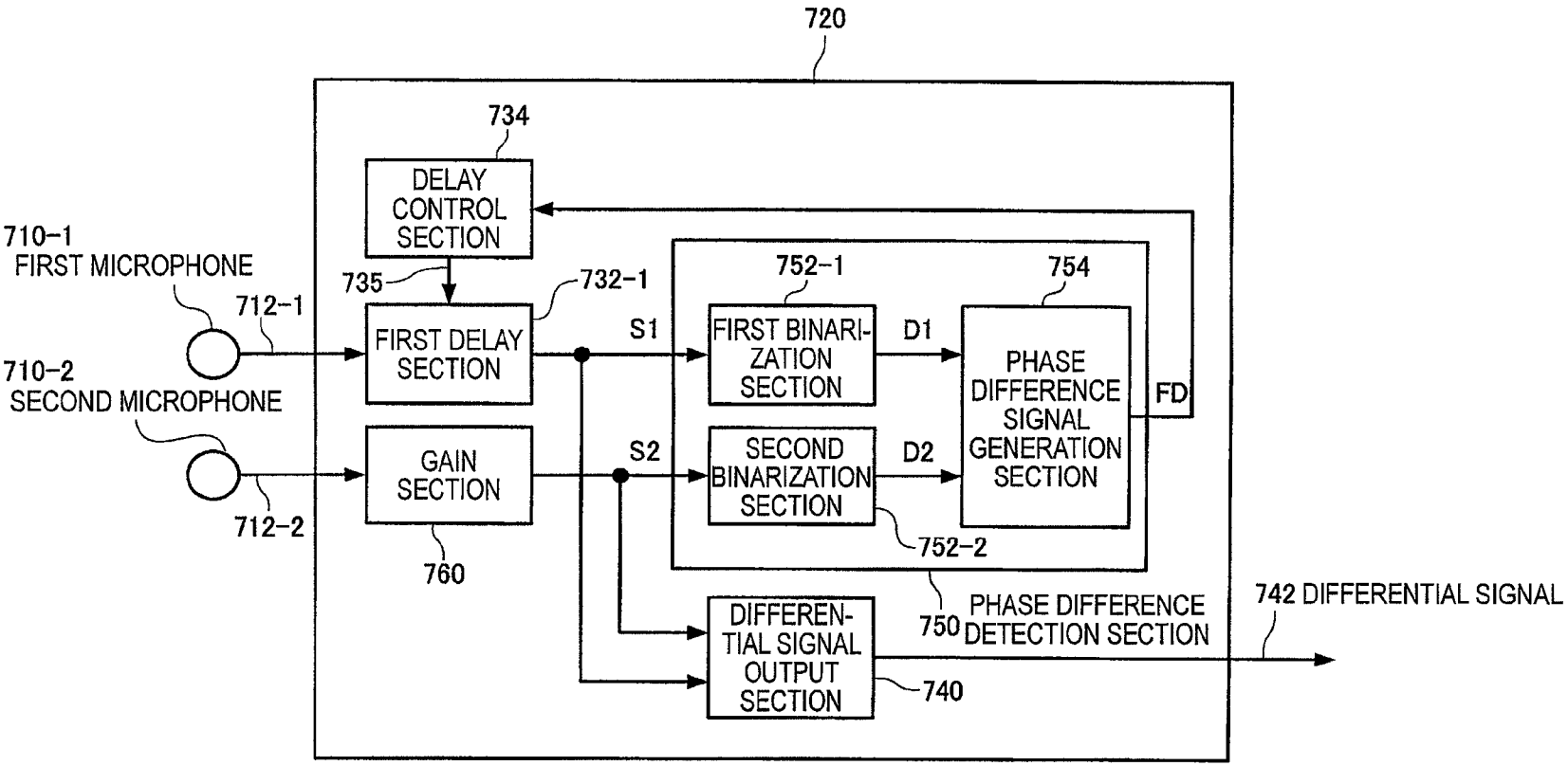
FIG. 18 is a diagram illustrating an example of the configuration of a voice input device.

FIG. 18 is a diagram illustrating an example of the configuration of the voice input device according to the third embodiment.

The phase difference detection section 720 may include a first binarization section 752-1. The first binarization section 752-1 binarizes the received first voltage signal S1 at a predetermined level to convert the first voltage signal S1 into a first digital signal D1.

The phase difference detection section 720 may also include a second binarization section 752-2. The second binarization section 752-2 binarizes the received second voltage signal S2 at a predetermined level to convert the second voltage signal S2 into a second digital signal D2.

The phase difference detection section 720 includes the phase difference signal output section 754. The phase difference signal output section 754 calculates a phase difference between the first digital signal D1 and the second digital signal D2 and outputs the phase difference signal FD.

The first delay section 732-1 receives the first voltage signal 712-1 obtained by the first microphone 710-1, delays the first voltage signal 712-1 by a predetermined amount based on the delay control signal 735 (for example, a predetermined current), and outputs the resulting signal S1. The gain section 760 receives the second voltage signal 712-2 obtained by the second microphone 710-2, applies a predetermined gain to the second voltage signal 712-2, and outputs the resulting signal S2. The first binarization section 752-1 receives the first voltage signal S1 output from the first delay section 732-1, and outputs the first digital signal D1 that has been binarized at a predetermined level. The second binarization section 752-2 receives the second voltage signal S2 output from the gain section 760, and outputs the second digital signal D2 that has been binarized at a predetermined level. The phase difference signal output section 754 receives the first digital signal D1 output from the first binarization section 752-1 and the second digital signal D2 output from the second binarization section 752-2, and outputs the phase difference signal FD. The delay control section 734 receives the phase difference signal FD output from the phase difference signal output section 754, and outputs the delay control signal 735 (for example, a predetermined current). The delay amount of the first delay section 732-1 may be feedback-controlled by controlling the delay amount of the first delay section 732-1 based on the delay control signal 735 (for example, a predetermined current).

Figure 19:
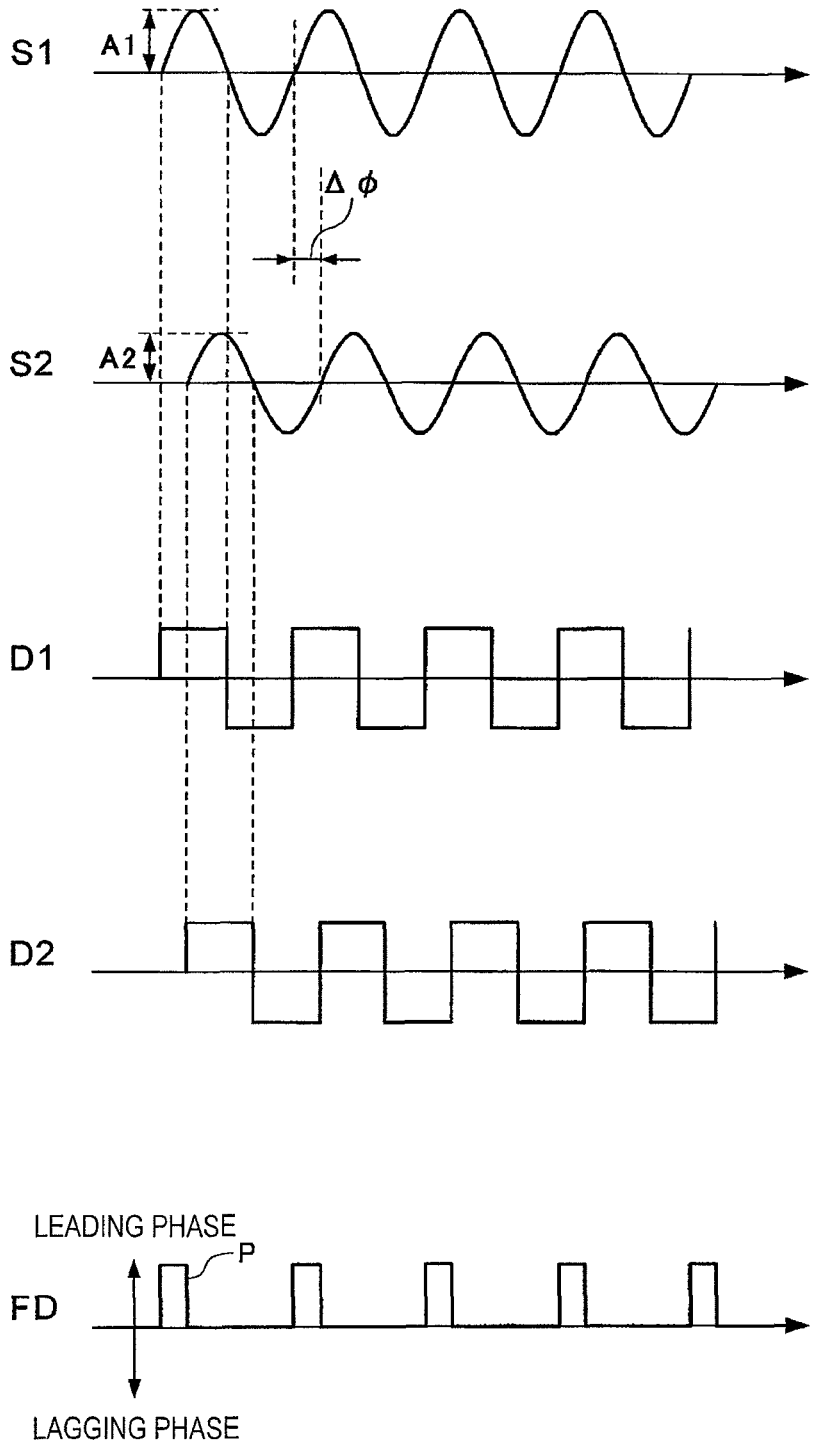
FIG. 19 is a timing chart of a phase difference detection section.

FIG. 19 is a timing chart of the phase difference detection section. Reference numeral S1 represents the voltage signal output from the first delay section 732-1, and reference numeral S2 represents the voltage signal output from the gain section. The phase of the voltage signal S2 is delayed by $\Delta\phi$ as compared with the phase of the voltage signal S1.

Reference numeral D1 represents the binarized signal of the voltage signal S1, and reference numeral D2 represents the binarized signal of the voltage signal S2. For example, the signal D1 or D2 is obtained by causing the voltage signal S1 or S2 to pass through a high-pass filter and binarizing the resulting signal using a comparator circuit.

Reference numeral FD represents the phase difference signal generated based on the binarized signal D1 and the binarized signal D2. For example, as illustrated in FIG. 19, when the phase of the first voltage signal leads the phase of the second voltage signal, a positive pulse P having a pulse width corresponding to the leading phase difference may be generated in each cycle. When the phase of the first voltage signal lags behind the phase of the second voltage signal, a negative pulse having a pulse width corresponding to the lagging phase difference may be generated in each cycle.

Figure 21:
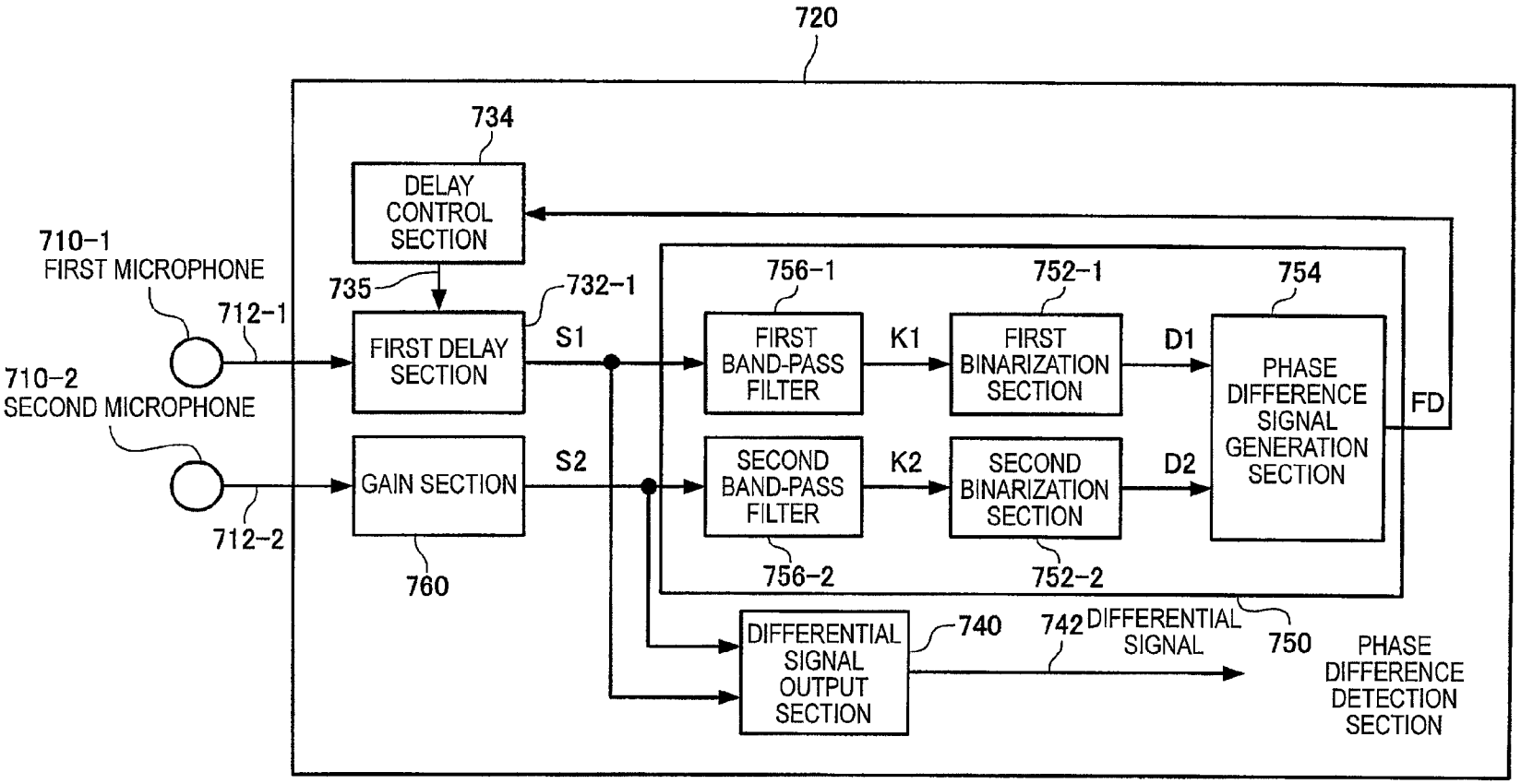
FIG. 21 is a diagram illustrating an example of the configuration of a voice input device.

FIG. 21 is a diagram illustrating an example of the configuration of the voice input device according to the third embodiment.

The phase difference detection section 750 includes a first band-pass filter 756-1. The first band-pass filter 756-1 is a band-pass filter that receives the first voltage signal S1 and allows a signal K1 having a predetermined single frequency to pass therethrough.

The phase difference detection section 750 also includes a second band-pass filter 756-2. The second band-pass filter 756-2 is a band-pass filter that receives the second voltage signal S2 and allows a signal K2 having a predetermined single frequency to pass therethrough.

The phase difference detection section 750 may detect the phase difference based on the first voltage signal K1 and the second voltage signal K2 that have passed through the first band-pass filter 756-1 and the second band-pass filter 756-2.

Figure 20:
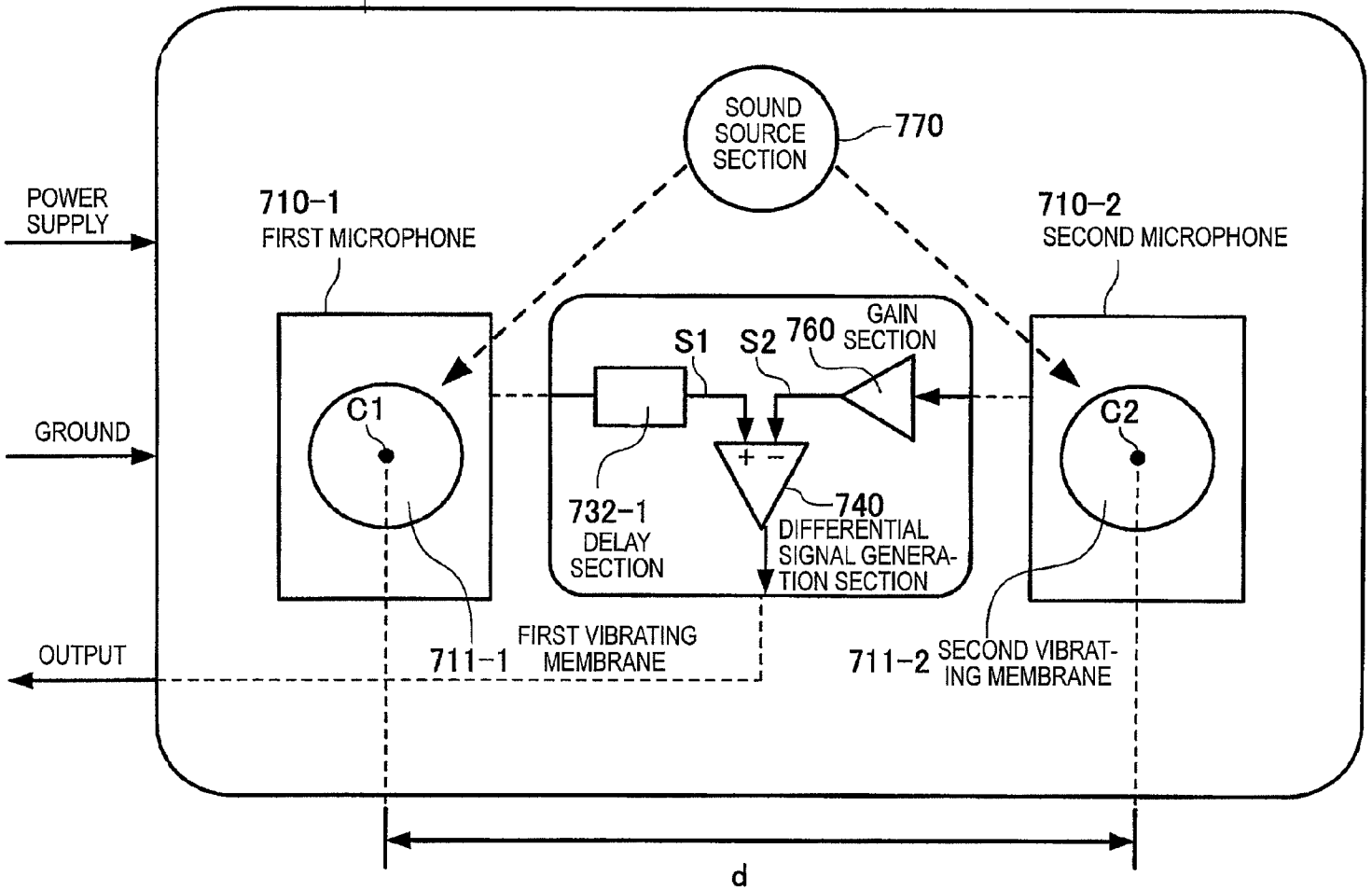
FIG. 20 is a diagram illustrating an example of the configuration of a voice input device.

For example, as illustrated in FIG. 20, a sound source section 770 is disposed at an equal distance from the first microphone 710-1 and the second microphone 710-2. The first microphone 710-1 and the second microphone 710-2 receive sound having a single frequency that is generated by the sound source section 770. The sound having a frequency other than the single frequency is cut off by the first band-pass filter 756-1 and the second band-pass filter 756-2, and the phase difference is then detected. In this way, the SN ratio of the phase comparison signal can be improved, and the phase difference or the delay amount can be detected with high accuracy.

When the voice input device itself does not include the sound source section 770, a test sound source may be temporarily provided near the voice input device during a test and may be set so that sound is input to the first and second microphones with the same phase. The first and second microphones may receive the sound, and the waveforms of the output first and second voltage signals may be monitored. The delay amount of the delay section may be changed so that the phase of the first voltage signal is identical to the phase of the second voltage signal.

The first delay section 732-1 receives the first voltage signal 712-1 obtained by the first microphone 710-1, delays the first voltage signal 712-1 by a predetermined amount based on the delay control signal 735 (for example, a predetermined current), and outputs the resulting signal S1. The gain section 760 receives the second voltage signal 712-2 obtained by the second microphone 710-2, applies a predetermined gain to the second voltage signal 712-2, and outputs the resulting signal S2. The first band-pass filter 756-1 receives the first voltage signal S1 output from the first delay section 732-1 and outputs the signal K1 having a single frequency. The second band-pass filter 756-2 receives the second voltage signal S2 output from the gain section 760 and outputs the signal K2 having a single frequency. The first binarization section 752-1 receives the signal K1 having a single frequency output from the first band-pass filter 756-1 and outputs the first digital signal D1 that has been binarized at a predetermined level. The second binarization section 752-2 receives the signal K2 having a single frequency output from the second band-pass filter 756-2 and outputs the second digital signal D2 that has been binarized at a predetermined level. The phase difference signal output section 754 receives the first digital signal D1 output from the first binarization section 752-1 and the second digital signal D2 output from the second binarization section 752-2 and outputs the phase difference signal FD. The delay control section 734 receives the phase difference signal FD output from the phase difference signal output section 754 and outputs the delay control signal 735 (for example, a predetermined current). The delay amount of the first delay section 732-1 may be feedback-controlled by controlling the delay amount of the first delay section 732-1 based on the delay control signal 735 (for example, a predetermined current).

Figure 22A:
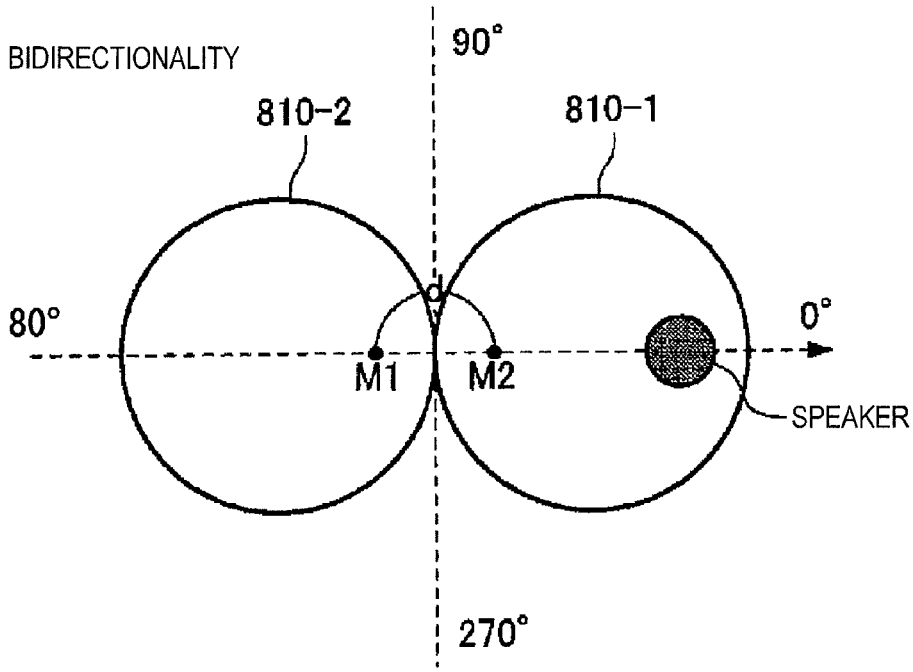
FIG. 22A is a diagram for describing the directivity of a differential microphone.
Figure 22B:
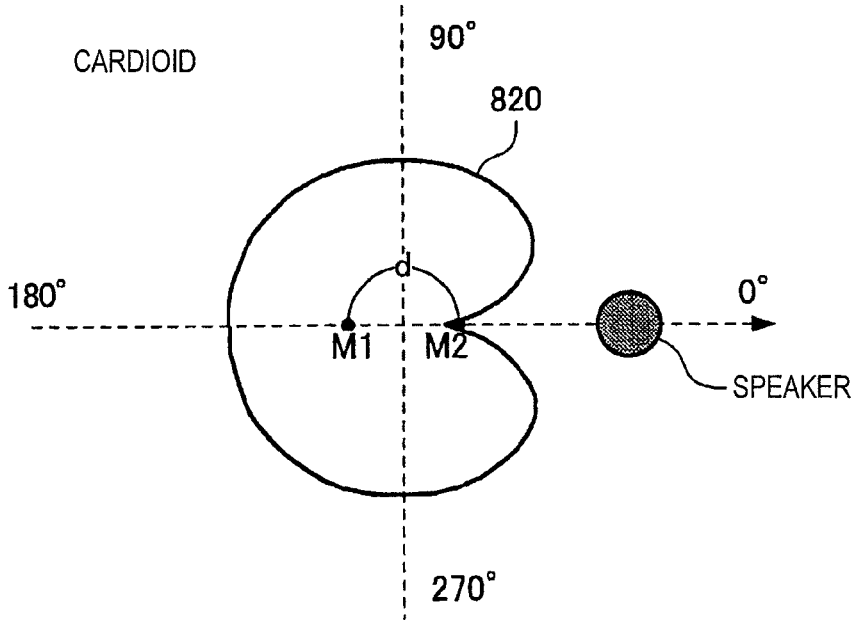
FIG. 22B is a diagram for describing the directivity of a differential microphone.

FIGS. 22A and 22B are diagrams for describing the directivity of a differential microphone.

FIG. 22A illustrates the directional pattern in a state where the phases of two microphones M1 and M2 coincide with each other. Circular areas 810-1 and 810-2 represent the directional pattern obtained by the difference in output between the two microphones M1 and M2. When the direction of a straight line that connects the two microphones M1 and M2 represents a 0°-180° direction, and the direction that perpendicularly intersects the straight line that connects the microphones M1 and M2 represents a 90°-270° direction, the directional pattern corresponds to bidirectionality in which the differential microphone has the maximum sensitivity in the directions of 0° and 180° and does not have sensitivity in the directions of 90° and 270°.

When one of the signals obtained by the two microphones M1 and M2 is delayed, the directional pattern changes. For example, when the output from the microphone M1 is delayed by an amount corresponding to a time obtained by dividing an intermicrophone distance d by a speed of sound c, the area representing the directivity of the microphones M1 and M2 has a cardioid shape as denoted by 820 in FIG. 22B. In this case, a directional pattern in which the differential microphone has no sensitivity (null) to a speaker positioned at 0° can be implemented. Thus, only surrounding sound (surrounding noise) can be acquired by selectively cutting off the speaker's voice.

The surrounding noise level can be detected by using the above-mentioned characteristics.

Figure 23:
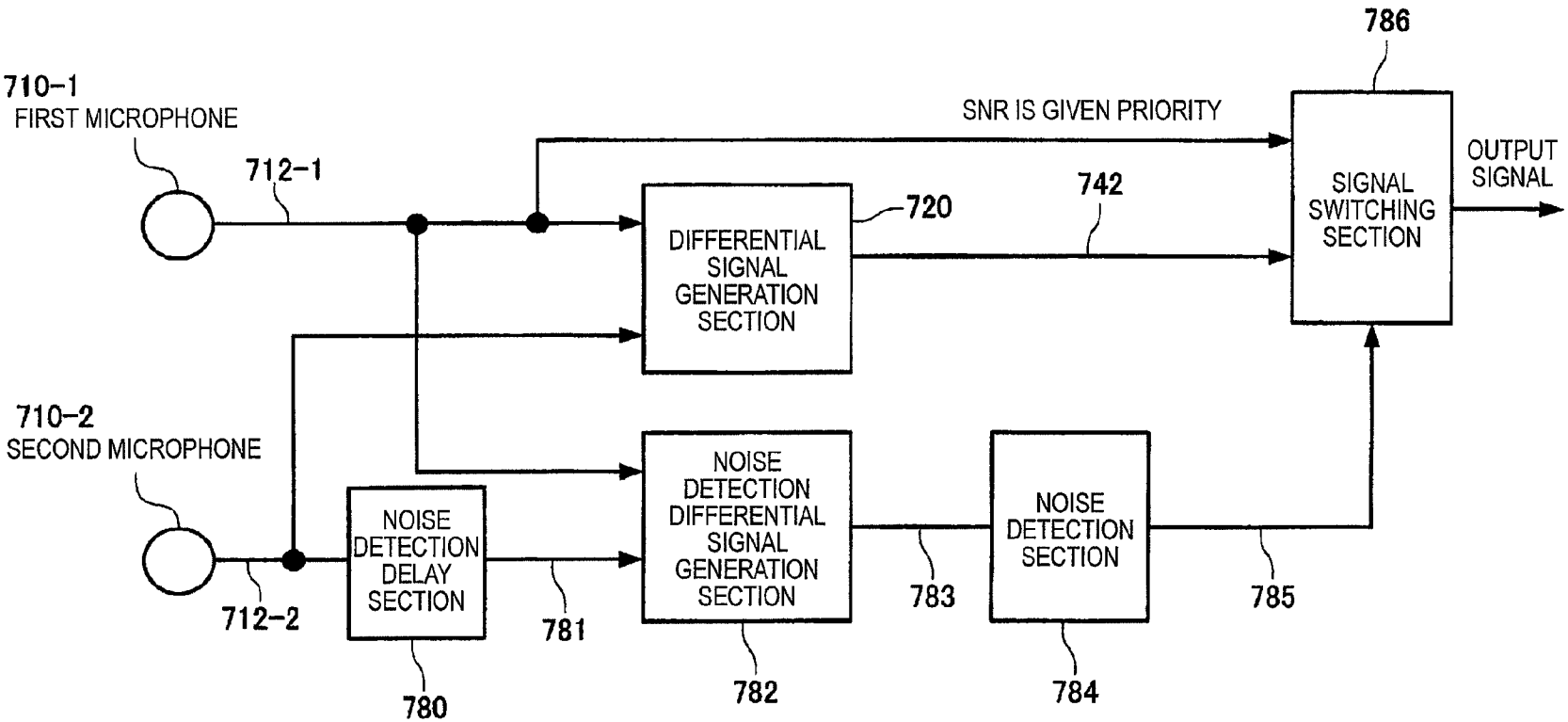
FIG. 23 is a diagram illustrating an example of the configuration of a voice input device that includes a noise detection means.

FIG. 23 is a diagram illustrating an example of the configuration of a voice input device that includes a noise detection means.

The voice input device according to this embodiment includes a noise detection delay section 780. The noise detection delay section 780 delays the second voltage signal 712-2 obtained by the second microphone 710-2 by a noise detection delay amount and outputs a resulting signal.

The voice input device according to this embodiment includes a noise detection differential signal generation section 782. The noise detection differential signal generation section 782 generates a noise detection differential signal 783 that represents the difference between a signal 781 that has been delayed by the noise detection delay section 780 by a predetermined noise detection delay amount and the first voltage signal 712-1 obtained by the first microphone 710-1.

The voice input device according to this embodiment includes a noise detection section 784. The noise detection section 784 determines the noise level based on the noise detection differential signal 783 and outputs a noise detection signal 785 based on the determination result. The noise detection section 784 may calculate the average level of the noise detection differential signal and generate the noise detection differential signal 785 based on the average level.

The voice input device according to this embodiment includes a signal switching section 786. The signal switching section 786 receives the differential signal 742 output from the differential signal generation section 720 and the first voltage signal 712-1 obtained by the first microphone and selectively outputs the first voltage signal 712-1 or the differential signal 742 based on the noise detection signal 785. The signal switching section 786 may output the first voltage signal obtained by the first microphone when the noise level is equal to or lower than a predetermined level and may output the differential signal when the average level is higher than a predetermined level. By doing so, sound acquired by a single microphone having a good SNR (signal-to-noise ratio: SN ratio) is output in a quiet environment (i.e., the noise level is equal to or lower than a predetermined level). On the other hand, sound acquired by a differential microphone having an excellent noise removal performance is output in a noisy environment (i.e., the noise level is equal to or higher than a predetermined level).

The differential signal generation section may have the configuration described with reference to FIGS. 13, 14, 17, 18, and 21, or may have the configuration of a known normal differential microphone. Moreover, the first vibrating membrane of the first microphone 710-1 and the second vibrating membrane of the second microphone 710-1 may, or may not, be disposed so that the noise intensity ratio that represents the ratio of the intensity of a noise component contained in the differential signal 742 to the intensity of the noise component contained in the first voltage signal or the second voltage signal is smaller than the input voice intensity ratio that represents the ratio of the intensity of an input voice component contained in the differential signal to the intensity of the input voice component contained in the first voltage signal or the second voltage signal.

Moreover, the noise detection delay amount may not be a time obtained by dividing the center-to-center distance (see "d" in FIG. 20) between the first and second vibrating plates by the speed of sound. Even when the speaker is not positioned in the 0° direction, characteristics that are suitable for noise detection and have a directivity that collects surrounding noise while cutting off the speaker's voice can be implemented by setting the null (no sensitivity) direction of the directional pattern in the direction of the speaker. For example, the delay amount may be set so that a hyper-cardioid or super-cardioid directional pattern is implemented to cut off the speaker's voice.

The differential signal generation section 720 receives the first voltage signal 712-1 obtained by the first microphone 710-1 and the second voltage signal 712-2 obtained by the second microphone 710-2 and generates and outputs the differential signal 742.

The noise detection delay section 780 receives the second voltage signal 712-2 obtained by the second microphone 710-2, delays the second voltage signal 712-2 by a noise detection delay amount, and outputs the resulting signal 781. The noise detection differential signal generation section 782 generates and outputs the noise detection differential signal 783 that represents the difference between a signal 781 that has been delayed by the noise detection delay section 780 by a predetermined noise detection delay amount and the first voltage signal 712-1 obtained by the first microphone 710-1. The noise detection section 784 receives the noise detection differential signal 783, determines the noise level based on the noise detection differential signal 783, and outputs the noise detection signal 785 based on the determination result.

The signal switching section 786 receives the differential signal 742 output from the differential signal generation section 720, the first voltage signal 712-1 obtained by the first microphone, and the noise detection signal 785 and selectively outputs the first voltage signal 712-1 or the differential signal 742 based on the noise detection signal 785.

Figure 24:
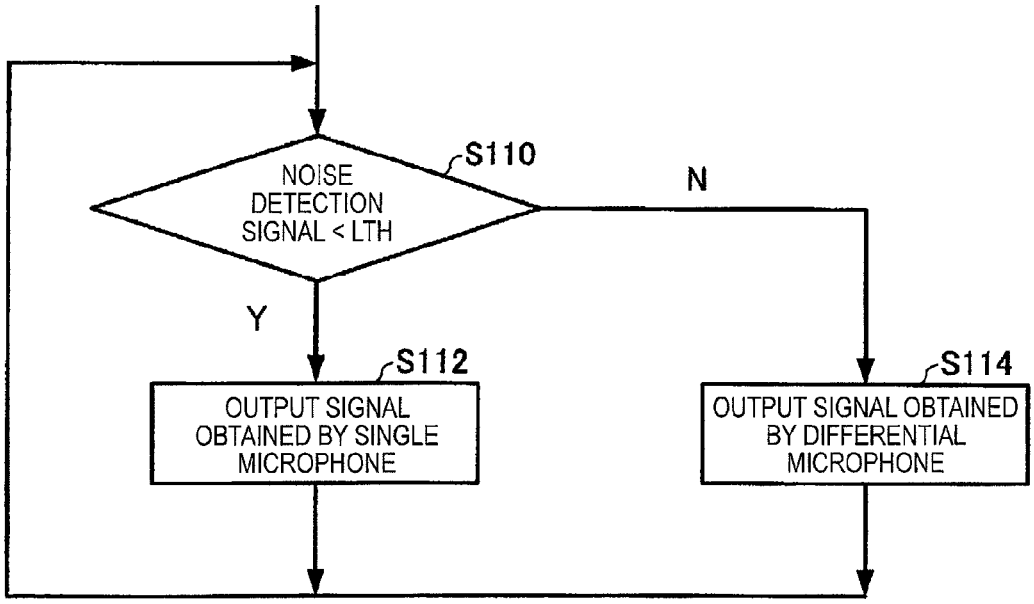
FIG. 24 is a flowchart illustrating an example of a signal switching operation based on noise detection.

FIG. 24 is a flowchart illustrating an example of a signal switching operation based on noise detection.

When the noise detection signal output from the noise detection section is smaller than a predetermined threshold value (LTH) (step S110), the signal switching section outputs the signal obtained by the single microphone (step S112). When the noise detection signal output from the noise detection section is not smaller than the predetermined threshold value (LTH) (step S110), the signal switching section outputs the signal obtained by the differential microphone (step S114).

In a voice input device that includes a loudspeaker that outputs sound information, the voice input device may include a volume control section that controls the volume of the loudspeaker based on the noise detection signal.

Figure 25:
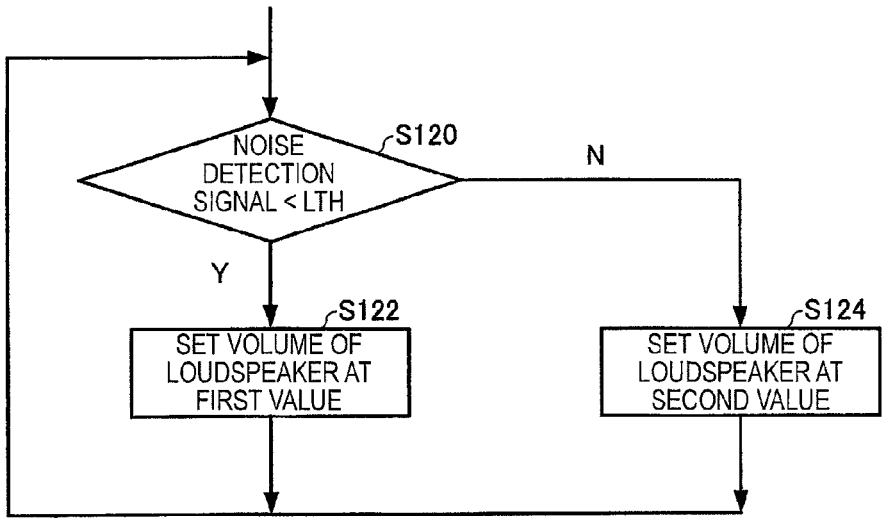
FIG. 25 is a flowchart illustrating an example of a loudspeaker volume control operation based on noise detection.

FIG. 25 is a flowchart illustrating an example of a loudspeaker volume control operation based on noise detection.

When the noise detection signal output from the noise detection section is smaller than the predetermined threshold value (LTH) (step S120), the volume of the loudspeaker is set at a first value (step S122). When the noise detection signal output from the noise detection section is not smaller than the predetermined threshold value (LTH) (step S120), the volume of the loudspeaker is set at a second value larger than the first value (step S124).

The volume of the loudspeaker may be decreased when the noise detection signal output from the noise detection section is smaller than the predetermined threshold value (LTH), and may be increased when the noise detection signal output from the noise detection section is not smaller than the predetermined threshold value (LTH).

Figure 26:
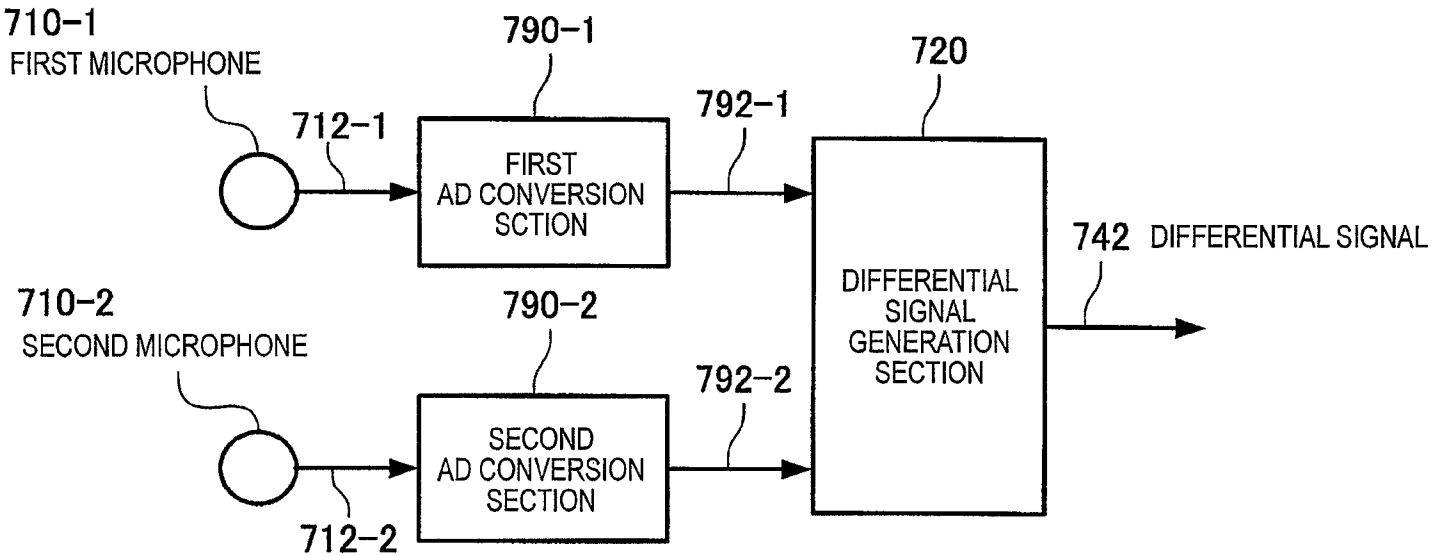
FIG. 26 is a diagram illustrating an example of the configuration of a voice input device that includes an AD conversion means.

FIG. 26 is a diagram illustrating an example of the configuration of a voice input device that includes an AD conversion means.

The voice input device according to this embodiment may include a first AD conversion means 790-1. The first AD conversion means 790-1 subjects the first voltage signal 712-1 obtained by the first microphone 710-1 to analog-to-digital conversion.

The voice input device according to this embodiment may include a second AD conversion means 790-2. The second AD conversion means 790-2 subjects the second voltage signal 712-2 obtained by the second microphone 710-2 to analog-to-digital conversion.

The voice input device according to this embodiment includes the differential signal generation section 720. The differential signal generation section 720 may generate the differential signal 742 that represents the difference between a first voltage signal 782-1 that has been converted into a digital signal by the first AD conversion means 790-1 and a second voltage signal 782-2 that has been converted into a digital signal by the second AD conversion means 790-2 based on the first voltage signal 782-1 and the second voltage signal 782-2.

Here, the differential signal generation section 720 may have the configuration described with reference to FIGS. 13, 14, 17, 18, and 21. The delay amount of the differential signal generation section 720 may be set to be an integer multiple of the analog-to-digital conversion cycle of the first AD conversion means 790-1 and the second AD conversion means 790-2. By doing so, the delay section can delay the input signal by digitally shifting the input signal by one or several clock pulses using a flip-flop.

The center-to-center distance between the first vibrating membrane of the first microphone 710-1 and the second vibrating membrane of the second microphone 710-2 may be set to be a value obtained by multiplying the analog-to-digital conversion cycle by the speed of sound or an integer multiple of that value.

By doing so, the noise detection delay section can accurately implement a directional pattern (for example, cardioid directional pattern) convenient for collecting surrounding noise by a simple operation of shifting the input voltage signal by n clock pulses (n is an integer).

For example, when the sampling frequency when performing analog-to-digital conversion is 44.1 kHz, the center-to-center distance between the first and second vibrating plates is about 7.7 mm. When the sampling frequency is 16 kHz, the center-to-center distance between the first and second vibrating plates is about 21 mm.

Figure 27:
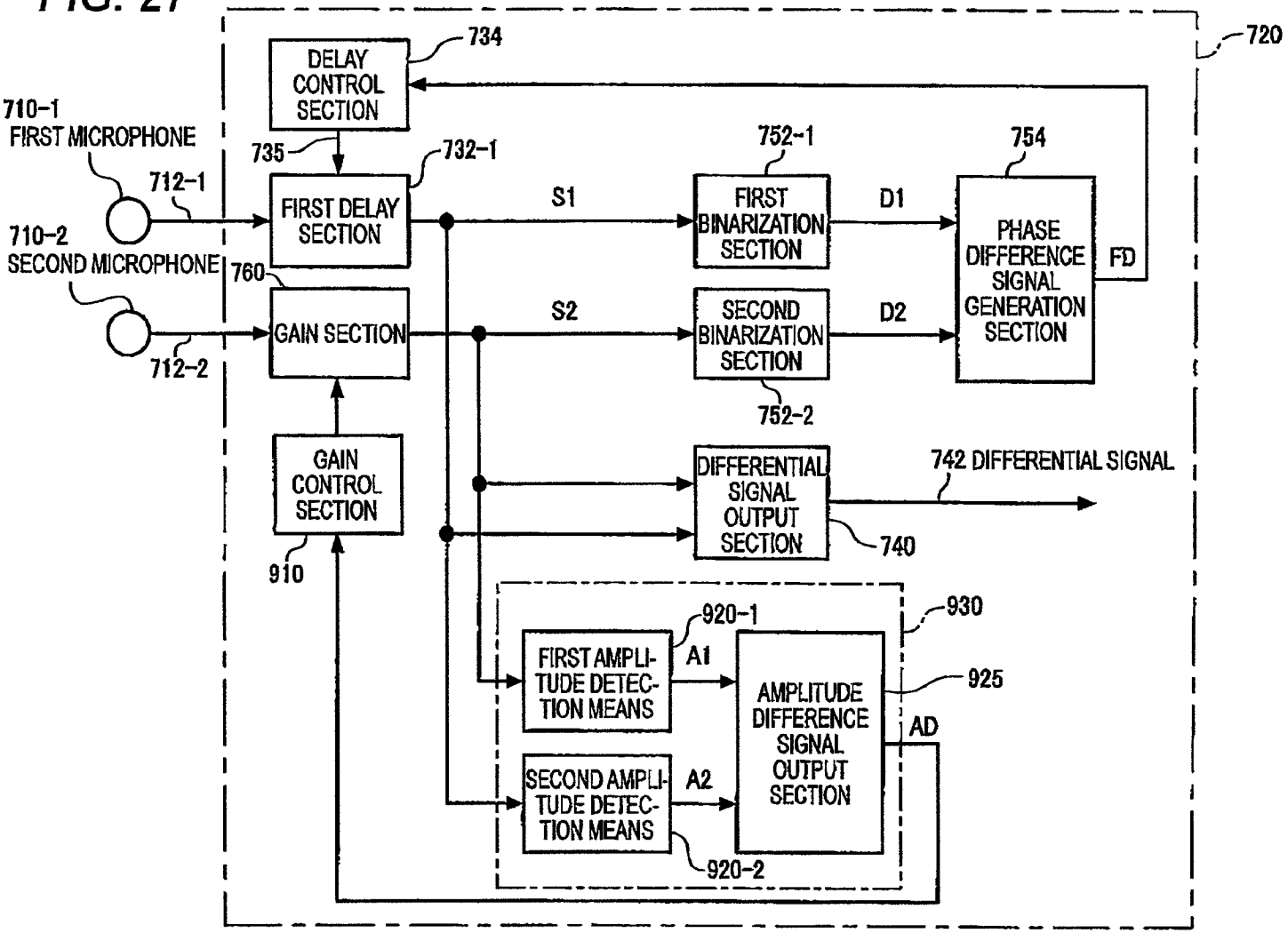
FIG. 27 is a diagram illustrating an example of the configuration of a voice input device that includes a gain adjustment means.

FIG. 27 is a diagram illustrating an example of the configuration of a voice input device that includes a gain adjustment means.

The differential signal generation section 720 of the voice input device according to this embodiment includes a gain control section 910. The gain control section 910 changes the amplification factor (gain) of the gain section 760. The balance between the amplitude of the first voltage signal 712-1 obtained by the first microphone 710-1 and the amplitude of the second voltage signal 712-2 obtained by the second microphone 710-2 may be adjusted by the gain control section 910 dynamically controlling the amplification factor of the gain section 760 based on an amplitude difference signal AD output from an amplitude difference detection section.

The differential signal generation section 720 includes an amplitude difference detection section 930. The amplitude difference detection section 930 includes a first amplitude detection means 920-1. The first amplitude detection means 920-1 detects the amplitude of the signal S1 output from the first delay section 732-1 and outputs a first amplitude signal A1.

The amplitude difference detection section 930 includes a second amplitude detection means 920-2. The second amplitude detection means 920-2 detects the amplitude of the signal S2 output from the gain section 760 and outputs a second amplitude signal A2.

The amplitude difference detection section 930 includes an amplitude difference signal output section 925. The amplitude difference signal output section 925 receives the first amplitude signal A1 output from the first amplitude detection means 920-1 and the second amplitude signal A2 output from the second amplitude detection means 920-2, calculates the difference in amplitude between the first and second amplitude signals, and outputs the amplitude difference signal AD. The gain of the gain section 760 may be feedback-controlled by controlling the gain of the gain section 760 based on the amplitude difference signal AD.

7. Configuration of Voice Input Device According to Fourth Embodiment

Figure 28:
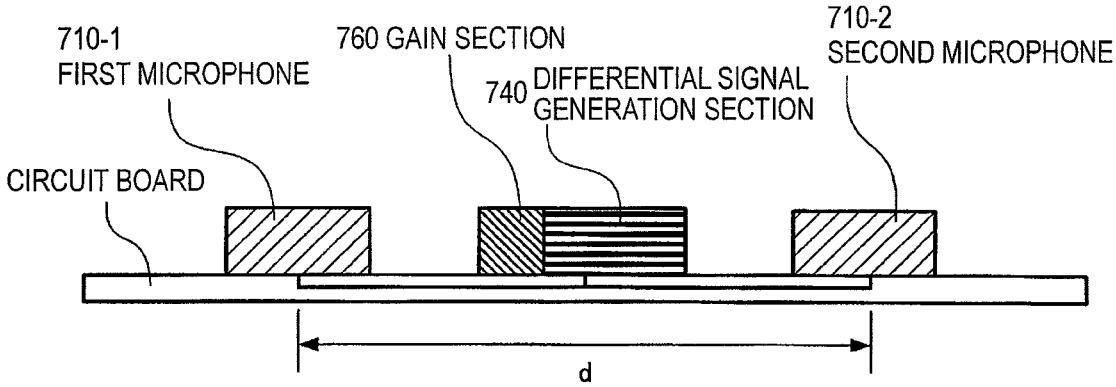
FIG. 28 is a diagram illustrating an example of the configuration of a voice input device.
Figure 29:
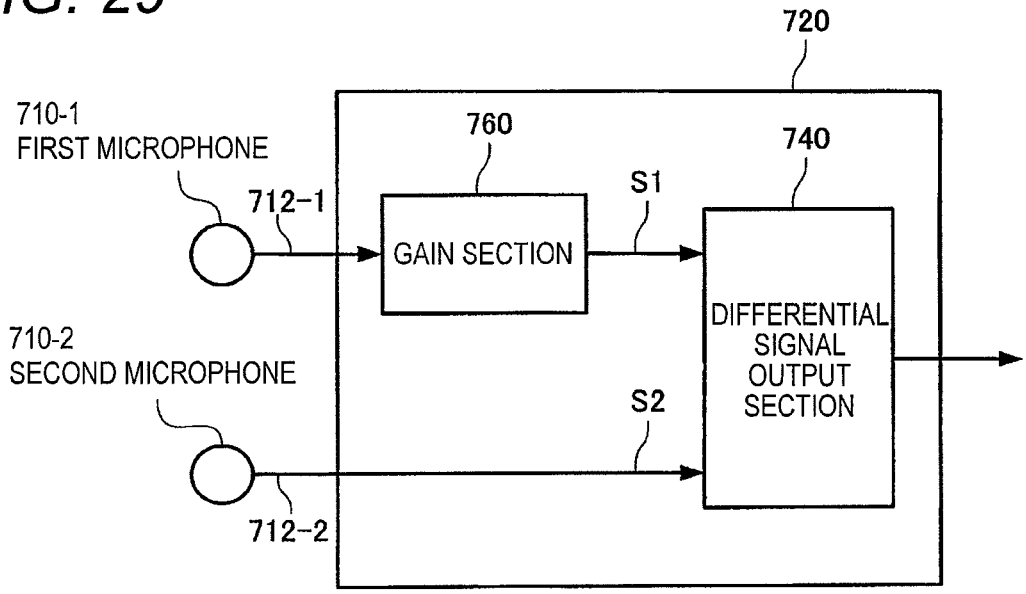
FIG. 29 is a diagram illustrating an example of the configuration of a voice input device.

FIGS. 28 and 29 are diagrams illustrating examples of the configuration of a voice input device according to a fourth embodiment.

A voice input device 700 according to the fourth embodiment includes a first microphone 710-1 that includes a first vibrating membrane. The voice input device 700 according to the fourth embodiment also includes the second microphone 710-2 that includes the second vibrating membrane.

The first vibrating membrane of the first microphone 710-1 and the first vibrating membrane of the second microphone 710-2 are disposed so that a noise intensity ratio that represents the ratio of the intensity of a noise component contained in a differential signal 742 to the intensity of the noise component contained in a first voltage signal 712-1 or a second voltage signal 712-2, is smaller than an input voice intensity ratio that represents the ratio of the intensity of an input voice component contained in the differential signal 742 to the intensity of the input voice component contained in the first voltage signal 712-1 or the second voltage signal 712-2.

Moreover, the first microphone 710-1 that includes the first vibrating membrane and the second microphone 710-2 that includes the second vibrating membrane may be configured as described with reference to FIGS. 1 to 8.

The voice input device 700 according to the fourth embodiment includes a differential signal generation section 720 that generates the differential signal 742 that represents the difference between the first voltage signal 712-1 obtained by the first microphone 710-1 and the second voltage signal 712-2 obtained by the second microphone 710-2 based on the first voltage signal 712-1 and the second voltage signal 712-2.

The differential signal generation section 720 also includes a gain section 760. The gain section 760 amplifies the first voltage signal 712-1 obtained by the first microphone 710-1 by a predetermined gain and outputs the resulting signal.

The differential signal generation section 720 also includes a differential signal output section 740. The differential signal output section 740 receives a first voltage signal S1 amplified by the gain section 760 by a predetermined gain and the second voltage signal obtained by the second microphone, generates a differential signal that represents the difference between the first voltage signal S1 amplified by a predetermined gain and the second voltage signal, and outputs the differential signal.

By amplifying the first voltage signal 712-1 by a predetermined gain (i.e., increasing or decreasing the gain thereof), the first and second voltage signals can be corrected so that the difference in amplitude between the first and second voltage signals is removed. Therefore, it is possible to prevent deterioration in the noise suppression effect of the differential microphone due to the difference in sensitivity between the two microphones caused by a manufacturing variation or the like.

Figure 30:
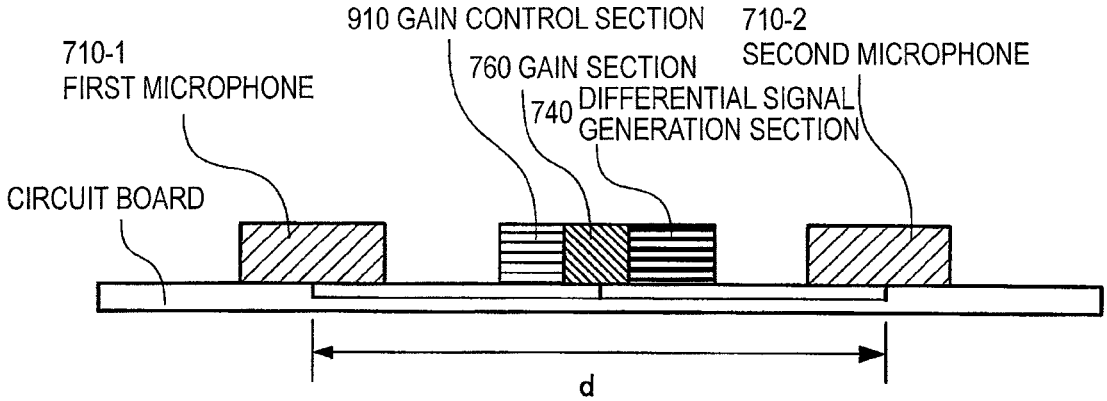
FIG. 30 is a diagram illustrating an example of the configuration of a voice input device.
Figure 31:
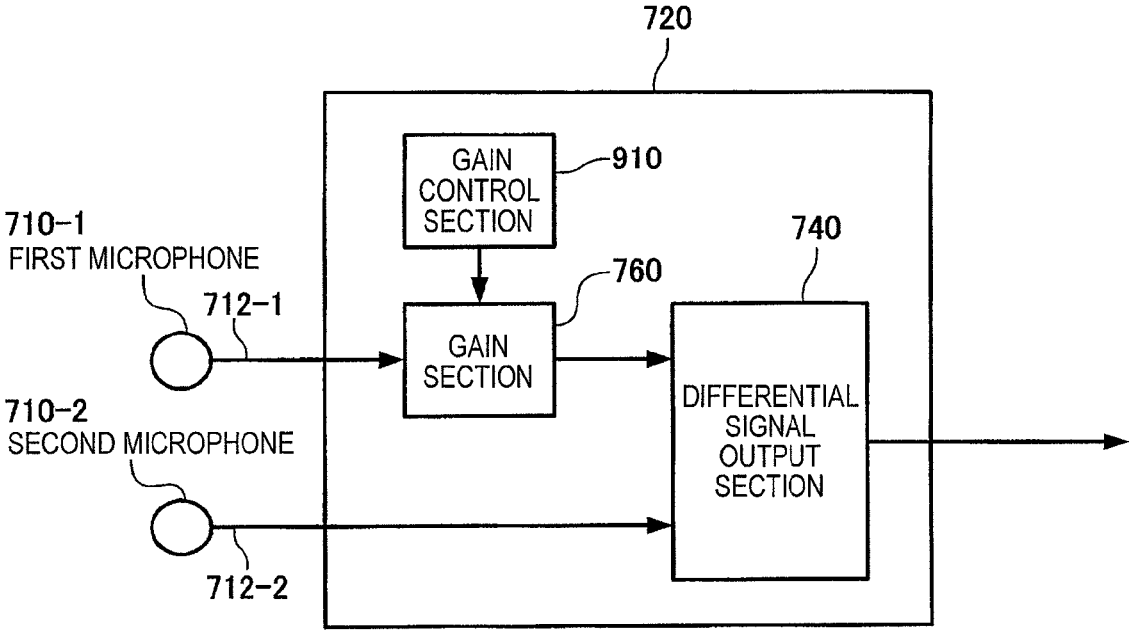
FIG. 31 is a diagram illustrating an example of the configuration of a voice input device.

FIGS. 30 and 31 are diagrams illustrating examples of the configuration of the voice input device according to the fourth embodiment.

The differential signal generation section 720 according to this embodiment may include a gain control section 910. The gain control section 910 changes the gain of the gain section 760. The balance between the amplitude of the output S1 from the gain section and the amplitude of the second voltage signal 712-2 obtained by the second microphone may be adjusted by the gain control section 910 dynamically or statically controlling the gain of the gain section 760.

FIG. 32 is a diagram illustrating an example of the specific configuration of the gain section and the gain control section. For example, when processing an analog signal, the gain section 760 may be formed by an analog circuit such as an operational amplifier (for example, a non-inverting amplifier circuit as shown in FIG. 32). The amplification factor of the operational amplifier may be controlled by dynamically or statically controlling the voltage applied to the minus (−) terminal of the operational amplifier by changing the resistances of resistors R1 and R2 or trimming the resistors R1 and R2 to a predetermined value during manufacturing.

Figure 33A:
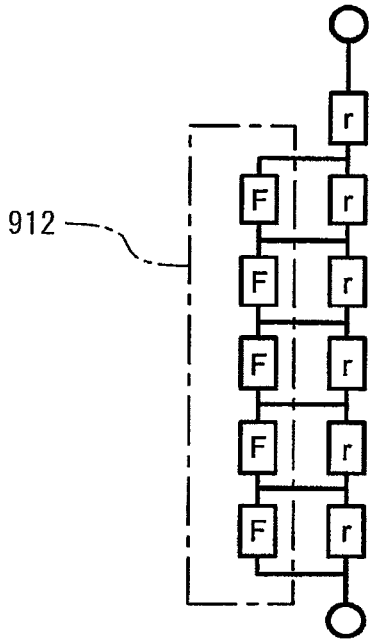
FIG. 33A is a diagram illustrating an example of a configuration that statically controls the amplification factor of a gain section.
Figure 33B:
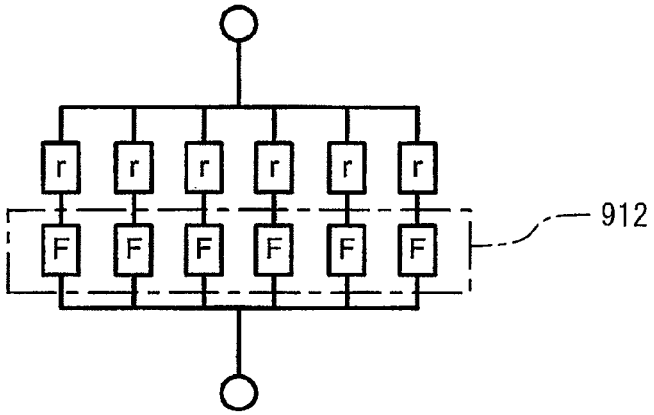
FIG. 33B is a diagram illustrating an example of a configuration that statically controls the amplification factor of a gain section.

FIGS. 33A and 33B illustrate an example of a configuration that statically controls the amplification factor of the gain section.

For example, as illustrated in FIG. 33A, the resistor R1 or R2 in FIG. 32 may include a resistor array in which a plurality of resistors is connected in series, and a predetermined voltage may be applied to a predetermined terminal (the minus (−) terminal in FIG. 32) of the gain section through the resistor array. An appropriate amplification factor may be calculated, and the resistors (r) or conductors (F denoted by reference numeral 912) that form the resistor array may be cut using a laser or fused by applying a high voltage or a high current during the manufacturing process so that the resistors have a resistance that implements the appropriate amplification factor.

Moreover, for example, as illustrated in FIG. 33B, the resistor R1 or R2 in FIG. 32 may include a resistor array in which a plurality of resistors is connected in parallel, and a predetermined voltage may be applied to a predetermined terminal (the minus (−) terminal in FIG. 32) of the gain section through the resistor array. An appropriate amplification factor may be calculated, and the resistors (r) or conductors (F denoted by reference numeral 912) that form the resistor array may be cut using a laser or fused by applying a high voltage or a high current during the manufacturing process so that the resistors have a resistance that implements the appropriate amplification factor.

Here, the appropriate amplification factor may be set at a value that cancels the gain balance of the microphone that has occurred during the manufacturing process. A resistance corresponding to the gain balance of the microphone that has occurred during the manufacturing process can be achieved by using the resistor array in which a plurality of resistors is connected in series or parallel as shown in FIGS. 33A and 33B. Thus, the resistor array functions as the gain control section that is connected to the predetermined terminal so as to control the gain of the gain section.

Although this embodiment has been described by way of an example in which a plurality of resistors (r) is connected through fuses (F), the invention is not limited to this. A plurality of resistors (r) may be connected in series or parallel without using the fuses (F). In this case, at least one resistor may be cut.

Moreover, for example, the resistor R1 or R2 in FIG. 32 may be formed by a single resistor as shown in FIG. 40, and the resistance of the resistor may be adjusted by so-called laser trimming which involves cutting a part of the resistor.

Figure 34:
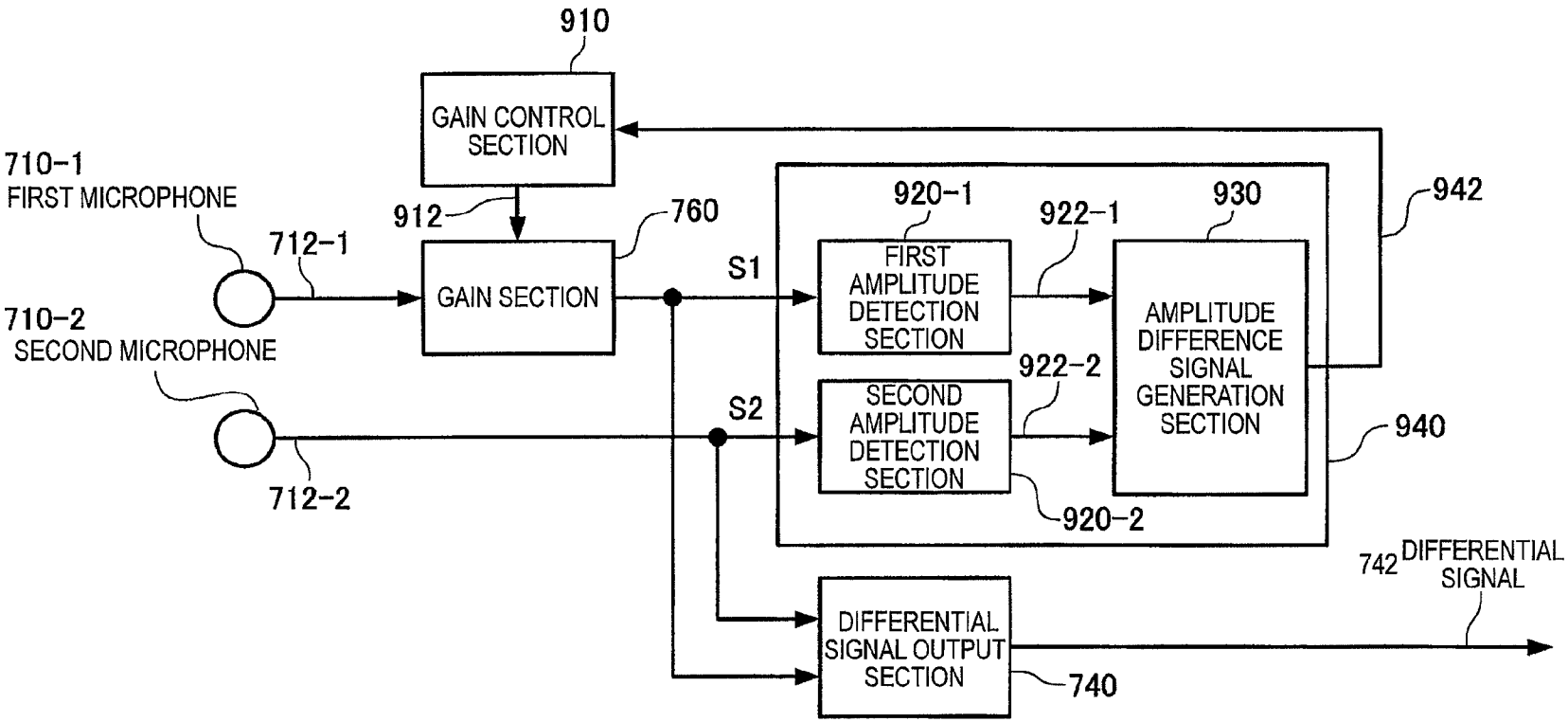
FIG. 34 is a diagram illustrating an example of the configuration of a voice input device.

FIG. 34 is a diagram illustrating an example of the configuration of the voice input device according to the fourth embodiment.

The differential signal generation section 720 may include an amplitude difference detection section 940. The amplitude difference detection section 940 receives a first voltage signal (S1) and a second voltage signal (S2) input to the differential signal output section 740, detects the difference in amplitude between the first voltage signal (S1) and the second voltage signal (S2) when the differential signal 742 is generated based on the first voltage signal (S1) and the second voltage signal (S2) which have been received, generates an amplitude difference signal 942 based on the detection result, and outputs the amplitude difference signal 942.

The gain control section 910 may change the gain of the gain section 760 based on the amplitude difference signal 942.

The amplitude difference detection section 940 may include a first amplitude detection section that detects the amplitude of the signal output from the gain section 760, a second amplitude detection section 922-1 that detects the signal amplitude of the second voltage signal obtained by the second microphone, and an amplitude difference signal generation section 930 that calculates the difference between a first amplitude signal 922-1 detected by the first amplitude detection section 922-2 and a second amplitude signal 922-1 detected by the second amplitude detection section 920-1, and generates the amplitude difference signal 942.

The first amplitude detection means 920-1 may receive the signal S1 output from the gain section 760, detect the amplitude of the signal S1, and output the first amplitude signal 922-1 based on the detection result. The second amplitude detection means 920-2 may receive the second voltage signal 912-2 obtained by the second microphone, detect the amplitude of the second voltage signal, and output the second amplitude signal 922-2 based on the detection result. The amplitude difference signal generation section 930 may receive the first amplitude signal 922-1 output from the first amplitude detection means 920-1 and the second amplitude signal 922-2 output from the second amplitude signal 922-2, calculate the difference between the first and second amplitude signals 922-1 and 922-2, and generate and output the amplitude difference signal 942.

The gain control section 910 receives the amplitude difference signal 942 output from the amplitude difference signal output section 930 and outputs the gain control signal (for example, a predetermined current) 912. The gain of the gain section 760 may be feedback-controlled by controlling the gain of the gain section 760 based on the gain control signal (for example, a predetermined current) 912.

According to this embodiment, the difference in amplitude that varies during use for various reasons can be detected in real time and adjusted.

The gain control section may adjust the gain so that the difference in amplitude between the signal S1 output from the gain section and the second voltage signal 712-2 (S2) obtained by the second microphone is within a predetermined percentage with respect to any one (S1 or S2) of the signals. Alternatively, the amplification factor of the gain section may be adjusted so that a predetermined noise suppression effect (for example, about 10 dB or more) is achieved.

For example, the amplification factor of the gain section may be adjusted so that the difference in amplitude between the signals S1 and S2 is within a range of −3% or more and +3% or less, or a range of −6% or more and +6% or less with respect to the signal S1 or S2. Noise can be reduced by about 10 dB in the former case, and noise can be reduced by about 6 dB in the latter case.

Figure 35:
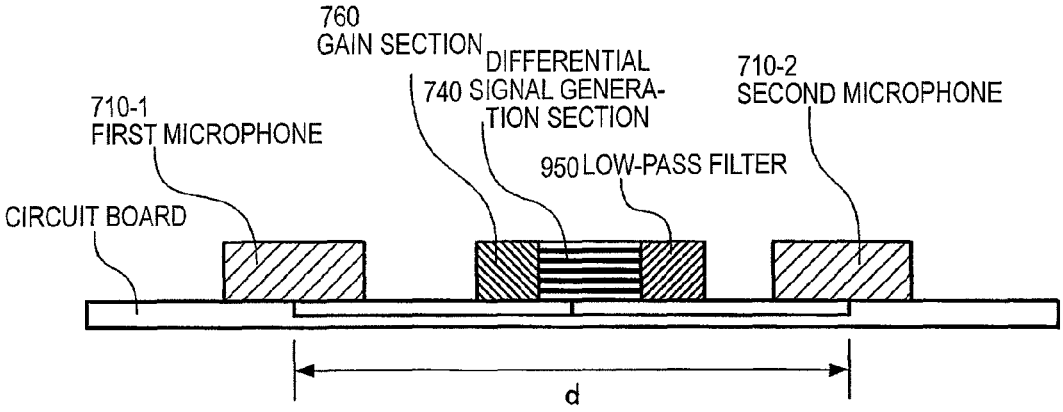
FIG. 35 is a diagram illustrating an example of the configuration of a voice input device.
Figure 36:
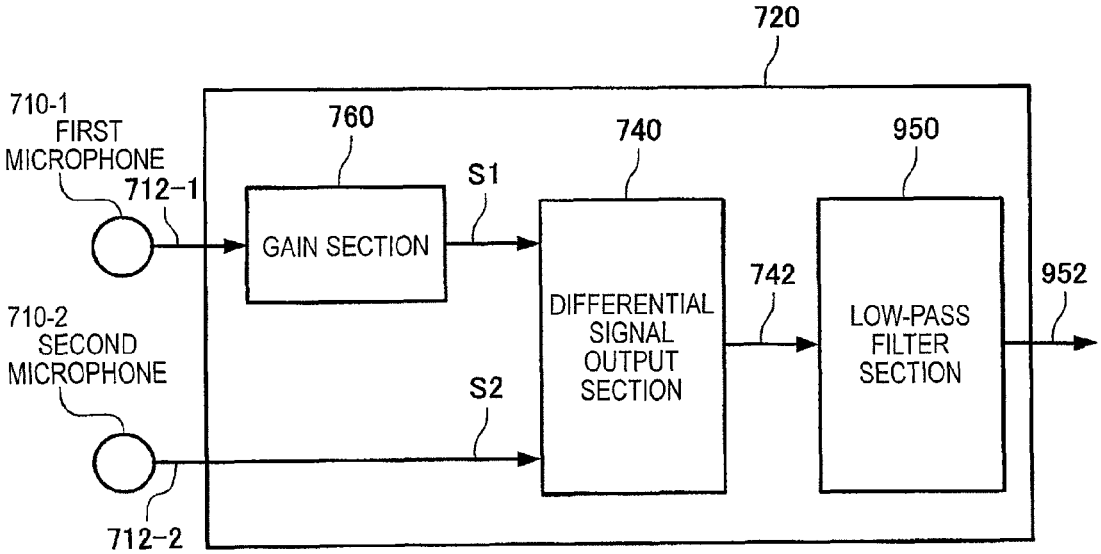
FIG. 36 is a diagram illustrating an example of the configuration of a voice input device.
Figure 37:
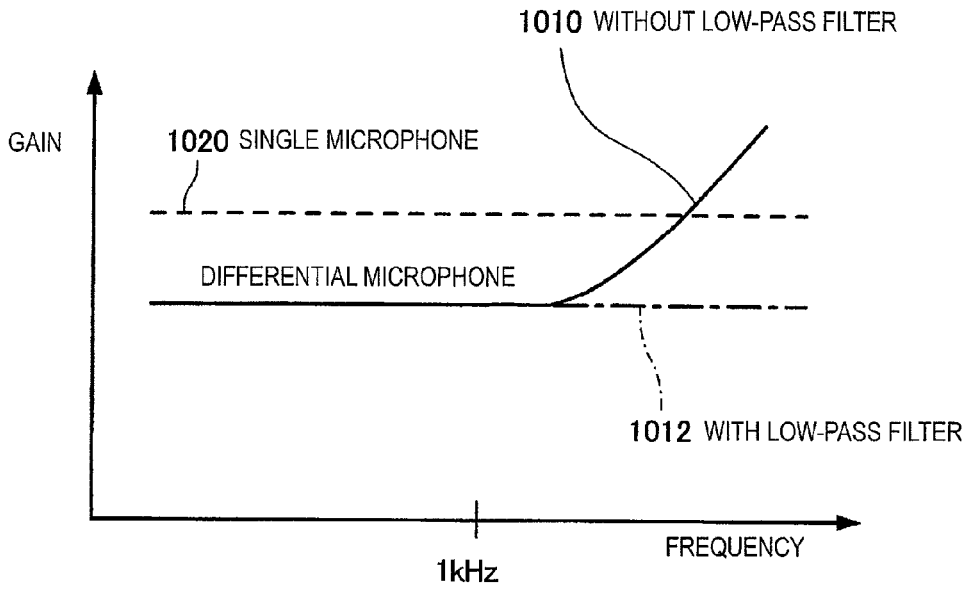
FIG. 37 is a diagram illustrating an example of the configuration of a voice input device.

FIGS. 35, 36, and 37 are diagrams illustrating examples of the configuration of the voice input device according to the fourth embodiment.

The differential signal generation section 720 may include a low-pass filter section 950. The low-pass filter section 950 blocks a high-frequency component of the differential signal. A filter having first-order cut-off properties may be used as the low-pass filter section 950. The cut-off frequency of the low-pass filter section 950 may be set at a value K of 1 kHz or more and 5 kHz or less. For example, the cut-off frequency of the low-pass filter section 950 is preferably set at about 1.5 kHz or more and about 2 kHz or less.

The gain section 760 receives the first voltage signal 712-1 obtained by the first microphone 710-1, amplifies the first voltage signal 712-1 by a predetermined amplification factor (gain), and outputs the first voltage signal S1 that has been amplified by a predetermined gain. The differential signal output section 740 receives the first voltage signal S1 amplified by the gain section 760 by a predetermined gain and the second voltage signal S2 obtained by the second microphone 710-2, generates a differential signal 742 that represents the difference between the first voltage signal S1 amplified by the predetermined gain and the second voltage signal, and outputs the differential signal 742. The low-pass filter section 950 receives the differential signal 742 output from the differential signal output section 740, and outputs a differential signal 952 obtained by attenuating high-frequency components (in the frequency band of K or more) contained in the differential signal 742.

FIG. 37 is a diagram for describing the gain characteristics of the differential microphone. The horizontal axis represents frequency, and the vertical axis represents gain. Reference numeral 1020 represents a graph showing the relationship between the frequency and the gain of a single microphone. The single microphone has flat frequency characteristics. Reference numeral 1010 represents a graph showing the relationship between the frequency and the gain of the differential microphone at an assumed speaker position, showing the frequency characteristics at a position of 50 mm from the center of the first microphone 710-1 and the second microphone 710-2, for example. Even when the first microphone 710-1 and the second microphone 710-2 have flat frequency characteristics, since the high frequency range of the differential signal increases linearly (20 dB/dec) from about 1 kHz, the frequency characteristics of the differential signal can be made flat by attenuating the high frequency range using a first-order low-pass filter having opposite characteristics. Therefore, uncomfortable feeling during hearing can be prevented.

Therefore, almost flat frequency characteristics as indicated by reference numeral 1012 can be obtained by correcting the frequency characteristics of the differential signal using the low-pass filter as illustrated in FIG. 36. In this way, it is possible to prevent the high frequency range of the speaker's voice or the high frequency range of noise from being enhanced to impair the sound quality.

Figure 38:
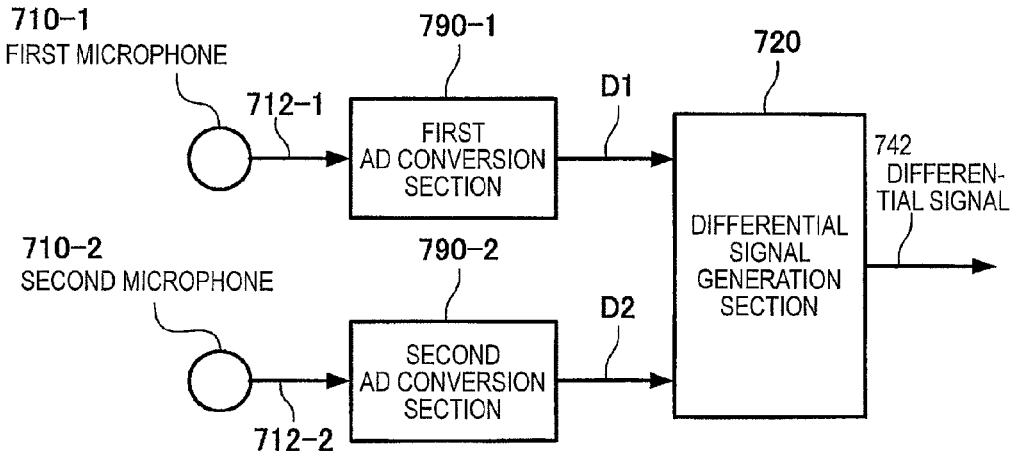
FIG. 38 is a diagram illustrating an example of the configuration of a voice input device that includes an AD conversion means.

FIG. 38 is a diagram illustrating an example of the configuration of a voice input device that includes an AD conversion means.

The voice input device according to this embodiment may include a first AD conversion means 790-1. The first AD conversion means 790-1 subjects the first voltage signal 712-1 obtained by the first microphone 710-1 to analog-to-digital conversion.

The voice input device according to this embodiment may include a second AD conversion means 790-2. The second AD conversion means 790-2 subjects the second voltage signal 712-2 obtained by the second microphone 710-2 to analog-to-digital conversion.

The voice input device according to this embodiment includes the differential signal generation section 720. The differential signal generation section 720 may generate the differential signal 742 that represents the difference between a first voltage signal 782-1 that has been converted into a digital signal by the first AD conversion means 790-1 and a second voltage signal 782-2 that has been converted into a digital signal by the second AD conversion means 790-2, by adjusting the gain balance and the delay balance through digital signal processing calculations based on the first voltage signal 782-1 and the second voltage signal 782-2.

Here, the differential signal generation section 720 may have the configuration described with reference to FIGS. 29, 31, 34, 36, and the like.

8. Configuration of Voice Input Device According to Fifth Embodiment

FIG. 20 is a diagram illustrating an example of the configuration of a voice input device according to a fifth embodiment.

The voice input device according to this embodiment may include a sound source section 770 provided at an equal distance from a first microphone (first vibrating membrane 711-1) and the second microphone (second vibrating membrane 711-2). The sound source section 770 may be formed by an oscillator or the like. The sound source section 770 may be provided at an equal distance from a center point C1 of the first vibrating membrane (diaphragm) 711-1 of the first microphone 710-1 and a center point C2 of the second vibrating membrane (diaphragm) 711-2 of the second microphone 710-2.

The difference in phase or delay between a first voltage signal S1 and a second voltage signal S2 input to a differential signal generation section 740 may be adjusted to zero based on sound output from the sound source section 770.

Moreover, the amplification factor of a gain section 760 may be changed based on sound output from the sound source section 770.

The difference in amplitude between the first voltage signal S1 and the second voltage signal S2 input to the differential signal generation section 740 may be adjusted to zero based on sound output from the sound source section 770.

Here, a sound source that produces sound having a single frequency may be used as the sound source section 770. For example, the sound source section 770 may produce sound having a frequency of 1 kHz.

Moreover, the frequency of the sound source section 770 may be set outside the audible band. For example, sound having a frequency (for example, 30 kHz) higher than 20 kHz is inaudible to the human ears. When the frequency of the sound source section 770 is set outside the audible band, the difference in phase, delay, or sensitivity (gain) between the input signals can be adjusted using the sound source section 770 during use without hindering the user.

For example, when forming a delay section 732-1 using an analog filter, the delay amount may change depending on the temperature characteristics. According to this embodiment, it is possible to perform delay adjustment in accordance with a change in environment such as a change in temperature. The delay adjustment may be performed regularly or intermittently, or may be performed when power is supplied.

9. Configuration of Voice Input Device According to Sixth Embodiment

Figure 39:
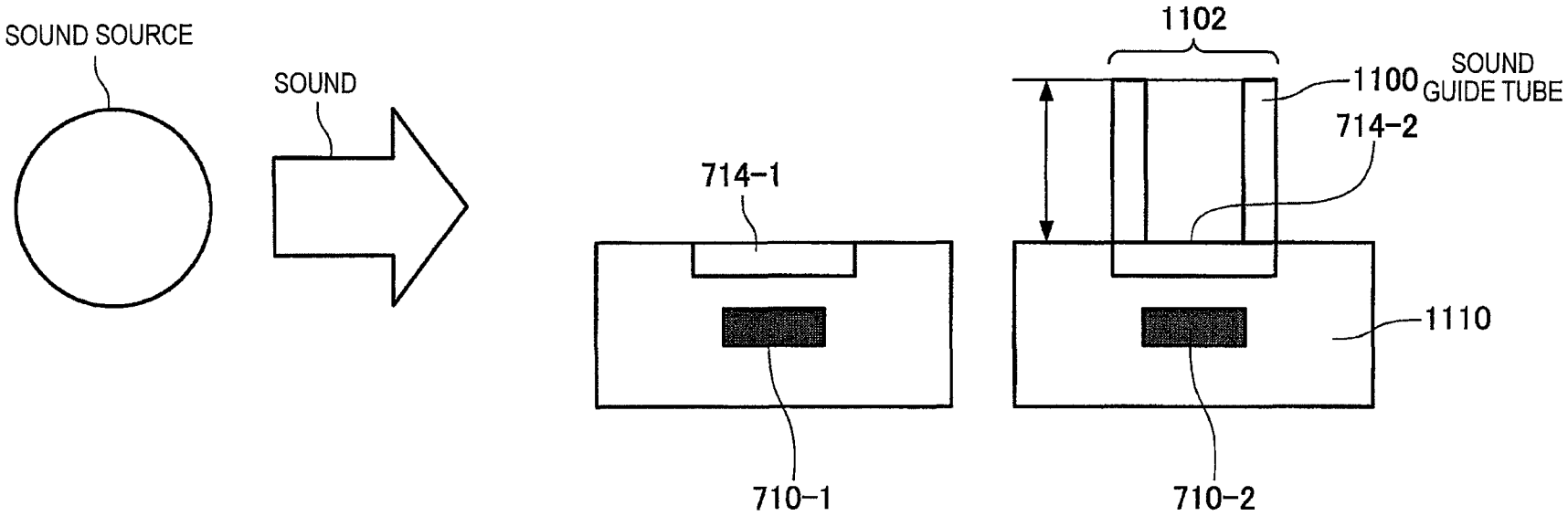
FIG. 39 is a diagram illustrating an example of the configuration of a voice input device.

FIG. 39 is a diagram illustrating an example of the configuration of a voice input device according to a sixth embodiment.

The voice input device according to this embodiment includes a first microphone 710-1 that includes a first vibrating membrane, a second microphone 710-2 that includes a second vibrating membrane, and a differential signal generation section (not shown) that generates a differential signal that represents the difference between a first voltage signal obtained by the first microphone and a second voltage signal obtained by the second microphone. At least one of the first and second vibrating membranes may acquire sound waves through a tubular sound guide tube 1100 provided perpendicularly to the surface of the vibrating membrane.

The sound guide tube 1100 may be provided on a substrate 1110 around the vibrating membrane so that sound waves that enter an opening 1102 of the tube reach the vibrating membrane of the second microphone 710-2 through a sound hole 714-2 without leaking to the outside. By doing so, sound that has entered the sound guide tube 1100 reaches the vibrating membrane of the second microphone 710-2 without being attenuated. According to this embodiment, the travel distance of sound before reaching the vibrating membrane can be changed by providing the sound guide tube to at least one of the first and second vibrating membranes. Therefore, a delay can be canceled by providing a sound guide tube having an appropriate length (for example, several millimeters) in accordance with a variation in delay balance.

The invention is not limited to the above-described embodiments, and various modifications can be made. The invention includes configurations that are substantially the same as the configurations described in the above embodiments (for example, in function, method and effect, or in objective and effect). The invention also includes a configuration in which an unsubstantial element of the above embodiments is replaced by another element. The invention also includes a configuration having the same effects as those of the configurations described in the above embodiments, or a configuration capable of achieving the same objectives as those of the above-described configurations. Further, the invention includes a configuration obtained by adding a known technique to the configurations described in the above embodiments.

This application is based on Japanese Patent Application No. 2008-132459, filed May 20, 2008, the contents of which are incorporated herein by reference.

REFERENCE SIGNS LIST

1: VOICE INPUT DEVICE
10: FIRST MICROPHONE
12: FIRST VIBRATING MEMBRANE
20: SECOND MICROPHONE
22: SECOND VIBRATING MEMBRANE

30: DIFFERENTIAL SIGNAL GENERATION SECTION
40: HOUSING
50: CALCULATION SECTION
60: COMMUNICATION SECTION
70: BASE
72: MAIN SURFACE
74: DEPRESSION
75: BOTTOM SURFACE
76: AREA
78: OPENING
80: BASE
82: MAIN SURFACE
84: FIRST DEPRESSION
85: FIRST OPENING
86: SECOND DEPRESSION
87: SECOND OPENING
100: CAPACITOR-TYPE MICROPHONE
102: VIBRATING MEMBRANE
104: ELECTRODE
300: PORTABLE PHONE
400: MICROPHONE
500: REMOTE CONTROLLER
600: INFORMATION PROCESSING SYSTEM
602: INFORMATION INPUT TERMINAL
604: HOST COMPUTER
700: VOICE INPUT DEVICE
710-1: FIRST MICROPHONE
710-2: SECOND MICROPHONE
712-1: FIRST VOLTAGE SIGNAL
712-2: SECOND VOLTAGE SIGNAL
714-1: FIRST VIBRATING MEMBRANE
714-2: SECOND VIBRATING MEMBRANE
720: DIFFERENTIAL SIGNAL GENERATION CIRCUIT
730: DELAY SECTION
734: DELAY CONTROL SECTION
740: DIFFERENTIAL SIGNAL OUTPUT SECTION
742: DIFFERENTIAL SIGNAL
750: PHASE DIFFERENCE DETECTION SECTION
752-1: FIRST BINARIZATION SECTION
752-2: SECOND BINARIZATION SECTION
754: PHASE DIFFERENCE SIGNAL GENERATION SECTION
756-1: FIRST BAND-PASS FILTER
756-2: SECOND BAND-PASS FILTER
760: GAIN SECTION
770: SOUND SOURCE SECTION
780: NOISE DETECTION DELAY SECTION
782: NOISE DETECTION DIFFERENTIAL SIGNAL GENERATION
784: SECTION
784: NOISE DETECTION SECTION
786: SIGNAL SWITCHING SECTION
790-1: FIRST AD CONVERSION MEANS
790-2: SECOND AD CONVERSION MEANS
900: AMPLITUDE DIFFERENCE DETECTION SECTION
910: GAIN CONTROL SECTION
920-1: FIRST AMPLITUDE DETECTION MEANS
920-2: SECOND AMPLITUDE DETECTION MEANS
930: AMPLITUDE DIFFERENCE DETECTION SECTION
1100: SOUND GUIDE TUBE

What is claimed is:

1. A voice input device comprising:

a first microphone that includes a first vibrating membrane;

a second microphone that includes a second vibrating membrane; and a differential signal generation section that generates a differential signal between a first voltage signal obtained by the first microphone and a second voltage signal obtained by the second microphone based on the first voltage signal and the second voltage signal, wherein the first and second vibrating membranes are disposed so that a noise intensity ratio that represents the ratio of intensity of a noise component contained in the differential signal to intensity of the noise component contained in the first or second voltage signal is smaller than an input voice intensity ratio that represents the ratio of intensity of an input voice component contained in the differential signal to intensity of the input voice component contained in the first voltage signal or the second voltage signal, and wherein the differential signal generation section includes:

a delay section that delays at least one of the first voltage signal obtained by the first microphone and the second voltage signal obtained by the second microphone by a predetermined delay amount and outputs the resulting signal; and a differential signal output section that receives the first voltage signal obtained by the first microphone and the second voltage signal obtained by the second microphone, at least one of the first and second voltage signals having been delayed by the delay section, generates a differential signal between the first voltage signal and the second voltage signal, and outputs the differential signal, wherein a center-to-center distance between the first and second vibrating membranes is set at a distance in which a chase component of a voice intensity ratio that is the ratio of the intensity of a differential sound pressure of voices incident on the first and second vibrating membranes to the intensity of a sound pressure of a voice incident on the first vibrating membrane becomes 0 dB or less with respect to sound in a frequency band of 10 kHz or less.

2. The voice input device according to claim 1, wherein the differential signal generation section includes:

a delay section that is configured so that the delay amount is changed in accordance with a current that flows through a predetermined terminal; and a delay control section that supplies the current that controls the delay amount of the delay section to the predetermined terminal, and wherein the delay control section includes a resistor array in which a plurality of resistors are connected in series or parallel, or includes at least one resistor, and is configured to be able to change the current supplied to the predetermined terminal of the delay section by cutting some of the resistors or conductors that form the resistor array or cutting a part of the at least one resistor.

3. The voice input device according to claim 1, wherein the differential signal generation section includes:

a phase difference detection section that receives the first voltage signal and the second voltage signal input to the differential signal output section, detects a phase difference between the first voltage signal and the second voltage signal when the differential signal is generated based on the first voltage signal and the second voltage signal that have been received, generates a phase difference signal based on the detection result, and outputs the phase difference signal; and a delay control section that changes the delay amount of the delay section based on the phase difference signal.

4. The voice input device according to claim 3, wherein the phase difference detection section includes:

a first binarization section that binarizes the received first voltage signal at a predetermined level to convert the first voltage signal into a first digital signal;

a second binarization section that binarizes the received second voltage signal at a predetermined level to convert the second voltage signal into a second digital signal; and a phase difference signal output section that calculates a phase difference between the first digital signal and the second digital signal and outputs the phase difference signal.

5. The voice input device according to claim 3, further comprising:

a sound source section that is provided at an equal distance from the first microphone and the second microphone, wherein the differential signal generation section includes:

a phase difference detection section that receives the first voltage signal and the second voltage signal input to the differential signal output section, detects a phase difference between the first voltage signal and the second voltage signal when the differential signal is generated based on the first voltage signal and the second voltage signal that have been received, generates a phase difference signal based on the detection result, and outputs the phase difference signal; and a delay control section that changes the delay amount of the delay section based on the phase difference signal, and wherein the delay control section changes the delay amount of the delay section based on sound output from the sound source section.

6. The voice input device according to claim 5, wherein the sound source section is a sound source that produces sound having a single frequency.

7. The voice input device according to claim 5, wherein the frequency of the sound source section is set outside an audible band.

8. The voice input device according to claim 3, wherein the phase difference detection section includes:

a first band-pass filter that receives the first voltage signal and allows a component having the single frequency to pass therethrough; and a second band-pass filter that receives the second voltage signal and allows a component having the single frequency to pass therethrough, wherein the phase difference detection section detects the phase difference based on the first voltage signal that has passed through the first band-pass filter and the second voltage signal that has passed through the second band-pass filter.

* * * * *